US010526846B2

(12) United States Patent
Barbera

(10) Patent No.: US 10,526,846 B2
(45) Date of Patent: Jan. 7, 2020

(54) MATERIAL EXHAUST CONNECTION FOR HORIZONTAL BORE

(71) Applicant: Barbco, Inc., East Canton, OH (US)

(72) Inventor: Anthony Barbera, Massillon, OH (US)

(73) Assignee: Barbco, Inc., East Canton, OH (US)

( * ) Notice: Subject to any disclaimer, the term of this patent is extended or adjusted under 35 U.S.C. 154(b) by 0 days.

(21) Appl. No.: 15/890,624

(22) Filed: Feb. 7, 2018

(65) Prior Publication Data

US 2018/0163475 A1 Jun. 14, 2018

Related U.S. Application Data

(63) Continuation-in-part of application No. 15/634,381, filed on Jun. 27, 2017, and a continuation-in-part of application No. 14/908,330, filed as application No. PCT/US2015/018847 on Mar. 5, 2015, now Pat. No. 10,180,031.

(60) Provisional application No. 61/948,798, filed on Mar. 6, 2014.

(51) Int. Cl.

| | |
|---|---|
| ***E21B 7/04*** | (2006.01) |
| ***E21B 7/20*** | (2006.01) |
| *E21B 7/06* | (2006.01) |
| *E21B 7/28* | (2006.01) |

(52) U.S. Cl.

CPC ..... *E21B 7/046* (2013.01); *E21B 7/20* (2013.01); *E21B 7/061* (2013.01); *E21B 7/201* (2013.01); *E21B 7/28* (2013.01)

(58) Field of Classification Search

CPC ..... E21B 7/046; E21B 7/20; E21B 21/16

See application file for complete search history.

(56) References Cited

U.S. PATENT DOCUMENTS

| | | | |
|---|---|---|---|
| 1,932,068 | A | 10/1933 | Englebright et al. |
| 3,902,563 | A | 9/1975 | Dunn |
| 3,920,090 | A | 11/1975 | McQueen et al. |
| 4,043,136 | A | 8/1977 | Cherrington |
| 4,117,895 | A | 10/1978 | Ward et al. |
| 4,280,571 | A | 7/1981 | Fuller |
| 4,787,465 | A | 11/1988 | Dickinson, III et al. |
| 4,809,793 | A | 3/1989 | Hailey |
| 4,828,050 | A | 5/1989 | Hashimoto |
| 5,255,750 | A | 10/1993 | Wilkes, Jr. et al. |
| 5,314,267 | A | 5/1994 | Osadchuk |
| 5,355,967 | A | 10/1994 | Mueller et al. |
| 5,375,669 | A | 12/1994 | Cherrington |
| 5,437,500 | A | 8/1995 | Lehmann et al. |
| 5,711,385 | A | 1/1998 | Brotherton |
| 6,142,246 | A | 11/2000 | Dickinson, III et al. |

(Continued)

*Primary Examiner* — Kristyn A Hall

(74) *Attorney, Agent, or Firm* — Sand, Sebolt & Wernow Co., LPA

(57) ABSTRACT

An earth boring apparatus may include an earth-boring cutter head, and a casing secured to the cutter head and extending rearwardly therefrom so that the casing and cutter head are rotatable together as a unit. A casing cuttings passage may extend from adjacent the casing front end to adjacent the casing back end. An entrance opening of the casing cuttings passage, which is adjacent the cutter head, is adapted to allow cuttings to move through the entrance opening into the casing cuttings passage. In some implementations there may be a stationary auger positioned within the casing cuttings passage rearwardly from the entrance opening, such that the stationary auger does not rotate when the casing and cutter head are rotated together as a unit.

21 Claims, 28 Drawing Sheets

(56) References Cited

U.S. PATENT DOCUMENTS

| | | | |
|---|---|---|---|
| 6,237,701 | B1 | 5/2001 | Kolle et al. |
| 6,682,264 | B1 | 1/2004 | McGillis |
| 6,902,014 | B1 | 6/2005 | Estes |
| 7,114,583 | B2 | 10/2006 | Chrisman |
| 7,389,831 | B2 | 6/2008 | Mullins et al. |
| 7,484,574 | B2 | 2/2009 | Burnett et al. |
| 7,493,969 | B2 | 2/2009 | Burnett et al. |
| 7,845,432 | B2 | 12/2010 | Salins et al. |
| 8,113,741 | B1 | 2/2012 | Vidovic et al. |
| 8,151,906 | B2 | 4/2012 | Salins et al. |
| 8,210,774 | B1 | 7/2012 | Vidovic et al. |
| 8,256,536 | B2 | 9/2012 | Harrison et al. |
| 8,393,828 | B1 | 3/2013 | Vidovic et al. |
| 8,439,132 | B2 | 5/2013 | Salins et al. |
| 8,567,530 | B2 | 10/2013 | Barbera |
| 2009/0152008 | A1 | 6/2009 | Salins et al. |
| 2009/0152010 | A1 | 6/2009 | Salins et al. |
| 2009/0152012 | A1 | 6/2009 | Salins et al. |
| 2009/0288883 | A1 | 11/2009 | Barbera |
| 2009/0301783 | A1 | 12/2009 | Salins |
| 2011/0209921 | A1 | 9/2011 | Barbera |
| 2012/0241221 | A1 | 9/2012 | Salins et al. |
| 2016/0160566 | A1 | 6/2016 | Engle |

| FIG.11A | FIG.11B | FIG.11B |
|---|---|---|

MATERIAL EXHAUST CONNECTION FOR HORIZONTAL BORE

CROSS REFERENCE TO RELATED APPLICATIONS

This application is a continuation-in-part of U.S. application Ser. No. 15/634,381, filed on Jun. 27, 2017, and U.S. application Ser. No. 14/908,330 filed Jan. 28, 2016, which is a National Phase of PCT Application No. US2015/018847 filed Mar. 5, 2015, which claims priority to Provisional Application No. 61/948,798 filed Mar. 6, 2014, the disclosure of which is incorporated herein by reference.

BACKGROUND

Technical Field

The invention relates generally to an apparatus and method for drilling generally horizontal boreholes. More particularly, the invention is directed to a cutting assembly in which pressurized air is used to facilitate removal of the spoil or cuttings from the borehole. Specifically, the invention relates to a cutting assembly having a front cutting head and a larger diameter rear cutting head. A housing extends rearwardly from the rear cutting head and connects to a casing. An annular collar on the cutting assembly seals the borehole cut by the rear cutting head. Cuttings are moved through an air passage in the cutting assembly and into the casing using pressurized air and an independently rotating auger located in the housing.

BACKGROUND INFORMATION

Underground boring machines have been used for many years in the drilling of generally horizontal boreholes. The machines may be used to drill boreholes that are substantially straight and those which are arcuate for the primary purpose of avoiding or bypassing an obstacle. Often such boreholes are formed by initially drilling or otherwise forming a pilot hole of a generally smaller diameter, followed by the use of an enlarged cutting head that follows the path of the pilot hole in order to enlarge the borehole.

In some cases, it may take only one pass in addition to the pilot hole to create the desired final diameter of the borehole. In other cases, the first cutting device is removed from the pilot hole and additional larger cutting devices may be used to drill the borehole in as many passes as necessary to achieve the desired diameter of borehole.

Many of the boring machines utilize an auger which is rotated in order to force the cuttings or spoil to be removed from the borehole. Such augers may be disposed in a casing and have an outer diameter which is slightly smaller than that of the inner diameter of the casing in which the auger is disposed. Drilling fluid or mud is often pumped into the borehole either within a casing or external to a casing in order to facilitate the cutting process and removal of the cuttings. Drilling fluids or lubricants may involve water, bentonite or various types of polymers, etc. The use of certain types of drilling fluids may present environmental hazards and may be prohibited by environmental laws or regulations in certain circumstances. The inadvertent return of drilling lubricant to the surface, typically referred to as "frac-out", may be of particular concern when the drilling occurs under sensitive habitats or waterways. Although bentonite is non-toxic, the use of a bentonite slurry may be harmful to aquatic plants and fish and their eggs, as these may be smothered by the fine bentonite particles if discharged into waterways.

Other issues faced in drilling applications include that the terrain itself may cause disruptions to drilling. In some instances where boring systems utilize augers to remove the cuttings from the borehole these augers are typically formed in sections that are sequentially added rearwardly as the borehole becomes longer and can accommodate additional auger sections. Given that many boreholes may be several hundred feet long, an auger of such length adds a substantial amount of weight and frictional resistance to the rotation thereof. In some instances it may be necessary to install a product with a required bend radius and the length of the drill required in these instances can be substantial in order to achieve the desired radius.

SUMMARY

There remains a need in the art for improvements with respect to boring apparatus and methods to address the above-noted problems.

An apparatus and method for drilling an underground borehole is disclosed herein. The apparatus and method addresses some of the identified problems of previously known devices and methods.

In the presently disclosed apparatus and method pressurized air may be used to discharge cuttings produced by the disclosed cutting assembly. The cutting assembly may include a front cutting head and a larger diameter rear cutting head mounted on a shaft. An air passage defined through the cutting assembly may be placed in fluid communication with a pressurized remote air source and with a bore of a casing extending rearwardly from the cutting assembly. Pressurized air flows through the air passage and entrains cuttings produced by the front and rear cutting heads. A housing extends rearwardly from the larger diameter rear cutting head and an auger provided within the housing aids in directing cuttings into the casing. The auger rotates independently of the rest of the cutting assembly and may be configured to further reduce the size of the cuttings being moved thereby. A collar on the housing seals the borehole cut by the rear cutting assembly and aids in preventing frac-out.

In one aspect, the invention may provide a cutting assembly for drilling a borehole, said cutting assembly comprising a front cutting head of a first diameter; a rear cutting head of a second diameter, wherein the second diameter is greater than the first diameter; a shaft operatively engaging the front cutting head and the rear cutting head; wherein said rear cutting head is located rearwardly of the front cutting head along the shaft; and wherein the front cutting head, the rear cutting head and the shaft are rotatable in unison about a longitudinal axis of the shaft in a first direction; and an air passage defined in the cutting assembly; said air passage adapted to be operatively engaged with a remote air source located forwardly of the cutting assembly and with a bore of a casing located rearwardly of the cutting assembly; wherein pressurized air from the remote air source flows through the air passage and entrains cuttings produced by the front cutting head and the rear cutting head and directs the cuttings into the bore of the casing.

In another aspect, the invention may provide an apparatus for drilling boreholes comprising a cutter assembly; a swivel; and a casing; wherein the cutter assembly connectable between the swivel and the casing; said cutter assembly comprising a front cutting head of a first diameter; a rear cutting head of a second diameter, wherein the second diameter is greater than the first diameter; and wherein said rear cutting head is located rearwardly of the front cutting head; a shaft engaging the front cutting head to the rear cutting head; wherein the front cutting head, the rear cutting head and shaft are rotatable in unison in a first direction about a longitudinal axis of the shaft; and an air passage defined in the cutting assembly; wherein the air passage is in fluid communication with a bore defined by the swivel and with a bore defined by the casing; wherein the apparatus is adapted to be operatively engaged with a remote air source; and wherein pressurized air flowing from the air source through the bore of the swivel and through the air passage entrains cuttings produced by the front cutting head and the rear cutting head and directs the cuttings towards the bore of the casing.

In another aspect, the invention may provide a method of drilling an underground borehole comprising steps of rotating and moving forward a cutting assembly and a casing extending rearwardly from the cutting assembly; cutting a first diameter borehole with a first diameter front cutting head provided on the cutting assembly; cutting a second diameter borehole with a second diameter rear cutting head provided on the cutting assembly, wherein the rear cutting head is located rearwardly of the front cutting head on a shaft of the cutting assembly; moving pressurized air rearwardly through a first air passage formed in the front cutting head and through a second air passage formed in the rear cutting head; entraining cuttings produced by the front cutting head and the rear cutting head in the moving pressurized air; and directing the pressurized air with entrained cuttings into a bore of the casing extending rearwardly from the cutting assembly.

The method may further comprise sealing the second diameter borehole with a collar provided on the cutting assembly. The method may further comprise rotating the front cutting head, the rear cutting head and the shaft in a first direction about a longitudinal axis of the shaft; selectively rotating an auger provided on the cutting assembly in either of the first direction or the second direction; and directing the pressurized air with entrained cuttings towards the auger and subsequently into the bore of the casing. The method may further comprise rotating the front cutting head, the rear cutting head and the shaft at a first speed; and selectively rotating the auger at the first speed or at a second speed that is greater than the first speed or is less than the first speed.

The method may further comprise contacting the entrained cuttings with teeth provided on the auger; and reducing a size of the entrained cuttings with the teeth. The method may further comprise a step of adjusting back pressure in the first air passage and the second air passage by changing a pattern of holes in an end plate provided on the auger.

In yet another aspect, an exemplary embodiment of the present disclosure may provide a method for drilling through earthen material comprising: directing a gas through a pilot tube disposed below ground; directing the gas near a portion of a drilling head disposed below ground in operative communication with the pilot tube; directing the gas through an interior bore defined by a first casing segment; wherein the gas moving through the chamber carries spoils cut by the cutting head rearwardly through a second casing segment connected to the first casing segment. Additionally, this embodiment or another exemplary embodiment may provide directing the gas around an auger located within the first casing segment. Additionally, this embodiment or another exemplary embodiment may provide directing the gas through the interior bore of the first casing segment while the first casing segment is rotating about a longitudinal axis. This embodiment or another exemplary embodiment may provide wherein the auger is stationary and does not rotate about the longitudinal axis. Additionally, this embodiment or another exemplary embodiment may provide directing the gas around a first section of a stationary flute of the auger having a first diameter, and thereafter directing the gas around a second section of the stationary flute having a second diameter less than the first diameter, wherein the first section is associated with a forward end of the auger such that the auger is rearwardly tapered. Additionally, this embodiment or another exemplary embodiment may provide directing the gas through an aperture defined in the stationary flute of the auger. Additionally, this embodiment or another exemplary embodiment may provide directing the gas around a forward facing surface on the stationary flute of the auger. Additionally, this embodiment or another exemplary embodiment may provide directing the gas through the interior bore of the first casing segment while the first casing segment is rotating about a longitudinal axis; directing the gas to flow through a tapered portion of the first casing segment. Additionally, this embodiment or another exemplary embodiment may provide increasing a velocity of the flowing gas carrying the spoils downstream from the tapered portion of the first casing segment. Additionally, this embodiment or another exemplary embodiment may provide increasing pressure in the gas inside the first casing segment; generating a pocket of gas retained behind spoils that increases in pressure until the pocket of gas behind the spoils overcomes forces retaining the spoils inside the first casing segment; releasing the pocket of gas, in one or more burps, in response to the pocket of gas overcoming the forces that retain the spoils in the first casing segment.

In yet another aspect, an exemplary embodiment of the present disclosure may provide a method for drilling through earthen material comprising: rotating a first casing segment about a longitudinal axis disposed below ground; receiving spoils composed of cut aggregate material carried by a gas in the first casing segment; advancing the first casing segment forwardly simultaneous to rotation of the first casing segment to cut earthen material into aggregate material; and effecting rearwardly displacement of the cut aggregate material carried by the gas through the first casing segment. Additionally, this embodiment or another exemplary embodiment may provide effecting aggregate material to pass along a portion of an auger at least partially disposed within the first casing segment. Additionally, this embodiment or another exemplary embodiment may provide maintaining the auger stationary relative to the first casing segment so that the auger does not rotate about the longitudinal axis. Additionally, this embodiment or another exemplary embodiment may provide maintaining an a longitudinally aligned aperture formed in a flight of the auger in a fixed orientation relative to the longitudinal axis. Additionally, this embodiment or another exemplary embodiment may provide rotating the auger about the longitudinal axis relative to the first casing segment. Additionally, this embodiment or another exemplary embodiment may provide rotating a longitudinally aligned aperture formed in a flight of the auger about the longitudinal axis. Additionally, this embodiment or another exemplary embodiment may provide rotating the auger opposite a rotational direction of the first casing segment. Additionally, this embodiment or another exemplary embodiment may provide channeling the gas near a portion of a cutting head connected to the first casing segment such that the cutting head rotates in unison with the first casing segment; precluding the gas from flowing exterior the first casing segment; and effecting cut aggregate material to be mixed with the gas inside the first casing segment between an inner surface of the first casing segment and an outer surface of a stationary auger disposed within the first casing segment.

In yet another aspect, an exemplary embodiment of the present disclosure may provide an earth boring apparatus comprising: an earth-boring cutter head; a casing secured to the cutter head and extending rearwardly therefrom so that the casing and cutter head are rotatable together as a unit, the casing having a casing front end and a casing back end; a casing cuttings passage which extends from adjacent the casing front end to adjacent the casing back end; an entrance opening of the casing cuttings passage which is adjacent the cutter head and adapted to allow cuttings to move through the entrance opening into the casing cuttings passage; and a stationary auger positioned within the casing cuttings passage rearwardly from the entrance opening, wherein the stationary auger does not rotate when the casing and cutter head are rotated together as a unit.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1A:
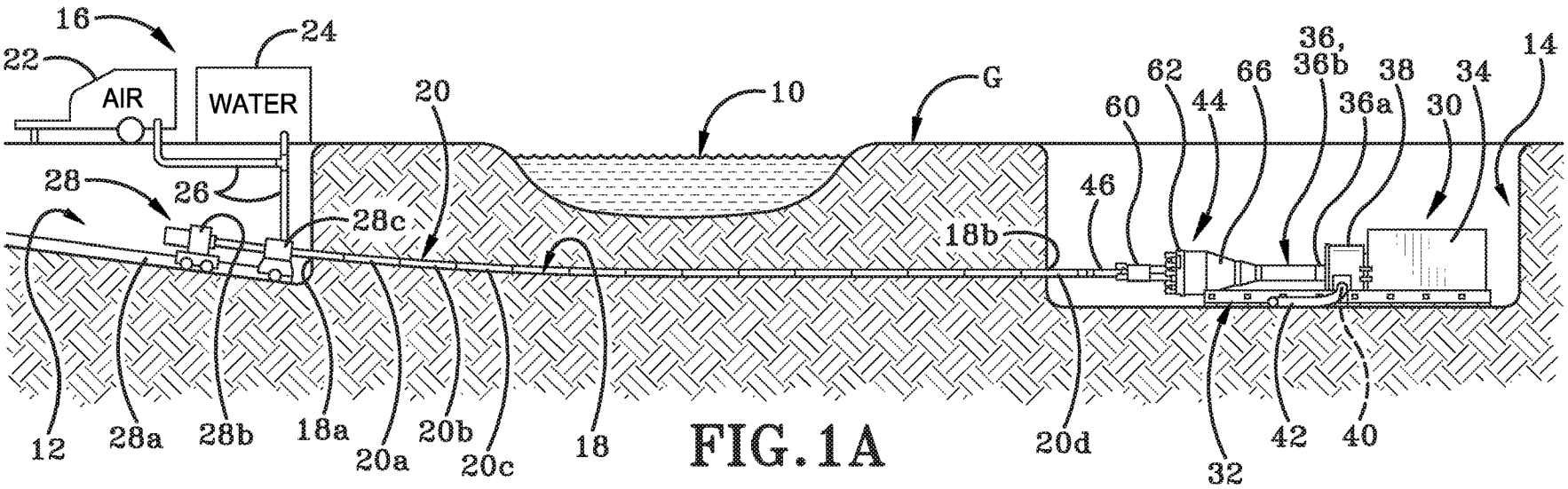
FIG. 1A (FIG. 1A) is a diagrammatic side elevation view of a horizontal directional drilling system with the ground shown in section to illustrate a pilot hole formed in the ground with the pilot tube remaining within the pilot hole.

FIG. 1 shows an area of terrain or ground "G" that includes an environmental obstacle 10 under which it is necessary to drill a borehole in order to lay a length of pipe. The obstacle 10 in this particular instance is illustrated as a body of water such as a stream, a river, a pond or a lake. It will be understood, however, that obstacle 10 may represent any other type of obstacle such as roads, buildings, walls, and trees and so forth such that trenchless or horizontal directional drilling (HDD drilling) is desirable or required.

In order to conduct a drilling operation in ground "G", a first pit 12 is dug in the ground "G" on one side of obstacle 10 and a second pit 14 is dug in ground "G" on the opposite side of obstacle 10. First pit 12 may be used to set up a control assembly 16 that may include a variety of different pieces of equipment at various times. Some of the equipment may be utilized to drill a pilot hole 18 from first pit 12 to second pit 14 and for inserting a pilot tube 20 therein. Pilot hole 18 (and a larger diameter borehole cut by a cutting assembly in accordance with an aspect of the present invention—to be discussed later herein) may be of a substantial length such as 50, 76, 150, 200, 250 or 300 feet or more. Thus, first and second pits 12, 14 may be located a distance remote from each other. The method of drilling of pilot tube 18 and the insertion of a pilot tube 20 in pilot hole 18 are known in the art and are therefore not discussed in greater detail herein. Pilot tube 20 may be made up of a plurality of pilot tube segments 20*a*, 20*b*, 20*c*, 20*d* and so on, that are connected to one another in an end-to-end fashion and are selectively engageable with and detachable from one another. For instance, each adjacent pair of segments, such as segments 20*a* and 20*b*; and 20*b* and 20*c*, may be joined to one another by a threaded engagement or by any other suitable type of connection known in the art. Each of segments 20*a*, 20*b*, 20*c*, 20*d* etc. defines a bore therein that extends from one end of the segment to the other end thereof. When the various segments are connected together, the pilot tube segment bores are put in fluid communication with one another. Pilot tube 20 thereby defines a bore therethrough that extends from the front end of the pilot tube 20 to the rear end thereof. For the purpose of the present description the front end of pilot tube 20 may be considered to be that part of the pilot tube 20 that is closest to first pit 12 and the rear end of pilot tube 20 is that part of the pilot tube that is initially adjacent second pit 14.

In accordance with an aspect of the present invention, control assembly 16 may include an air supply, such as air compressor 22, and a water supply 24 positioned in or adjacent first pit 12. Air compressor 22 and water supply 24 are operatively engaged via hoses or conduits 26 to pilot tube 20. The hoses or conduits 26 put air compressor 22 and water supply 24 into fluid communication with the bore defined in pilot tube 20. Air compressor 22 and water supply 24 may selectively provide pressurized air or water or another fluid, respectively, to pilot tube 20 and thereby to a cutting assembly that is connected to pilot tube 20, as will be described later herein.

A cutting assembly 44 in accordance with an aspect of the invention is operatively engaged with pilot tube 20 and is thereby put into fluid communication with air compressor 22 and water supply 24. Preferably in accordance with an aspect of the present invention, only pressurized air is caused to flow through the pilot tube 20 from air compressor 22 through an air passage defined in cutting assembly 44. The pressurized air flows through the air passage in cutting assembly 44 in order to discharge cuttings produced by cutting assembly 44 into a casing 36 attached to cutting assembly 44 and to move the cuttings through and out of the casing 36. Not using water or other liquids to discharge the cuttings produced by cutting assembly 44 aids in protecting the environment and aids in preventing frac-out during cutting operations.

Figure 1B:
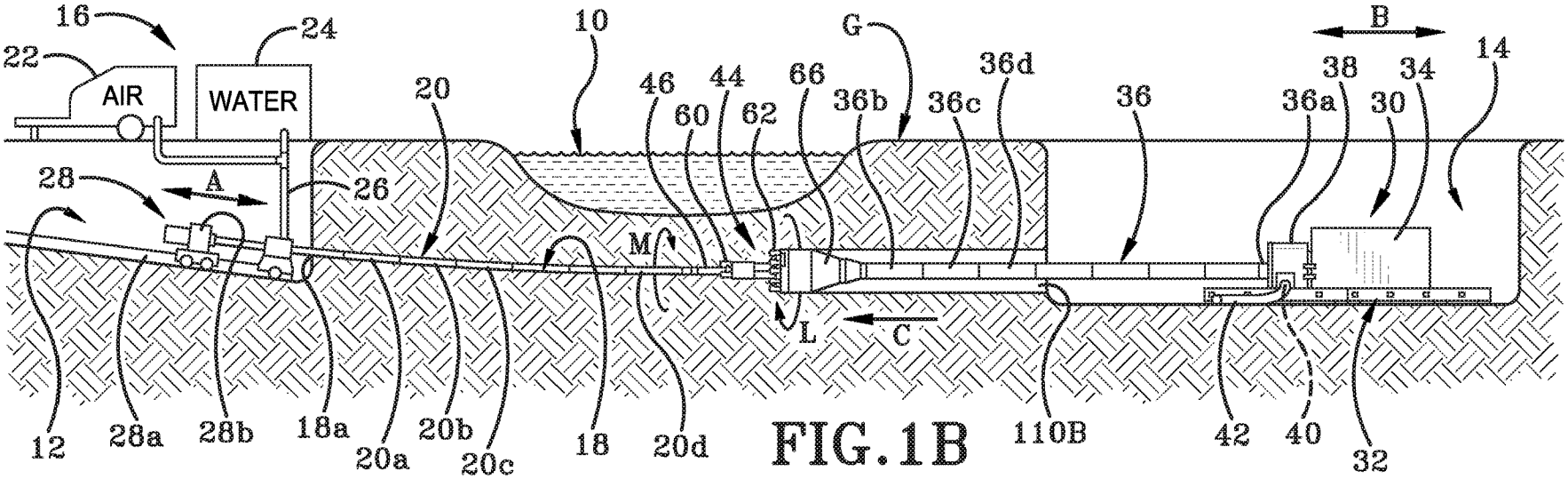
FIG. 1B (FIG. 1B) is a diagrammatic side elevation view of the horizontal directional drilling system with the ground shown in section showing the pilot tube remaining in the pilot hole and showing a cutting assembly in accordance with an aspect of the present invention engaged with the pilot tube.

Control assembly 16 may also comprise a drilling rig assembly 28 that includes tracks 28*a* anchored in first pit 12 and a motor 28*b* that is able to move back and forth in the manner indicated by arrows "A" (FIG. 1B). Motor 28*b* may be selectively engaged via a swivel assembly 28*c* to sections 20*a*, 20*b*, 20*c*, and 20*d* of pilot tube 20 during installation of pilot tube 20 and during subsequent removal thereof as drilling operations progress. Motor 28*b* is actuated to rotate pilot tube 20 about a longitudinal axis of tube 20.

A horizontal directional drilling (HDD) rig 30 may be placed in second pit 14. HDD rig 30 may include tracks 32 (FIG. 1A) that are anchored to ground "G" in the second pit 14. HDD rig 30 is able to move forward and rearward on tracks 32 during a drilling or boring operation in the direction indicated by arrows "B" (FIG. 1B). While tracks 32 are shown in FIGS. 1A and 1B as being horizontally oriented it will be understood that they may, instead, be angled relative to the horizontal. If this latter situation is the case then the pilot hole 18 at its rear end 18*b* adjacent second pit 14 may be oriented at an angle relative to the horizontal.

Rig 30 may include an engine 34 that rotates a drive shaft that is coupled to a rearmost segment 36*a* of a casing 36. Rig 30 may further include a front discharge box 38. Casing segment 36*a* may originate within discharge box 38 and extend forwardly out of discharge box 38. Discharge box 38 may also have an outlet or exit port 40 that may have connected to it a discharge conduit or hose 42. During forward and rearward movement of rig 30 as indicated by arrow "B" in FIG. 1B, the engine 34, front discharge box 38, rearward casing segment 36*a* and hose 42 move relative to tracks 32 and ground "G".

As indicated previously herein, an earth-boring or cutting assembly 44 in accordance with an aspect of the present invention may be secured between pilot tube 20 and casing 36. Engine 38 is provided to drive cutting assembly 44 in a forward direction (i.e., from second pit 14 towards first pit 12) and to rotate cutting assembly 44 in order to cut through the ground "G".

Figure 2:
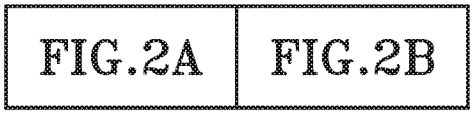
FIG. 2 (FIG. 2) is a block diagram showing that the components illustrated in FIG. 2A and FIG. 2B are oriented in a particular manner.
Figure 2A:
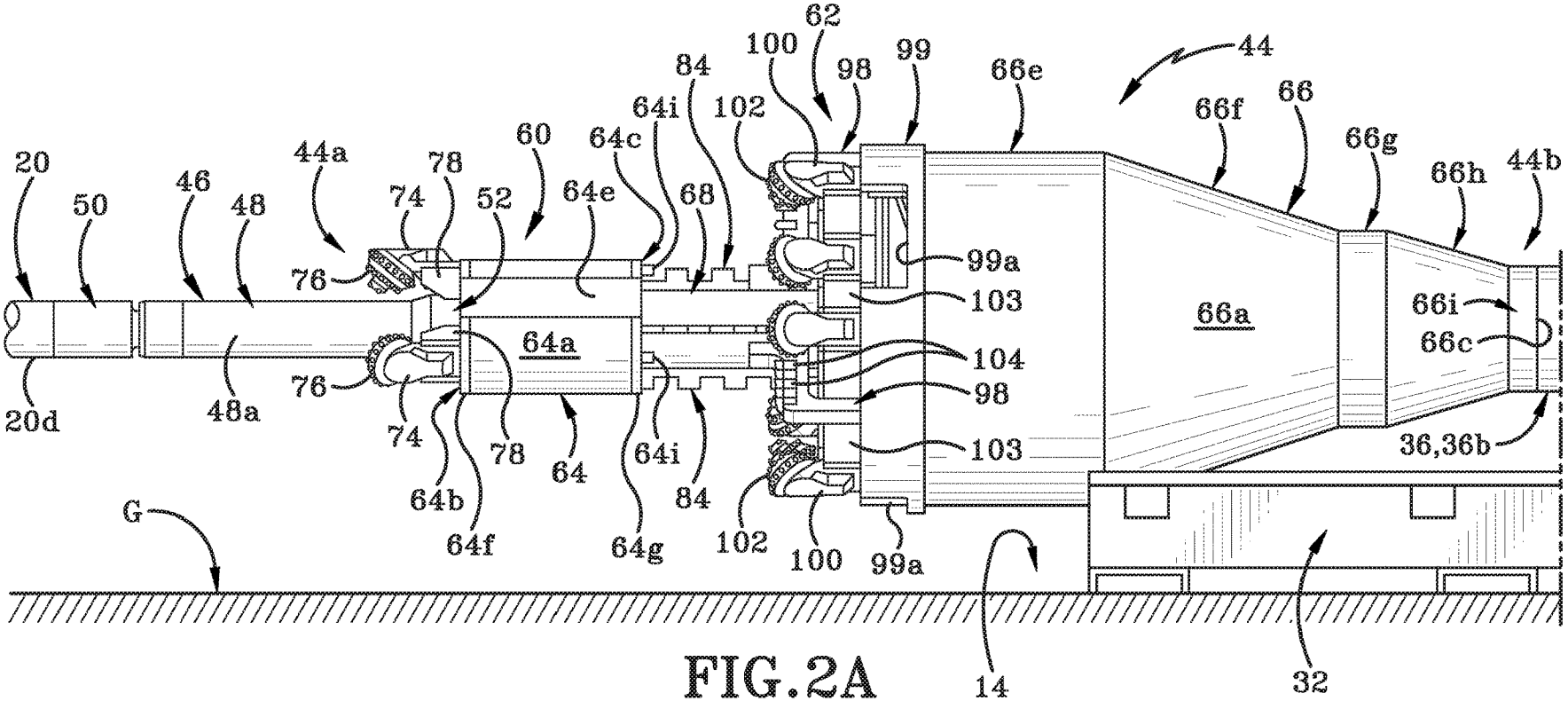
FIG. 2A (FIG. 2A) is a side elevational view showing a front end of the cutting assembly in accordance with the an aspect of the present invention engaged with the pilot tube via a swivel.
Figure 2B:
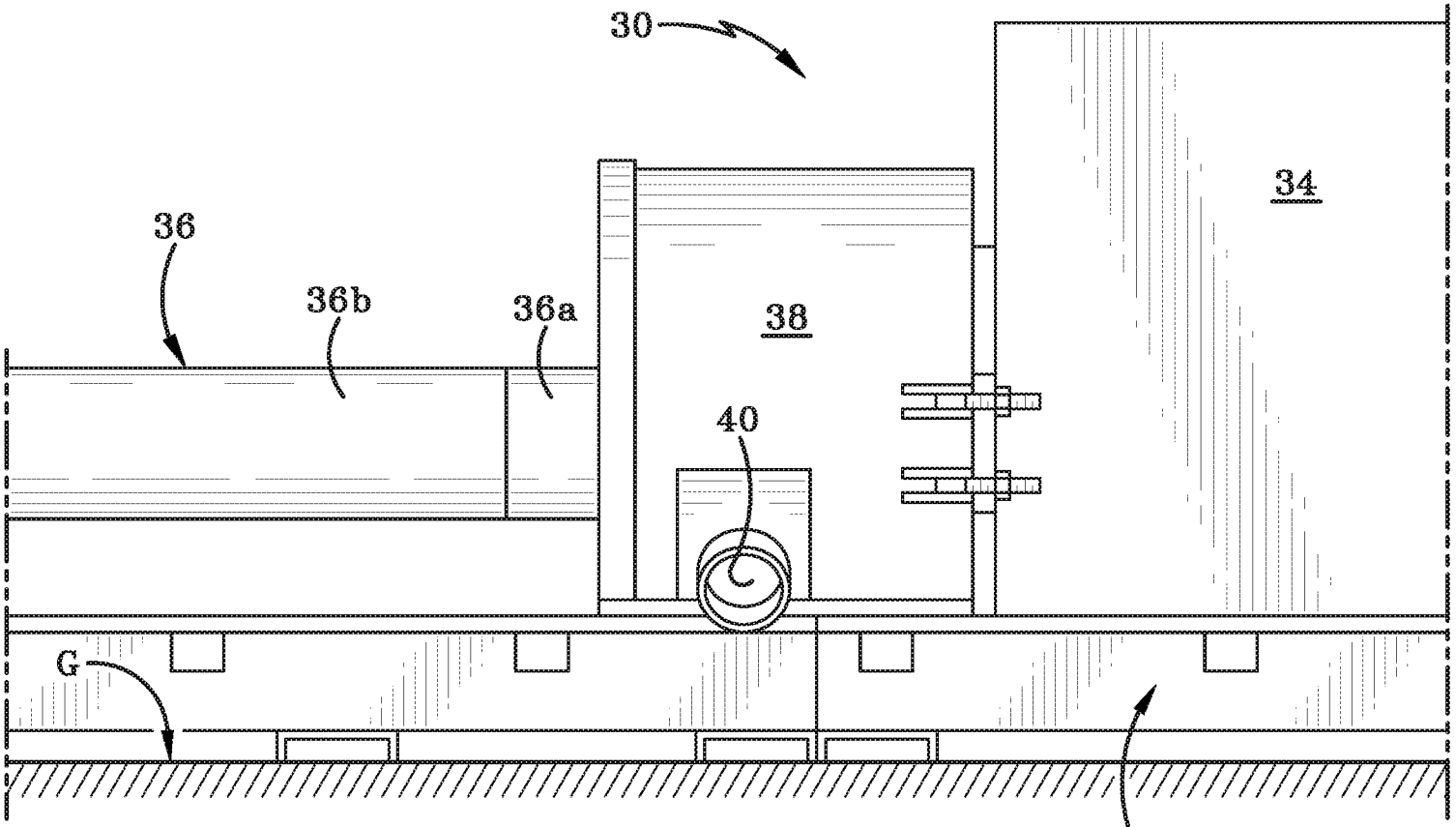
FIG. 2B (FIG. 2B) is a side elevation view showing a portion of a casing extending from a rear end of the cutting assembly of FIG. 2A where the casing is engaged with and extends forwardly from a power drive of a horizontal directional drilling rig.

FIG. 2A shows that cutting assembly 44 has a front end 44*a* and a rear end 44*b*. While engaged with pilot tube 20, cutting assembly 44 will advance and cut through the earth in the direction indicated by arrow "C" in FIG. 1B, i.e., in a direction from second pit 14 towards first pit 12. As the cutting operation progresses and cutting assembly 44 moves towards first pit 12, segments of pilot tube 20 are successively removed. At the same time, additional casing segments, such as segments 36*b*, 36*c*, and 36*d* will be successively added between cutting assembly 44 and the rearmost casing segment 36*a*. In other words, as cutting advances in the direction of arrow "C", the pilot tube 20 progressively gets shorter and the casing 36 (made up of casing segments 36*a*, 36*b*, 36*c*, 36*d* etc.) will progressively get longer. The casing segment 36*b* will be referred to in this description as forwardmost casing segment 36*b*.

Figures 11, 11A:
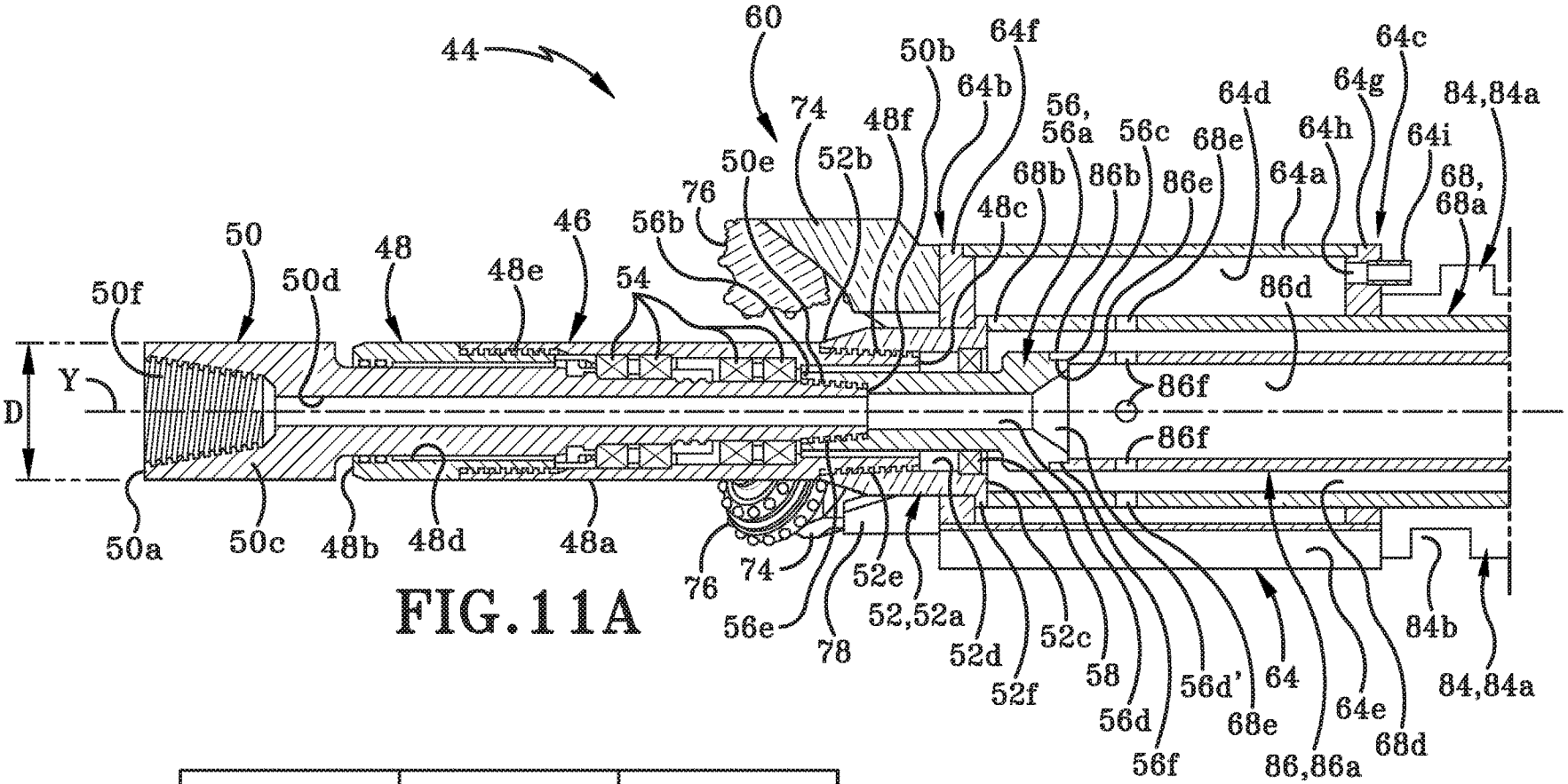
FIG. 11 (FIG. 11) is a block diagram showing that the components illustrated in FIG. 11A, FIG. 11B, and FIG. 11C are oriented in a particular manner, and wherein FIGS. 11A, 11B, and 11C together are a longitudinal cross-section taken along line 11-11 of FIG. 10.
FIG. 11A (FIG. 11A) is a longitudinal cross-section of the front cutting head and central shaft of the cutting assembly.

Front end 44*a* of cutting assembly 44 is secured to a rearmost segment 20*d* of pilot tube 20 via a swivel 46. Swivel 46 ensures that cutting assembly 44 is able to rotate without rotating pilot tube 20. FIG. 11A shows that swivel 46 may include an outer portion 48 and an inner portion 50 which are rotatable relative to one another about a longitudinal axis "Y". Outer portion 48 may include a generally cylindrical sidewall 48*a* that has a front end 48*b* and a rear end 48*c*. Rear end 48*c* may serve as the rear end of swivel 46. Sidewall 48*a* of outer portion 48 may comprise, for example, two segments which are threadedly secured to one another at a threaded connection 48*e*. Outer portion 48 may include an externally threaded portion 48*f* proximate rear end 48*c* that may threadedly engage a front end of a swivel mount 52.

Swivel mount 52 may have a generally circular peripheral wall 52*a* having a front end 52*b* and a rear end 52*c*. Peripheral wall 52*a* may taper towards front end 52*b*. Peripheral wall 52*a* may have an inner surface that bounds and defines an interior bore 52*d*. An internally threaded portion 52*e* of the inner surface of wall 52*a* may extend rearwardly from front end 52*b*. A threaded connection may be made between threads 48*e* on outer portion 48 and threads 52*e* on swivel mount 52. This threaded engagement may secure outer portion 48 rigidly on swivel mount 52. Outer portion 48 may extend outwardly and forwardly from front end 52*b* of swivel mount 52.

Sidewall 48*a* may have a cylindrical outer surface which may be concentric about longitudinal axis "Y" and define an outer diameter "D" (FIG. 11A). Outer portion 48 may further include an inner surface that extends from front end 48*b* to rear end 48*c* and bounds and defines a bore 48*d* that likewise extends from front end 48*b* to rear end 48*c* of swivel 46. Swivel mount 52 also has an annular shoulder 52*f* that is of a greater diameter than the rest of the peripheral wall 52*a* of the swivel mount 52. Annular shoulder 52*f* is located proximate rear end 52*c* of swivel mount 52.

Inner portion 50 of swivel 46 has a front end 50*a* and a rear end 50*b*. Front end 50*a* may serve as the front end of swivel 46. Inner portion 50 includes a sidewall 50*c* which defines an air passage 50*d* that extends from front end 50*a* to rear end 50*b*. Sidewall 50*c* may be concentric about longitudinal axis "Y" and an inner surface that bounds and defines swivel air passage 50*d* extends from front end 50*a* to rear end 50*b* of inner portion 50. A front region of sidewall 50*c* proximate front end 50*a* may be of a greater diameter than a rear region proximate rear end 50*b*. The rear region may be tapered and be externally threaded with threads 50*e* (FIG. 11A). Sidewall 50*c* may also include a middle region that is located between the greater diameter front region proximate front end 40*a* and the tapered region proximate rear end 50. The middle region of inner portion 50 may be received in bore 48*d* and the outer surface of the middle region of side wall 50*c* may be spaced from the inner surface of the outer portion 48. A plurality of bearings 54 may be provided within bore 48*d* and extend from the inner surface of the outer region 48 to the outer surface of the inner region 50. The greater diameter section of sidewall 50*c* may have an internally threaded and tapered portion 50*f* adjacent and extending rearwardly from front end 50*a*. Threaded portion 50*f* is configured to threadedly engage a rear end or trailing end of pilot tube 20 to secure pilot tube 20 to portion 50 of swivel 46.

A connector sleeve 56 engages rear end 50*b* of inner portion 50 of swivel 46. Connector sleeve 56 has a peripheral wall 56*a* with a front end 56*b* and a rear end 56*c* and defines a bore 56*d* therein that extends from front end 56*b* to rear end 56*c*. Connector sleeve 56 includes a narrower diameter region that includes front end 56*b* and a wider diameter region that includes rear end 56*c*. The narrower diameter of connector sleeve 56 may have a tapered and internally threaded region 56*e* that extends rearwardly from front end 56*b*. The narrower diameter region may be received through bore 52*d* of swivel mount 52 and into passage 48. Threaded region 56*e* of connector sleeve 56 may be threadedly engaged with threaded end 50*g* of inner portion 50 of swivel 46. Bearings 58 may be provided between an exterior surface of the narrower diameter region of connector sleeve 56 and an interior surface of swivel mount 52 so that there may be independent rotation of connector sleeve 56 relative to swivel mount 52. When connector sleeve 56 is engaged with inner portion 50 of swivel 46 there is fluid communication between passage 50*d* of inner portion 50 and bore 56*d* of connector sleeve 56. Connector sleeve 56 is thereby put into fluid communication with the bore of pilot tube 20. As may be seen from FIG. 11A, a terminal region of the bore 56*d* flares outwardly, progressively becoming greater in diameter towards rear end 56*c*. This flared diameter region is identified in FIG. 11A by the reference number 56*d*'. Rear end 56*c* also defines an exterior annular groove 56*f*. Inner portion 50 of swivel 46 is connected to pilot tube 20.

Cutting assembly 44 is shown in greater detail in FIGS. 2-12B. Cutting assembly 44 may comprise a front cutting head 60, a rear cutting head 62, a first housing 64, a second housing 66, a shaft 68 and an auger 70. Pilot tube 20 is operatively engaged with auger 70 and drives the rotation of auger 70 in either of the opposite direction "M" to cutting assembly 44 or in the same direction as cutting assembly 44 (i.e., in the opposite direction of arrow "M"). Additionally, cutting assembly 44 may be rotated at a first speed and pilot tube 20 and auger 70 may selectively be rotated and the first speed (i.e., the same speed as cutting assembly 44) or at a second speed that is greater than the first speed or is less than the first speed. In other words, auger 70 may be rotated at a same speed or at different speed relative to the speed of rotation of cutting assembly 44. The various rotational directions and speeds of rotation of cutting assembly 44 and auger 70 may be selected based on the type of terrain, the soils, rocks etc. that have to be cut through or any other factors that may affect the cutting ability of cutting assembly 44 and removal of material cut during operation of cutting assembly 44.

Referring to FIGS. 3, 11A, 11B and 12A, shaft 68 extends between front cutting head 60 and rear cutting head 62 and is engaged with front cutting head 60 and rear cutting head 62 in such a way that front cutting head 60, rear cutting head 62 and shaft 68 will rotate in unison about a longitudinal axis "Y" (FIG. 11A) of shaft 68.

Shaft 68 may be a cylindrical member having annular wall 68*a*, a front end 68*b* (FIG. 11A) and a rear end 68*c* (FIG. 11B) located a distance from front end 68*b*. Shaft 68 may be concentric about longitudinal axis "Y" of shaft 68 and thereby of cutter assembly 44. Inner surface of wall 68*a* of shaft 68 defines a longitudinal bore 68*d* that extends from front end 68*b* to rear end 68*c*. Front end 68*b* is engaged with swivel mount 52, specifically annular shoulder 52*f* thereof, in any suitable manner such as by welding, and in such a way that swivel mount 52 and shaft 68 will rotate in unison with each other about longitudinal axis "Y".

Figure 11B:
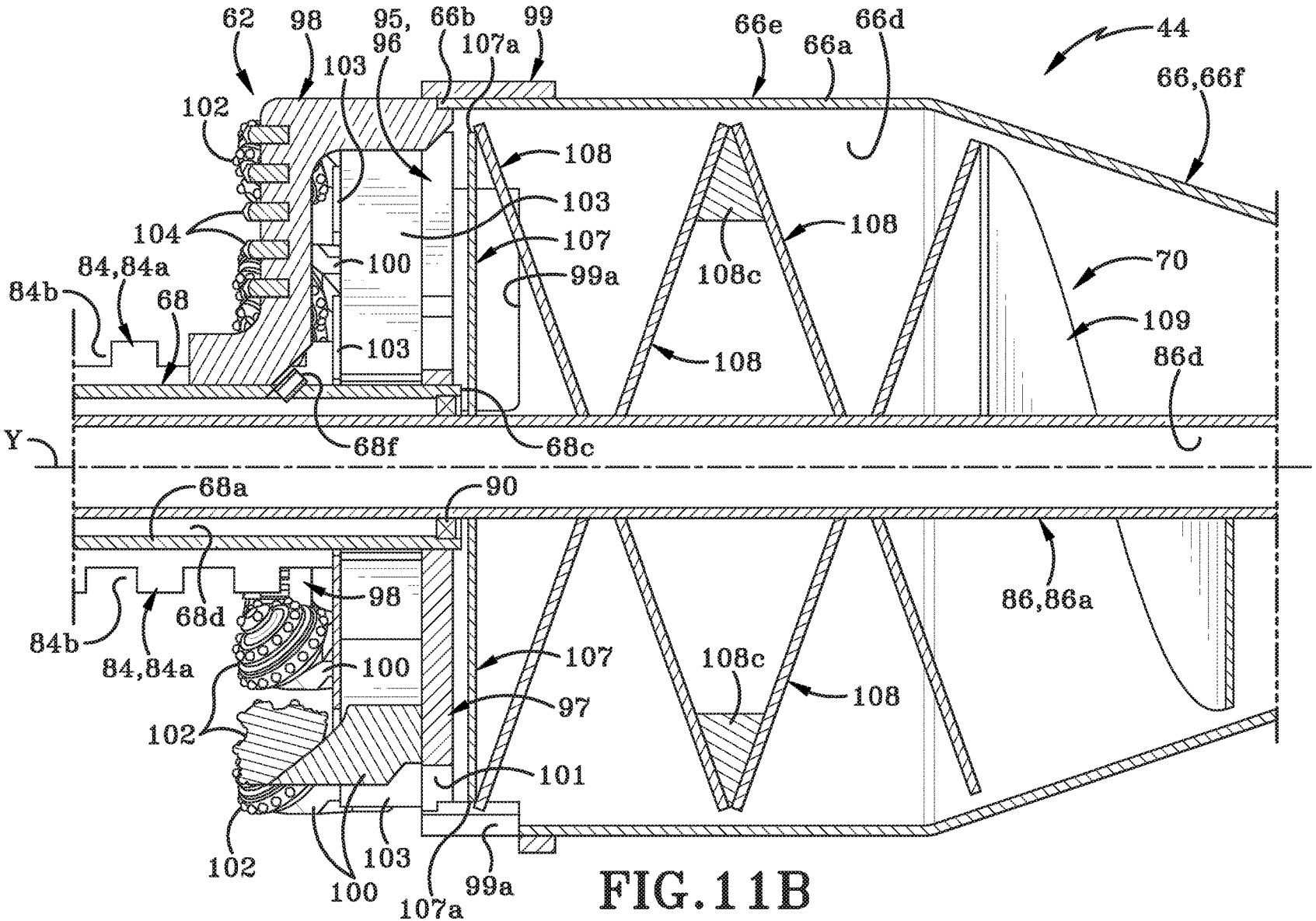
FIG. 11B (FIG. 11B) is a longitudinal cross-section through a middle portion of the rear cutting head and housing and showing the auger located in the interior of the housing.

Peripheral wall 68*a* of shaft 68 may define a plurality of first holes 68*e* and second holes 68*f* therein that extend between an exterior surface of wall 68*a* and an interior surface thereof. First holes 68*e* may be located a short distance rearwardly of front end 68*b* of shaft 68 and second holes 68*f* may be located a short distance forwardly of rear end 68*c* of shaft 68. First holes 68*e* may be oriented generally perpendicular to longitudinal axis "Y" while second holes 68*f* may each include a nozzle that extends outwardly from peripheral wall 68*a* and is oriented at an acute angle relative to wall 68*a* and to longitudinal axis "Y" (FIG. 11B). It will be understood that shaft 68 may be fabricated to include fewer or more first holes 68*e* and second holes 68*f* and may even be provided with additional holes along the length of shaft 68.

Front cutting head 60 may include a first housing 64 having a peripheral wall 64*a* with a front end 64*b* and a rear end 64*c*. A front plate 64*f* is provided at front end 64*b* of peripheral wall 64*a* and closes off access to a front end of the first housing 64. Front plate 64*f* engages an exterior surface of swivel mount 52 and interlocks with annular shoulder 52*f* on swivel mount 52. A rear plate 64*g* is provided at rear end 64*c* of peripheral wall 64*a* and closes off access to a rear end of first housing 64. The peripheral wall 64*a*, front plate 64*f* and rear plate 64*g* bound and define an interior chamber 64*d*. Peripheral wall 64*a*, front plate 64*f* and rear plate 64*g* each define one or more fluted regions 64*e* that can best be seen in FIGS. 5A, 6, and 7. Fluted regions 64*e* allow materials cut as cutting assembly 44 rotates to be moved rearwardly away from front cutting head 60 as cutting assembly 44 moves forwardly.

Interior chamber 64*d* (FIG. 12A) extends from front plate 64*f* to rear plate 64*g* and from inner surface of peripheral wall 64*a* of first housing 64 to exterior surface of peripheral wall 68*a* of shaft 68. A plurality of holes 64*h* are defined in rear plate 64*g* and nozzles 64*i* are positioned within the holes 64*h*. Each nozzle 64*i* may be directed rearwardly away from rear plate 64*g* and may be oriented generally parallel to longitudinal axis "Y".

Front cutting head 60 further includes a plurality of arms 74 with roller cones 76 mounted thereon. Each arm 74 extends outwardly and forwardly from a front surface of front plate 64*f* on first housing 64. Each of the plurality of arms 74, is are mounted on front plate 64*f* in such a way that they extend outwardly away from the front surface of front plate 64*f* in a direction that may be generally parallel to the longitudinal axis "Y" of shaft 68. A roller cone 76 is mounted proximate a free end of each arm 74 and in such a way that roller cone 76 may rotate about an axis that passes through a central region of the roller cone 76 and into the free end of the associated arm 74, Roller cone 76 may be of a configuration such as is illustrated in the attached figures but it will be understood that other types of cutters may be utilized in the place of roller cones 76 depending on what is required by any particular terrain, ground or rock that needs to be bored into by cutting assembly 44.

Figure 6:
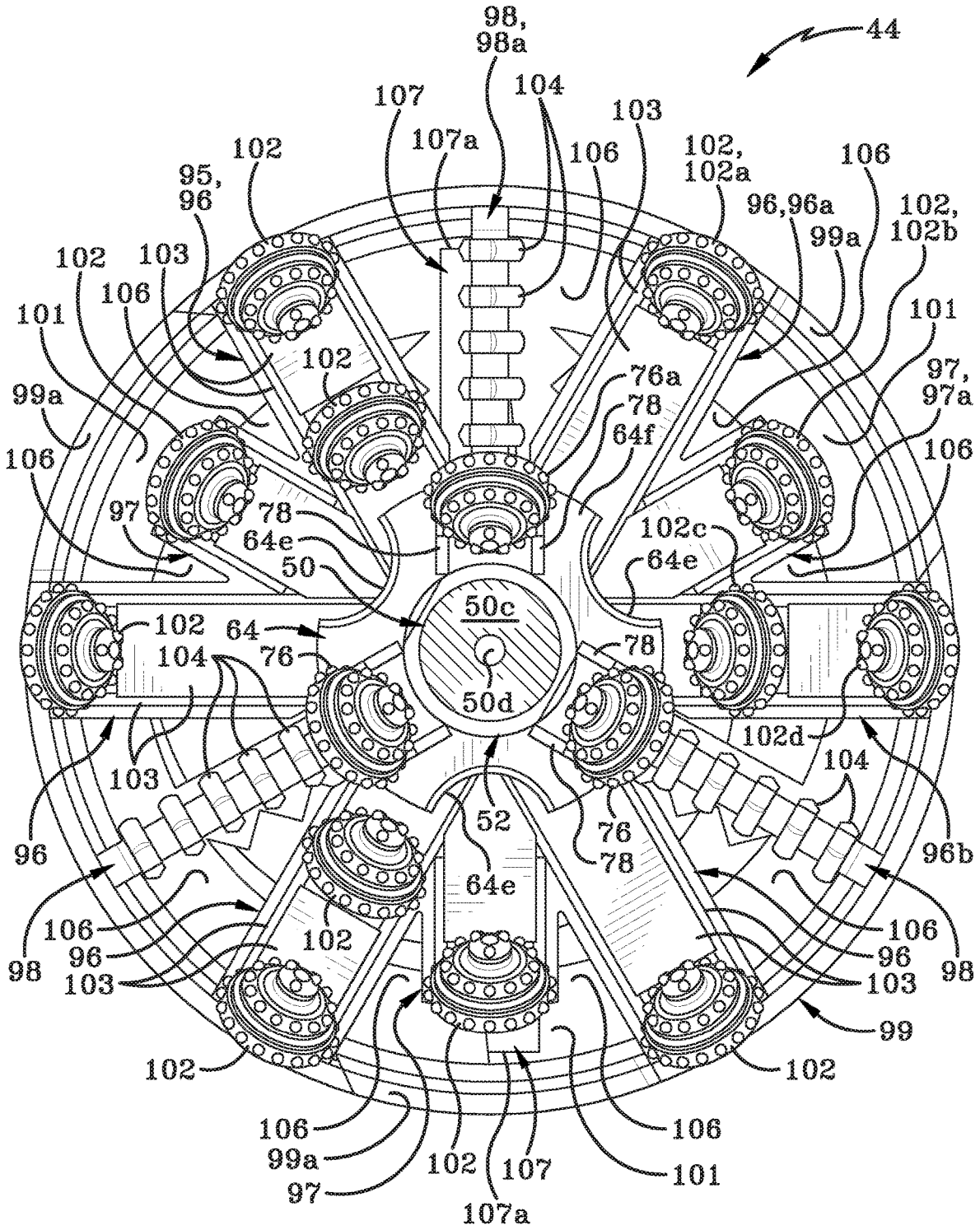
FIG. 6 (FIG. 6) is a front end view of the cutting assembly taken along line 6-6 of FIG. 5A.

A pair of plates 78 may flank each arm 74 and extend outwardly and forwardly from the front surface of front plate 64*f* of first housing 64. Plates 78 may be oriented generally at right angles to the front surface of front plate 64*f*. FIG. 6 shows that the two plates 78 in each pair of plates 78 may be oriented generally parallel to each other. The plates 78 are located on either side of an associated arm 74 and roller cones 76 and so cut and ground material passes into spaces between the arms and is guided by plates 78 downwardly toward rear cutting head 62. As will be described later herein this rearward movement of cut and ground material is aided in moving rearwardly by air that exits first housing 64 through nozzles 64*i* and is swept rearwardly by the air towards rear cutting head 62. Roller cones 76 and plates 78 are components that are used to cut and grind through rock and soil as cutting assembly 44 advances in the direction of arrow "C" (FIG. 1B).

As is evident from FIG. 2A, front cutting head 60 is of a smaller exterior diameter than rear cutting head 62. Front plate 64*f*, arms 74, plates 78, swivel mount 52 and shaft 68 may be welded together and because of this all of these components will move in unison with each other as cutting assembly 44 rotates about longitudinal axis "Y". Swivel mount 52 is threadedly engaged with outer member 48 of swivel 46. Consequently, outer member 48 of swivel 46 will rotate in unison with shaft 68 and independently of the inner member 50 of swivel 46.

Figure 3:
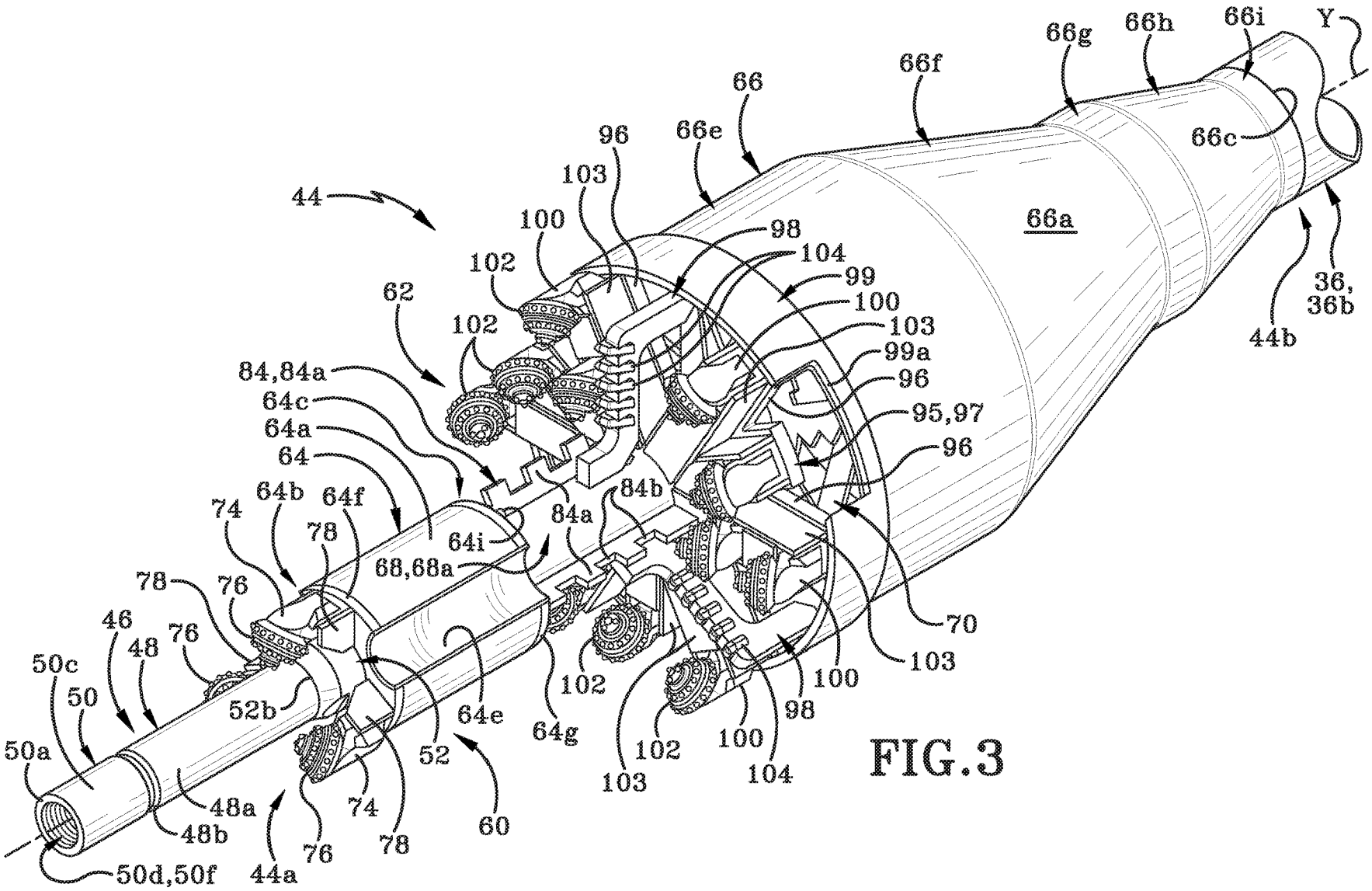
FIG. 3 (FIG. 3) is an enlarged perspective view of the cutting assembly in accordance with an aspect of the present invention.

FIG. 3 shows that a section of shaft 68 extends between first housing 64 and rear cutting head 62. A plurality of flanges 84 may extend radially outwardly from an exterior surface of the peripheral wall 68*a* of shaft 68. Each flange 84 may include a plurality of cutting teeth 84*a* and recesses on its outermost end. Cutting teeth 84*a* aid in cutting through rock and soil that contact the exterior surface of this section of shaft 68. Teeth 84*a* also aid in further reducing a size of the cuttings produced by front cutting head 60 as those cuttings move rearwardly through fluted regions 64*e*.

Figure 4:
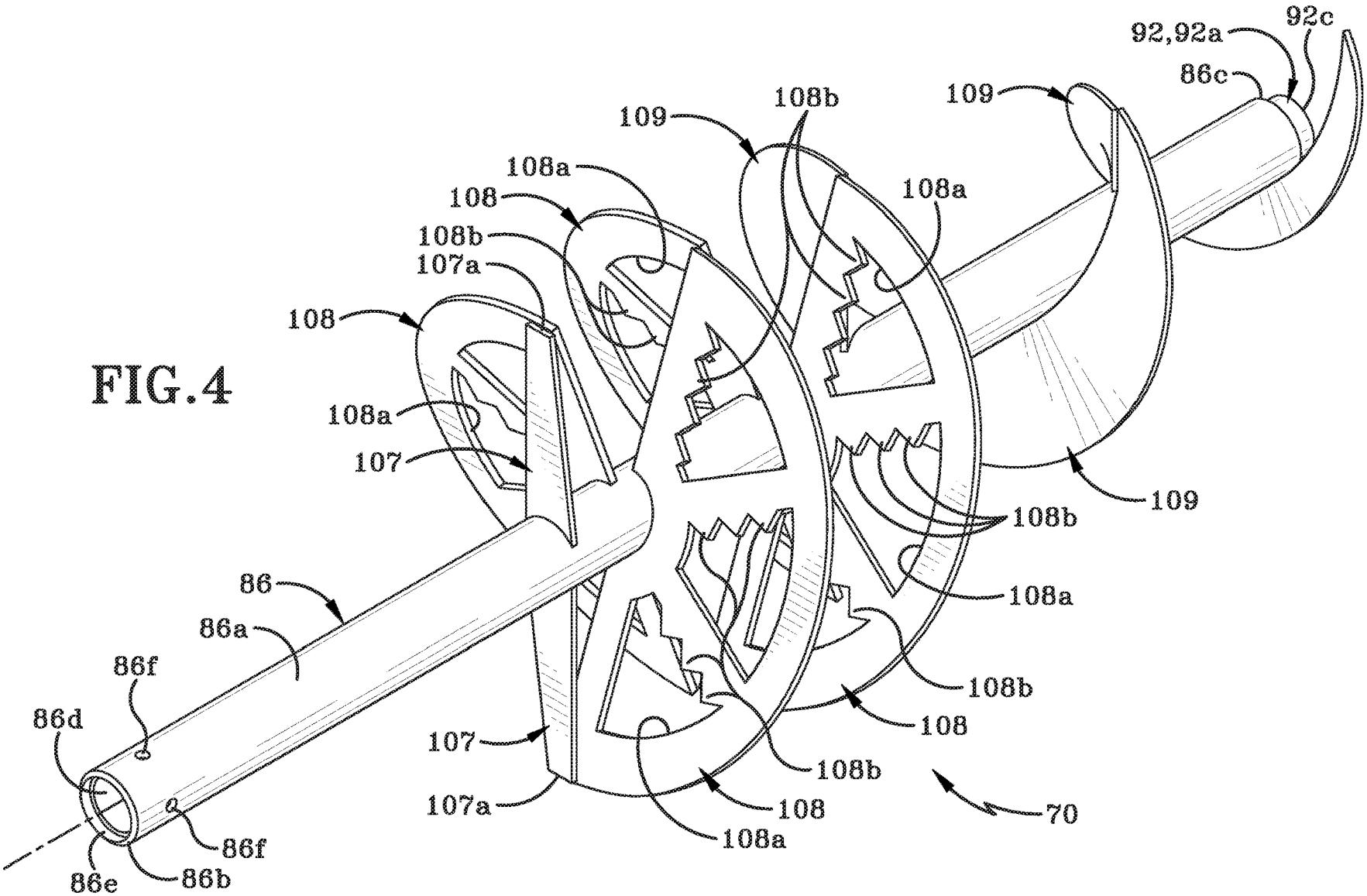
FIG. 4 (FIG. 4) is an isometric perspective view of an auger of the cutting assembly of FIG. 3.
Figures 5, 5A, 5B:
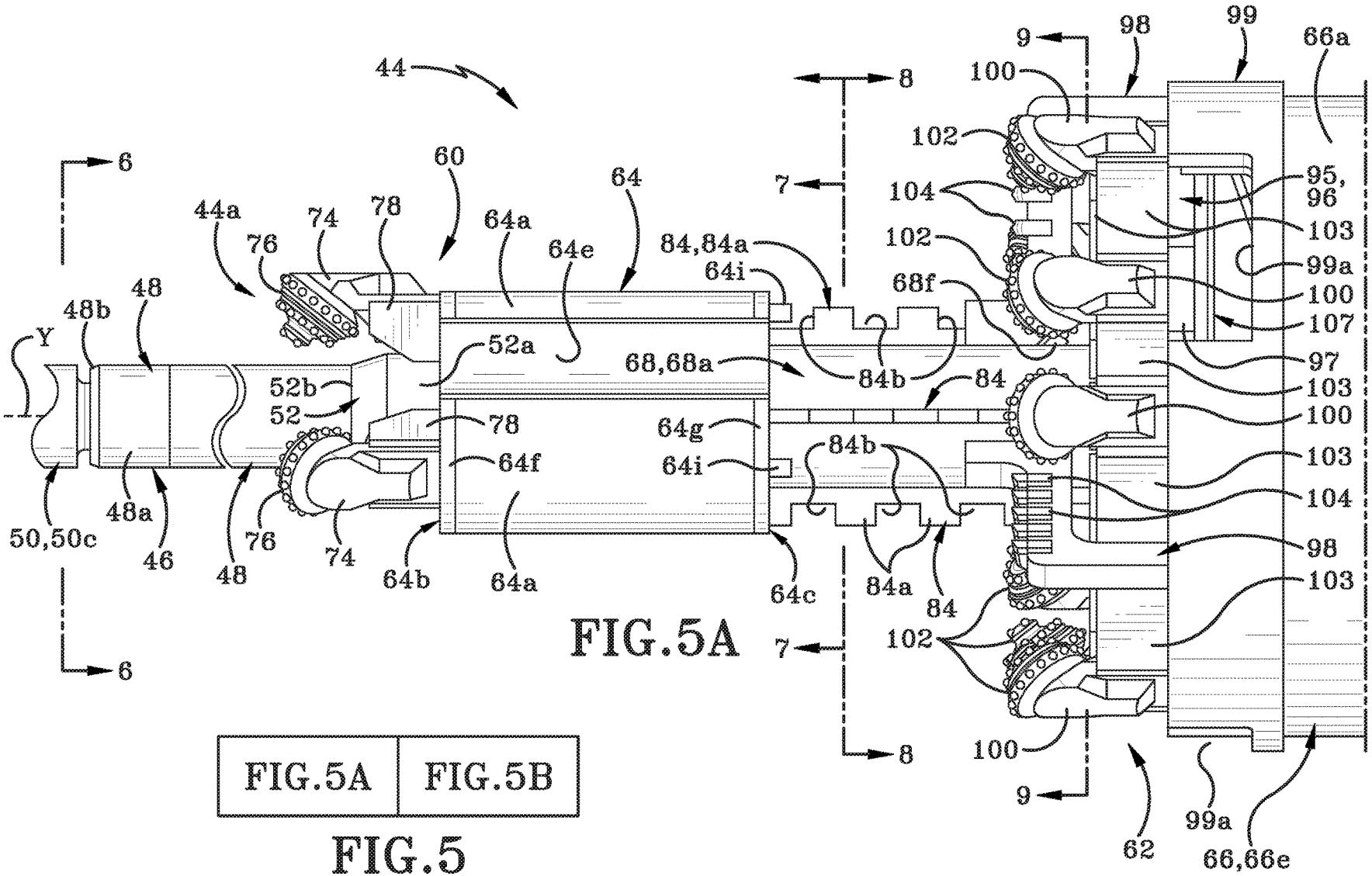
FIG. 5 (FIG. 5) is a block diagram showing that the components illustrated in FIG. 5A and FIG. 5B are oriented in a particular manner.
FIG. 5A (FIG. 5A) is a side elevational view of the front end of the cutting assembly of FIG. 3 showing a front cutting head and a rear cutting head thereof.
FIG. 5B (FIG. 5B) is a side elevational view of the rear end of the cutting assembly of FIG. 3 showing a housing that extends rearwardly from the rear cutting head and a casing that is engaged with the housing.
Figure 5B:
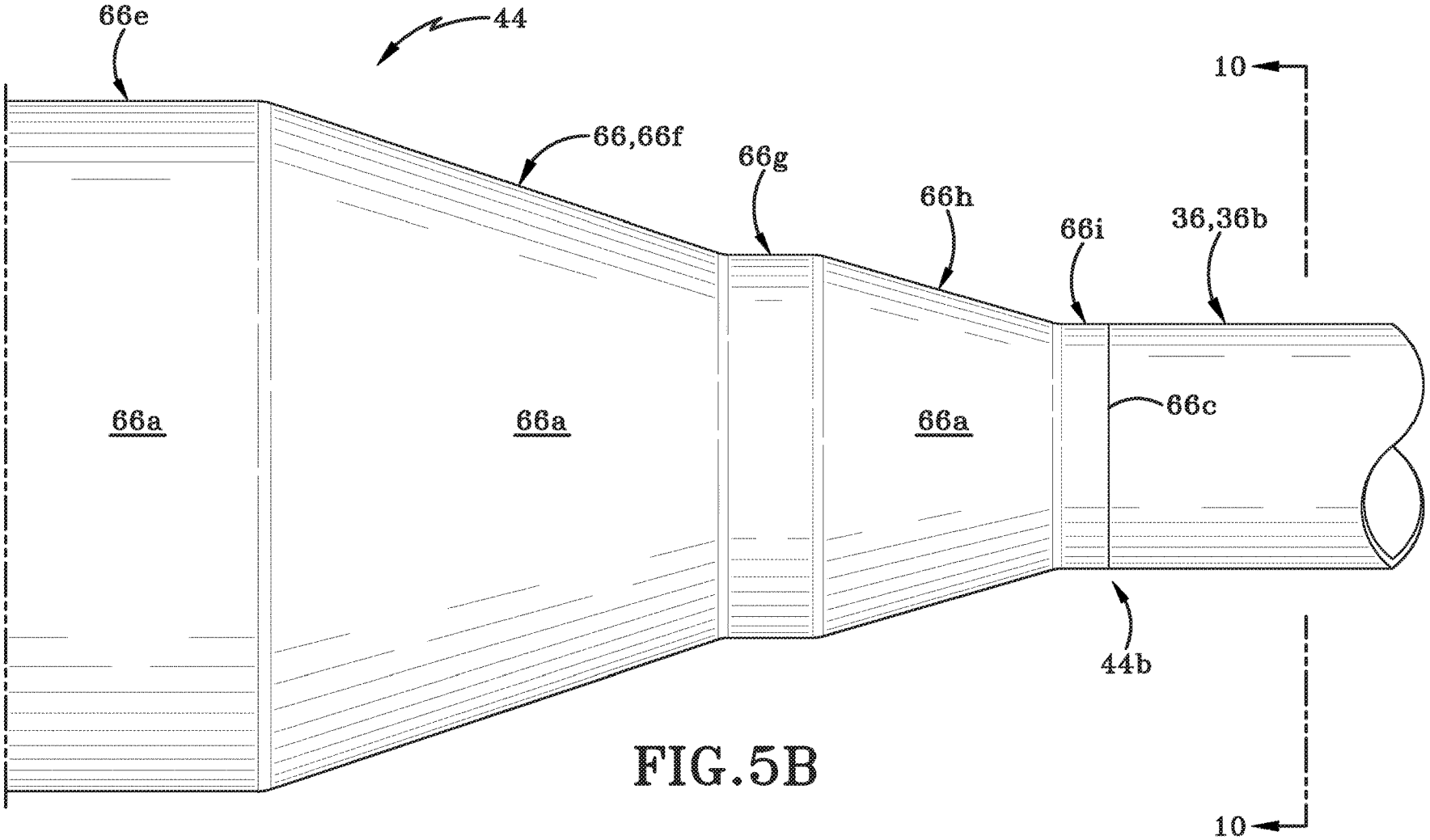

FIG. 4 shows auger 70 in greater detail. Auger 70 may comprise an auger shaft 86 upon which are engaged a plurality of flights 88*a*-88*d*. Auger shaft 86 may have a peripheral wall 88*a* with a front end 88*b* and a rear end 88*c*. Peripheral wall 88*a* may define a bore 88*d* that extends from front end 88*b* to rear end 88*c*. Auger shaft 86 may be of substantially constant diameter along its length as measured from front end 88*b* to rear end 88*c*. Front end 88*a* may an annular shoulder 88*e* that is configured to be complementary to annular groove 56*f* of connector sleeve 56. Auger shaft 86 is engaged with connector sleeve 56 in such a way that connector sleeve 56 and auger shaft 86 will move in unison as auger 70 is rotated in either of a first direction or a second direction about longitudinal axis "Y". The engagement between auger shaft 86 and connector sleeve 56 also places bore 86*d* of auger shaft 86 in fluid communication with bore 56*d* of connector sleeve 56 and thereby ultimately with the bore of pilot tube 20. It should be noted that the diameter of bore 86*d* is substantially the same as the maximum diameter of the flared section of bore 56*d* of connector sleeve 56. FIG. 11A shows that a plurality of holes 86*f* may be defined in peripheral wall 86*a* of auger shaft 86. Holes 86*f* may be aligned with first holes 68*e* in shaft 68. Holes 86*f* enable bore 86*d* of auger shaft 86 to be placed in fluid communication with bore 68*d* of shaft 68 and thereby with interior chamber

64*d* of first housing 64. Thus, interior chamber 64*d* of first housing 64 is placed in fluid communication with the bore of pilot tube 20.

FIG. 11B shows that bearings 90 are provided between an interior surface of peripheral wall 68*a* of shaft 68 and an exterior surface of peripheral wall 86*a* of auger shaft 86. Auger shaft 86 may therefore be able to be rotated independently of the rotation of shaft 68.

Figure 8:
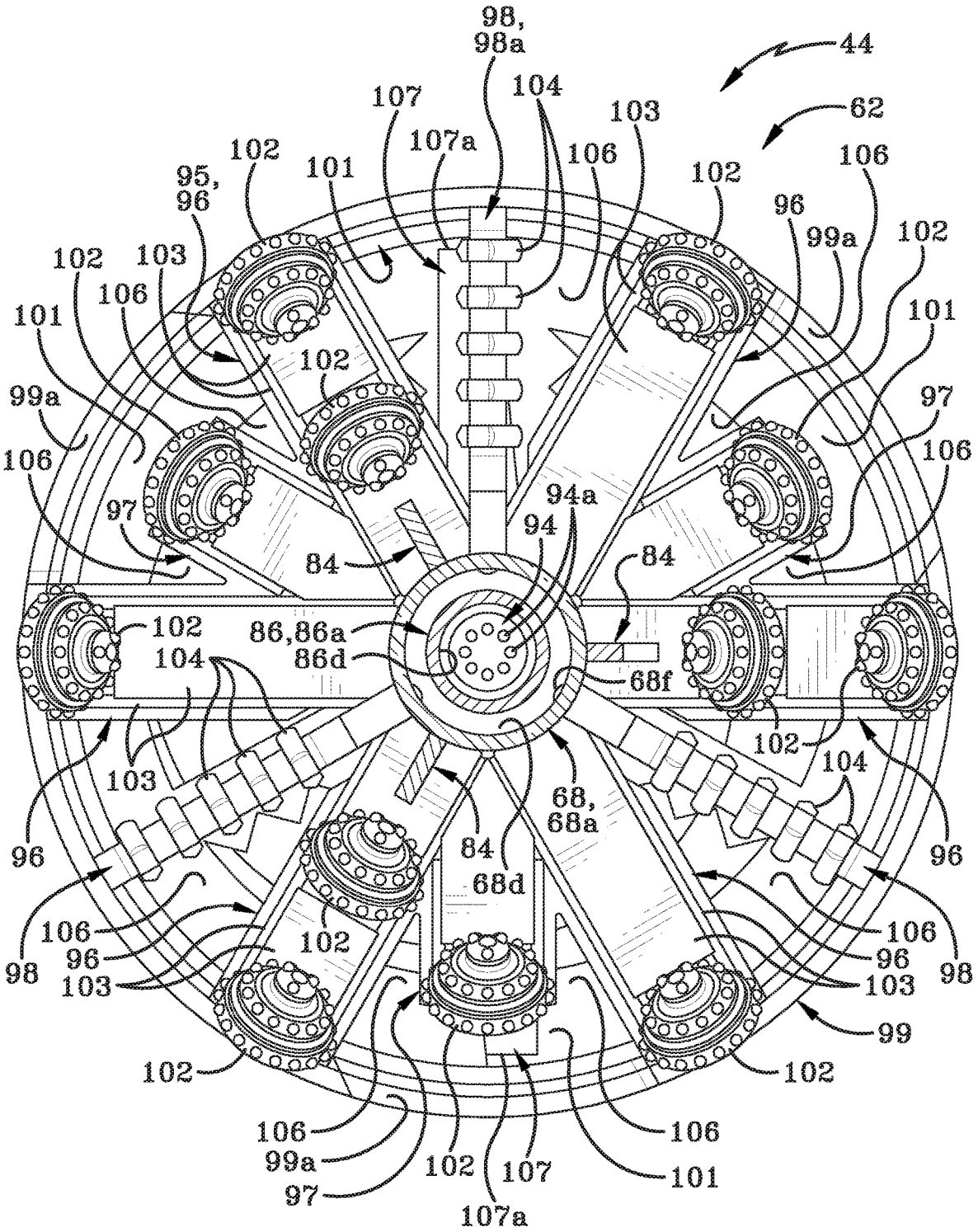
FIG. 8 (FIG. 8) is front end view of the rear cutting head taken along line 8-8 of FIG. 5A.
Figure 9:
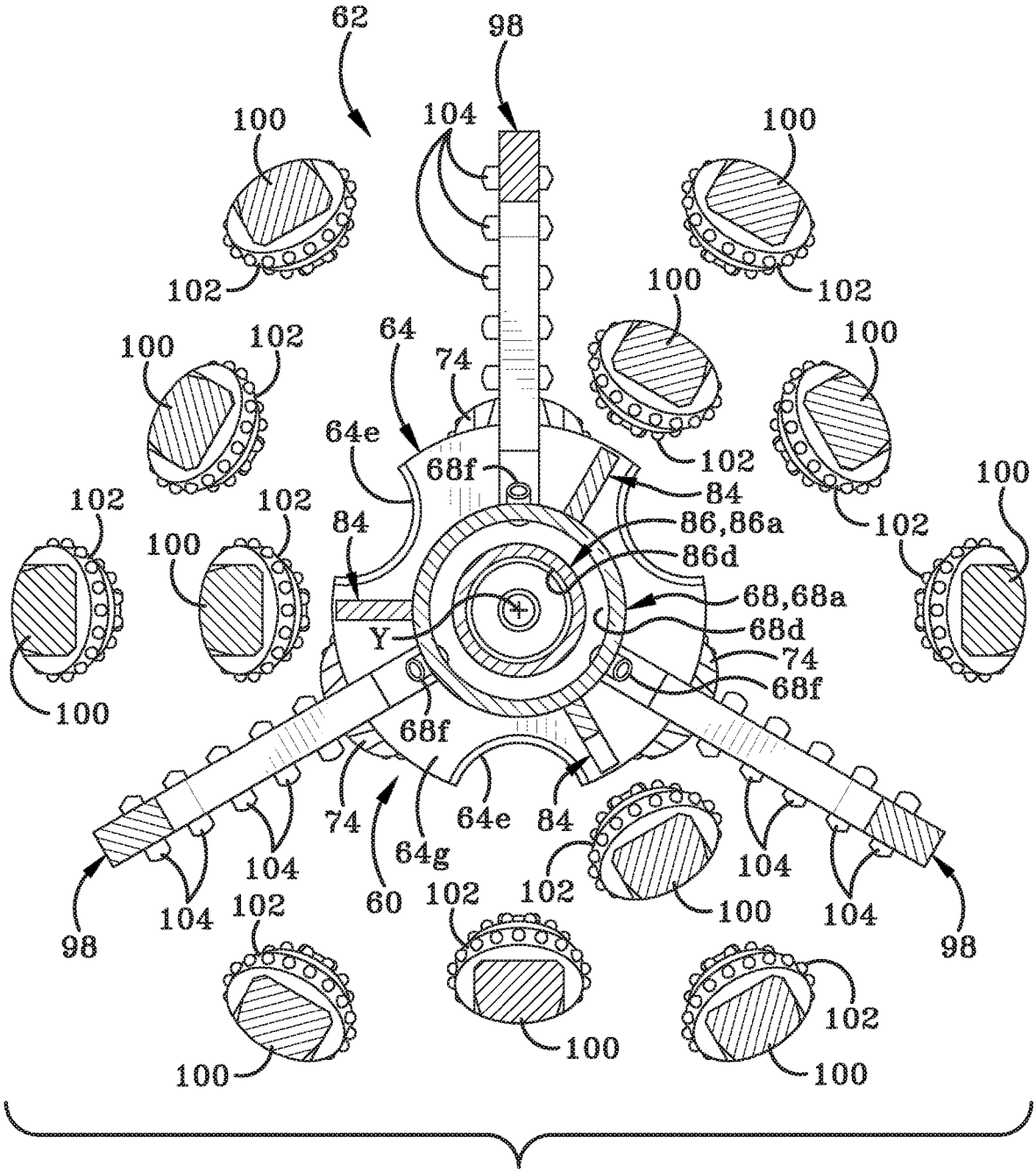
FIG. 9 (FIG. 9) is a rear end view of a middle region of the rear cutting head taken along line 9-9 of FIG. 5A.
Figure 10:
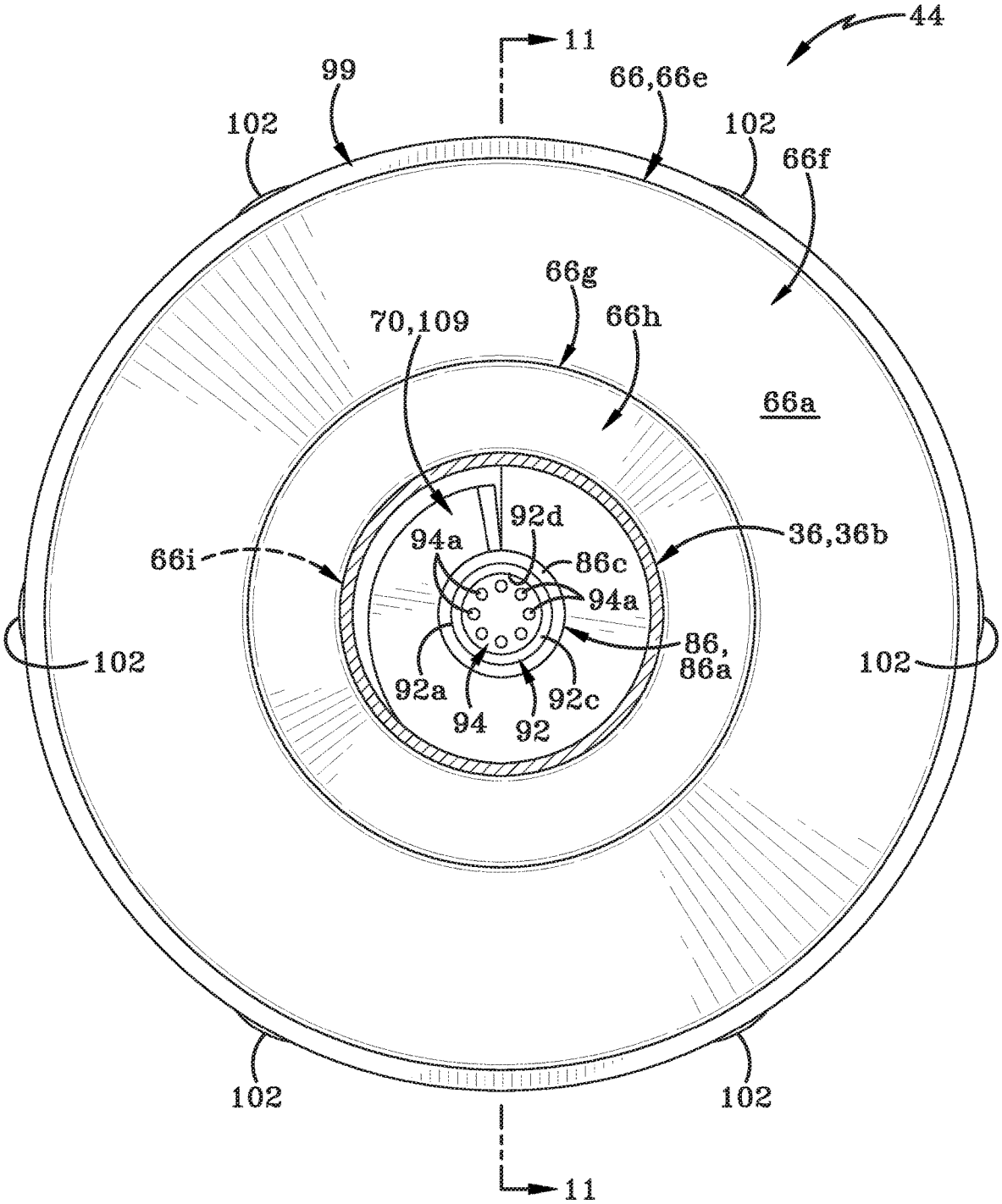
FIG. 10 (FIG. 10) is a rear end view of the housing of the cutting assembly taken along line 10-10 of FIG. 5B.
Figure 11C:
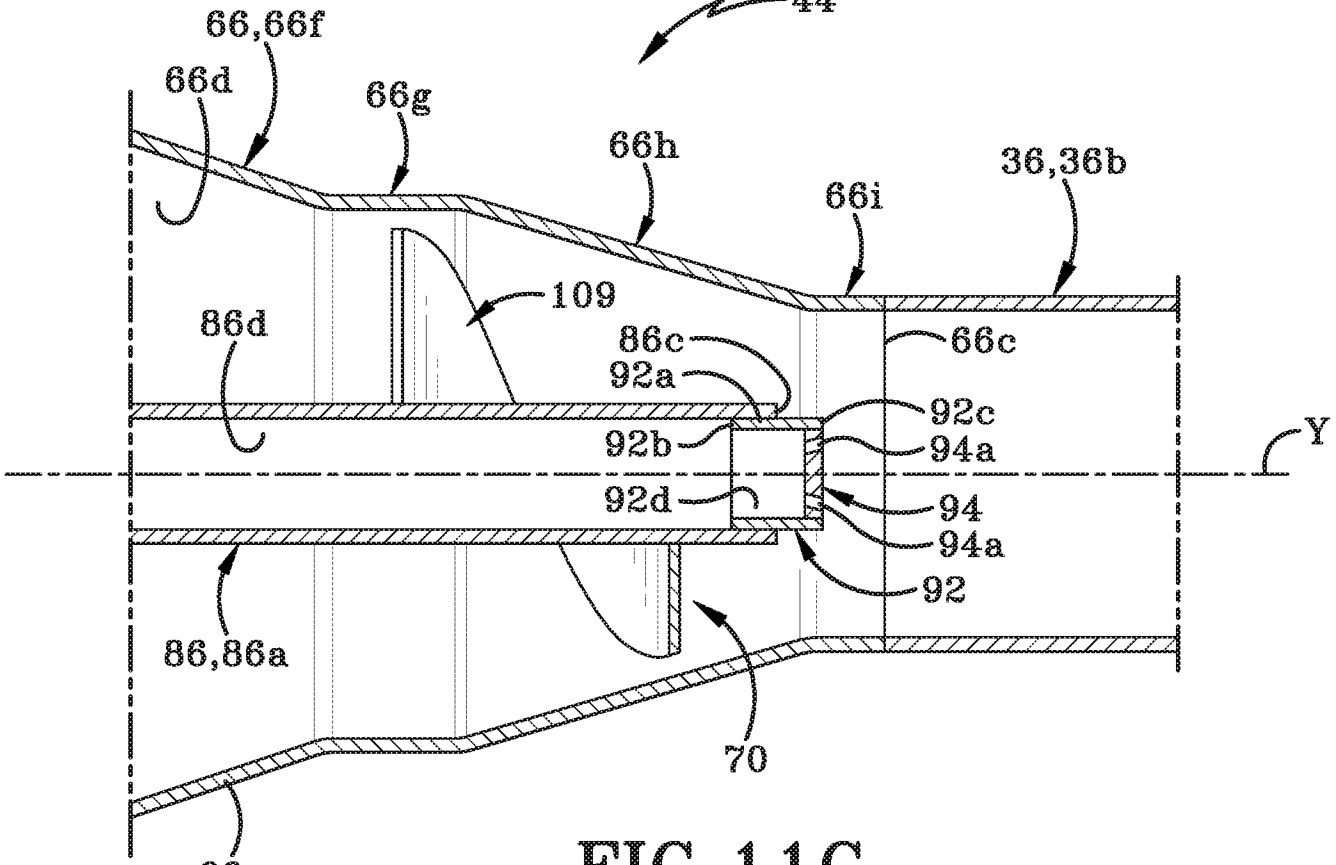
FIG. 11C (FIG. 11C) is longitudinal cross-section through a rearward portion of the housing and the casing engaged therewith.

Referring to FIG. 11C, the rear end 86*c* of auger shaft 86 defines an opening therein and an insert 92 may be positioned in this opening and extending rearwardly of rear end 86*c*. Insert 92 may comprise a tubular peripheral wall 92*a* having a front end 92*b* and a rear end 92*c*. Peripheral wall 92*a* may define a bore 92*d* that is placed in fluid communication with bore 86*d* of auger shaft 86 when insert 92 is engaged with auger shaft 86. An end plate 94 may be engaged with insert 92 to limit fluid communication between bore 92*d* and an interior of a second housing 68 engaged with rear cutting head 62. End plate 94 may be a planar member that is generally circular in shape and defines a plurality of holes 94*a* therein. Holes 94*a* extend between an interior and exterior surface of plate 94 and allow air to flow out of bore 92*d* of insert 92. Plate 94 may be engaged with rear end 92*c* of insert 92 in such a way that the plate 94 may be removed and replaced from time to time. Furthermore, insert 92 may be engaged with auger shaft 86 in such a way that insert 92 may be removed and replaced from time to time. FIGS. 8 and 10 show a particular number of holes 94*a* arranged in an exemplary pattern but it should be understood that any desired configuration and number of holes 94*a* may be provided in plate 94. Holes 94*a* may be arranged in any pattern that is suitable for the particular terrain, rock and soil through which cutter assembly 44 is moving. A variety of different plates 94 that have different hole configurations or patterns may be selectively utilized in cutter assembly 44. In some instances, plate 94 may be an integral part of insert 92. In this latter instance, a plurality of inserts that have end walls in the same location as end plate 94 may be provided and the particular insert 92 with a particular selected pattern of holes 94*a* therein may be selected for use based on the cutting conditions and the nature of the terrain, rock or soil through which cutter assembly 44 must cut. It has been found that plates 94 having different patterns of holes 94*a* therein create different speed and pressure air and fluid flow from nozzles 64*i*, 68*f* and from holes 94*a*. The operator will select one of a plurality of differently configured plates to engage with cutting assembly 44. Each of these plates may differ in the number and pattern of holes 94*a* provided therein. After selecting an appropriate plate for the specific type of terrain through which cutting assembly 44 will bore, the operator will engage the appropriate plate 94 with insert 92.

Figure 12A:
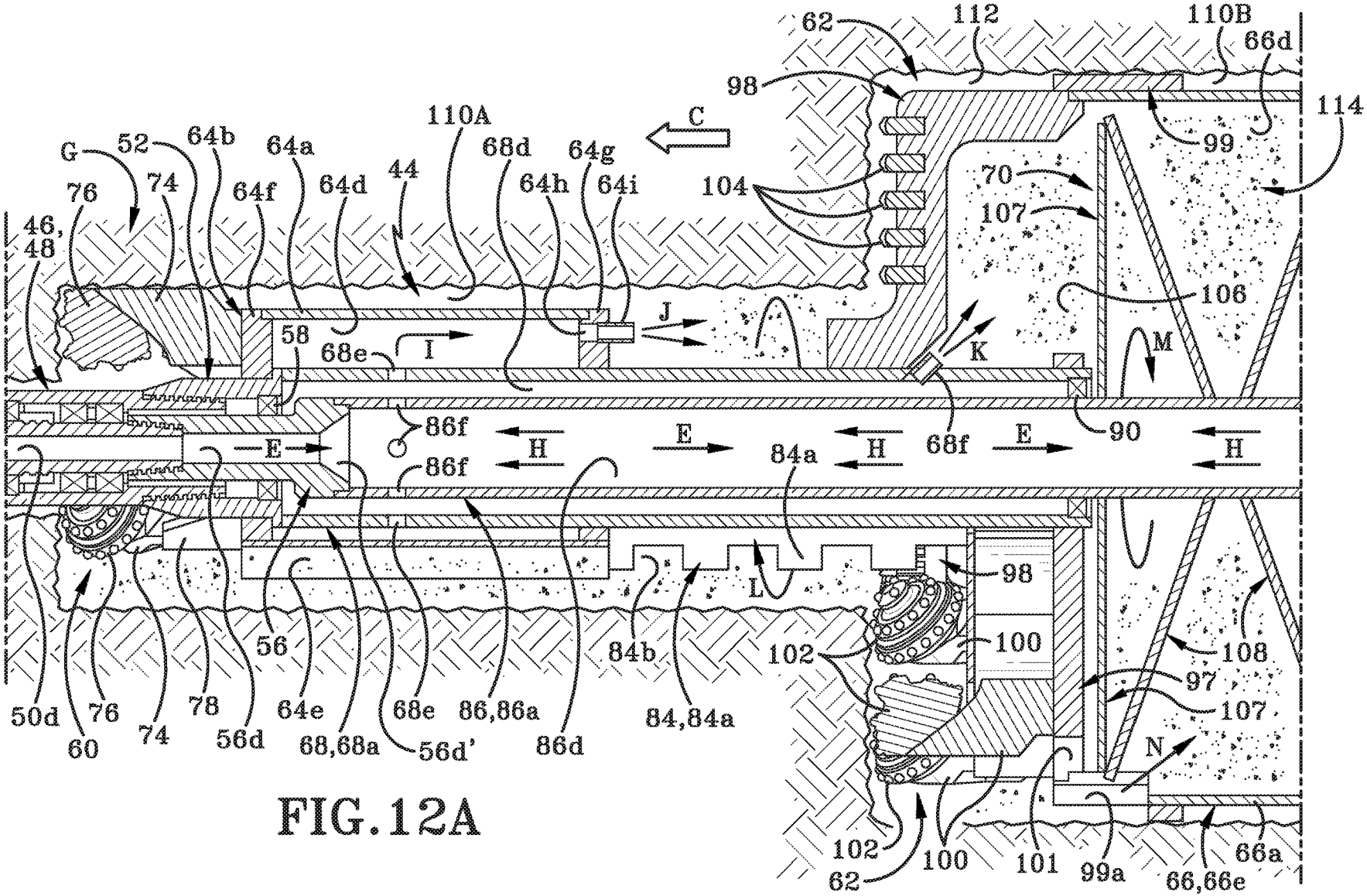
FIG. 12A (FIG. 12A) is a longitudinal cross-sectional view of the front cutting head, the rear cutting head, central shaft and a front portion of the housing of the cutting assembly in operation and showing the flow of spoil through the cutting assembly.
Figure 12B:
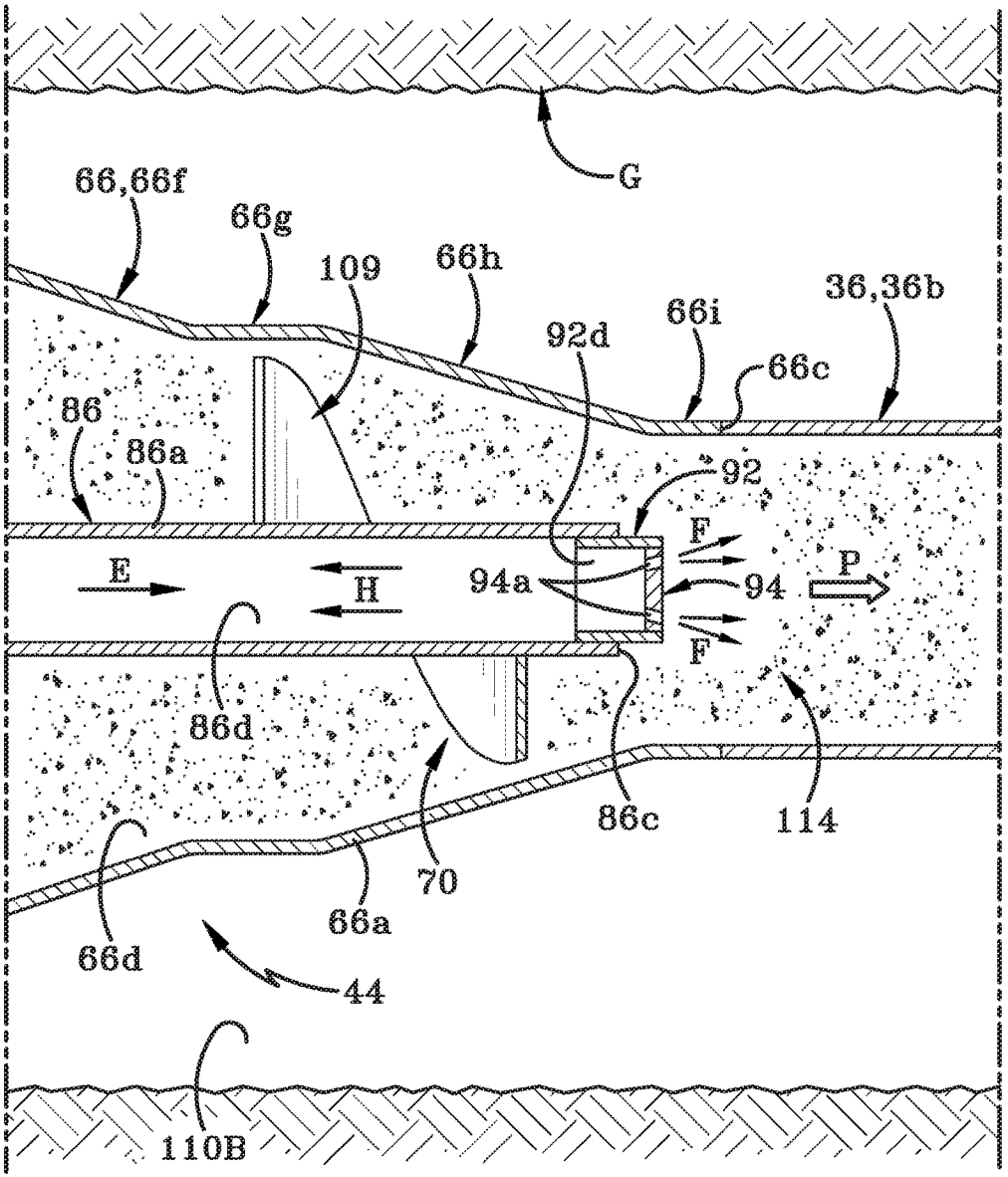
FIG. 12B (FIG. 12B) is a longitudinal cross-sectional view of a rear portion of the housing of the cutting assembly in operation and showing the flow of spoil therethrough and into the casing engaged with the rear end of the cutting assembly.

Pressurized air may be caused to flow from the bore of pilot tube 20, through an air passage defined in swivel 46, through an air passage defined in cutter assembly 44 and through a bore defined in casing 36. The air passage through swivel 46 may comprise the air passage 50*d* of inner member 50 of swivel 46 and the bore 56*d* of connector sleeve 56. The air passage through cutting assembly may comprise the bore 86*d* of auger shaft 86, having an opening 86*e* at front end 86*b*. The holes 86*f* in auger shaft 86, the bore 92*d* of insert 92, the holes 94*a* in plate 94, the bore 68*d* of shaft 68, the first holes 68*e* and nozzles 68*f* of shaft 68; the bore 64*d* of first housing 64 and a bore 68*d* of second housing 68. Pressurized air from air compressor 22 may be caused to flow through swivel 46 and the air passage in cutting assembly 44 and into the bore of casing 36 in a first direction indicated by arrows "E" in FIG. 12A. Holes 94*a* in insert may allow some air to flow through bore 92*d* of insert 92 and to exit from bore 92*d*. The flow of exiting air is indicated by arrows "F" in FIG. 12B. The air flowing in the direction "F" entrains cut material and directs that material through bore 66*d* of second housing 66 and towards auger 70 and ultimately into and through the bore of casing 36. However, because there are solid regions on plate 94 that are located between the various holes 94*a* therein, a quantity of the air flowing through bore 92*d* of insert 92 in the direction "E" hits plate 94. This creates a back-pressure in bores 92*d* and 86*d* and the back-pressure is indicated by the arrows "H" in FIGS. 12A and 12B. The combination of air flow in the direction of arrow "E" and the back-pressure "H" causes air or fluid to be forced out of first holes 86*f* of auger shaft 86 and into bore 68*d* of shaft 68. Air subsequently flow out of bore 68*d* through first holes 68*e* and into bore 64*d* of first housing 64. This flow is indicated by arrow "I" in FIG. 12A. Air flows out of bore 64*d* of first housing 64 through nozzles 64*i* in the direction indicated by arrow "J" (FIG. 12A). This air flow picks up cuttings moving through fluted regions 64*e* produced by front cutting head 60 and causes those cuttings to move rearwardly towards rear cutting head 62.

Air flowing through bore 68*d* of shaft 68 also flows rearwardly and outwardly through nozzles 68*f* and into the region located rearwardly of rear cutting head 62. This air flow is indicated by arrows "K" in FIG. 12A. The air flow "J" entrains material cut by front cutting head 60 and directs that material rearwardly towards rear cutting head 62. The air flow "K" entrains material cut by rear cutting head 62 and directs that material rearwardly through bore 66*d* of second housing 66 towards auger 70 and towards the bore of casing 36.

Referring to FIGS. 6, 8 and 11B, rear cutting head 62 extends outwardly and forwardly from second housing 66. Second housing 66 includes a peripheral wall 66*a*, a front end 66*b*, a rear end 66*c* and a bore 66*d* defined by an inner surface of wall 66*a* and extending from front end 66*b* to rear end 66*c*. As is evident from FIG. 2A, second housing 66 tapers progressively from proximate collar 99 to where rear end 66*c* of second housing 66 connects to casing 36 and includes a widest diameter first region 66*e*, a tapering diameter second region 66*f*, a substantially constant diameter third region 66*g*, a tapering diameter fourth region 66*h*, and a substantially constant diameter fifth region 66*i* that terminates in rear end 66*c*. Fifth region 66*i* may comprise a collar that is configured to mate with a casing segment, such as segment 36*b* that is secured to the rear end 66*c* of second housing 66. Annular collar 66*i* is engaged with rearmost portion of second housing 66. The collar of fifth region 66*i* may help to rigidly secure second housing 66 to casing segment 36*b*. The collar 66*i* may threadably engage casing segment 36*b* or may be welded thereto or may be connected by a plurality of fasteners (not shown) such as bolts or screws to casing segment 36*b*. (Similar collars and fasteners may be used between adjacent pairs of casing segments 36 to secure a given front end of one segment 36 to a given rear end of another segment 36, whereby such collars may be used to secure segments 36 in the end-to-end fashion shown in FIG. 1B). The engagement of casing 36 with second housing 66 places bore 66*d* of second housing 66 in fluid communication with the bore of casing 36.

Rear cutting head 62 may comprise a plurality of legs 96 and 97 that extend radially outwardly and forwardly from an end plate 95 (FIGS. 8 and 11B). Legs 96 and 97 may both have arms 100 that are engaged therewith and which extend outwardly and forwardly away from end plate 95. A series of plates 103 may be welded to end plate 95 and legs 96, 97, 99 for strength and rigidity and to secure legs to end plate 95. A roller cone 102 may be provided on each arm 100. FIG. 6 shows that legs 96 and 97 may differ in length. Legs 96 may extend outwardly from shaft 68 all the way to an annular collar 99 that is provided on second housing 66 or as part of rear cutting head 62. Collar 99 may overlap a front end 66*b* of peripheral wall 66*a* of second housing 66. Collar 99 and sidewall 66*a* may define an opening 99*a* (FIG. 5A) therein that helps cut material to flow into an interior of cutter assembly 44 in the direction of arrow "N" (FIG. 12A) as will be later described herein. It should be noted that the roller cones 102 located proximate the outer perimeter of rear cutting head 62 will cut through the ground "G" to create a borehole 110B (FIG. 10) that is slightly larger than the exterior diameter of collar 99 and is larger than an exterior diameter of sidewall 66*a* of second housing 66. Collar 99 may have a diameter greater than or substantially equal to the diameter of the rear cutter head 62; where the diameter of the rear cutter head extends from an outermost region of one roller cone 102 to an outermost region of an opposed roller cone 102. Consequently, collar 99 may be substantially in direct contact with the surrounding ground and soil that defines borehole 110B that is cut by rear cutting head 62. A gap 112 (FIG. 10) may be defined between the ground and soil that defines borehole 110B and the exterior surface of sidewall 66*a*. Collar 99 is thus adapted to effectively "seal" the borehole 110B and substantially prevents debris cut during boring operations with cutting assembly 44 from moving forwardly beyond rear cutting head 62. In other words, collar 99 may aid in preventing frac-out by sealing borehole 110B. Collar 99 may be welded or otherwise secured to second housing 66 so that collar 99 and second housing 66 rotate in unison with rear cutting head 62 and shaft 68.

Legs 96 of rear cutting head 62 may be fixedly engaged with an exterior surface of shaft 68 and collar 99. Some of the legs 96 may be provided with a single arm 100 and roller cone 102 thereon. Other of the legs 96 may be provided with more than one arm 100 and roller cone 102 thereon. In particular, the legs 96 illustrated herein may have either one or two arms 100 and roller cones 102 thereon.

Legs 97 of rear cutting head 62 on the other hand may be engaged with shaft 68 at one end but terminate a distance away from collar 99. Consequently, a gap 101 may be defined between collar 99 and a terminal end 97*b* of each leg 97. The ends of legs 97 and gaps 101 may be directly adjacent openings 99*a* in collar 99 and peripheral wall 66*a* (FIGS. 6 & 8). Each leg 97 may have a single arm 100 thereon with a single roller cone 102 thereon.

Legs 98 of rear cutting head 62 may extend outwardly from shaft 68 to collar 99 and be fixedly engaged to each of the shaft 68 and collar 99. Legs 98 may be substantially "S"-shaped when viewed from the side such as in FIG. 11B. A plurality of cutting teeth 104 may be provided on a section each leg 98 that is oriented generally at right angles to longitudinal axis "Y" of cutting assembly 44. Cutting teeth 104 may be oriented at right angles to the length of each leg 98, where the length is measured from shaft 68 to collar 99.

It should be noted that the positioning and type of legs 96, 97, 98 may be such that there are three arms 98 oriented at about 60° relative to each other. This can be seen best in FIG. 9. There may also be three legs 97 oriented at about 60° relative to each other but offset from the three legs 98. There may also be three legs 96 that include a single roller cone 102 thereon that are oriented at about 60° relative to each other; but again, offset from the legs 98 and 97. Finally, there may be three legs 96 that include two roller cones 102 thereon that are oriented at about 60° relative to each other but offset from the other legs.

Figure 6A:
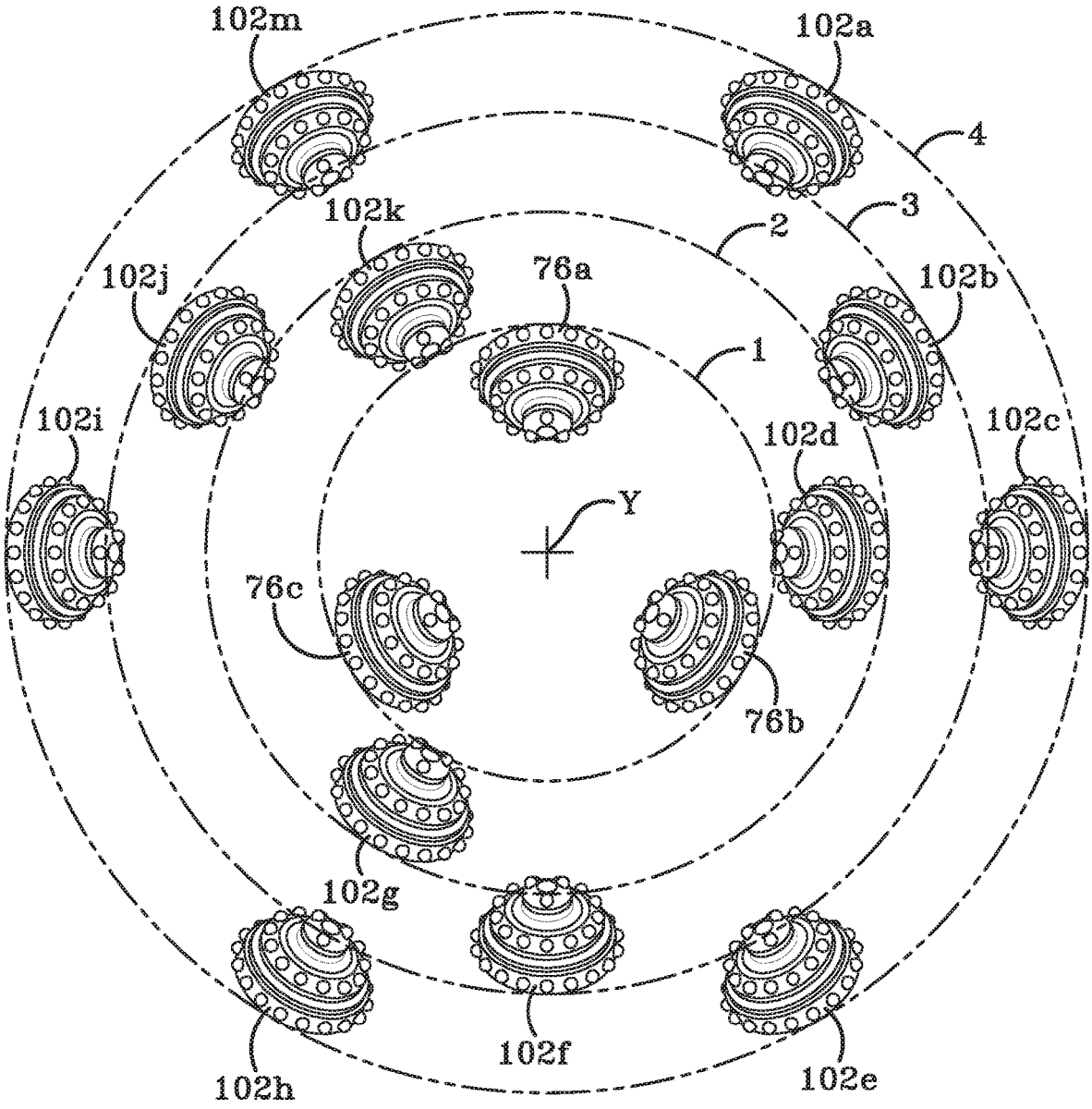
FIG. 6A (FIG. 6A) is a front end view of only the roller cones of the front and rear cutting heads showing that the overlap between the concentric rings of roller cones in the cutting assembly.
Figure 7:
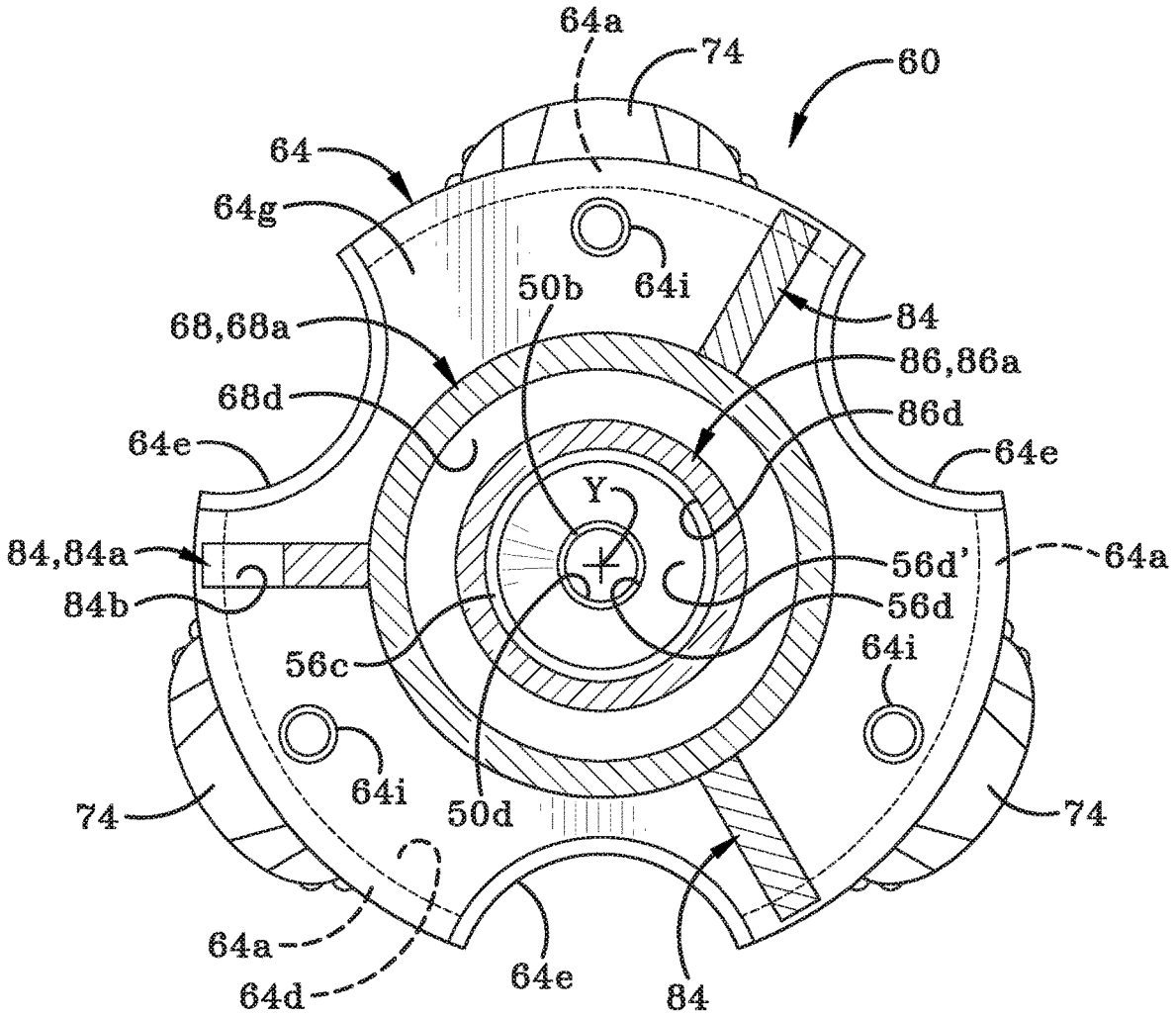
FIG. 7 (FIG. 7) is a rear end view of the front cutting head taken along line 7-7 of FIG. 5A.

FIGS. 6 and 6A show that the legs 96, 97, and 98 may be oriented as though they mark the hours on an analog clock. As illustrated in these figures a first leg 98*a* may be located at a "12-o'clock" position; a first leg 96*a* may be located at a "1-o'clock" position, a first leg 97*a* may be located at a "2-o'clock" position, and so on. In total, there may be twelve legs that are located at the hour positions on a analog clock. It should be noted that in the particular configuration illustrated in these figures, first leg 98*a* may have cutter teeth 104 thereon and be radially aligned with one of the arms 74 on front cutting head 60. Consequently the roller cone 76*a* (FIG. 6) on that arm 74 appears to be on an innermost end of first leg 98*a* when seen from the front. First leg 96*a* may be offset from first leg 98*a* and be offset from the arm 74 that includes roller cone 76*a*. First leg 96*a* may include an arm 100 with a roller cone 102*a* thereon. It should be noted that this roller cone's perimeter may extend marginally further outwardly than an outer surface of collar 99. The opening or cut-out region 99*a* may be defined in collar 99 to allow material to flow inwardly into second housing 66. This can best be seen in FIG. 10. First leg 97*a* may include only a single roller cone 102*b* thereon. It should be noted that roller cone 102*b* may be located at a distance away from shaft 68 that falls between the distance of the roller cone 102*a* from roller cone 76*a*. The second arm 96*b* (which is at the "3-o'clock" position) may include two roller cones 102*c*, 102*d*. It should be noted that roller cone 102*b* may be located between roller cones 102*c* and 102. Roller cone 102*d* may be the same distance from shaft 68 as is roller cone 102*a*.

FIG. 6A shows the roller cones only and their relative "orbits" (or radial distances) relative to longitudinal axis "Y". Roller cones 76*a*, 76*b*, 76*c* are in a first orbit, identified by the reference number "1". Each of these roller cones 76*a*, 76*b*, 76*c* is provided on front cutting head 60. Roller cones 102*d*, 102*g*, and 102*k* are in a second orbit, identified by the number "2". Roller cones 102*b*, 102*f*, 102*j* are all in a third orbit, identified by the number "3". Roller cones 102*a*, 102*c*, 102*e*, 102*h*, 102*i*, and 102*m* are all in a fourth orbit, identified by the number "4". Each group of roller cones slightly overlaps the orbits adjacent to its own orbit. For example, the roller cones 76*a*, 76*b* and 76*c* are in orbit "1" but slightly overlap orbit "2". The roller cones 102*b*, 102*f*, 102*j* are in orbit "3" but slightly overlap orbit "2" and orbit "4". This arrangement of the roller cones ensures that as the cutter assembly 44 cuts through the ground, each and all of the soil or rock located from adjacent shaft 68 outwardly to collar 99 will tend to be cut away by one of the roller cones as the cutter assembly 44 rotates. There will tend not to be small "islands" of uncut rock and soil left behind the cutter assembly 44 because of this configuration of roller cones.

Since each leg 96, 97, 98 may be positioned in generally the same location as the hour markings on an analog clock face, gaps may be defined between adjacent legs 96, 97, 98. These gaps are identified in FIG. 6 by the reference number 106. The gaps 106 are provided to allow cut material (i.e., cuttings or spoil or discharge) to move rearwardly out of the way of the cutter assembly 44 as it moves forward through the terrain. As will be explained later herein, the cut material is moved rearwardly by a combination of the forward and rotational movement of cutter assembly 44 and air pressure from air compressor 22 that entrains the cut material therein as the air flows through the air passage defined in the cutter assembly 44 and into and through the casing 36 to where those cuttings will be discharged through hose 42 and into second pit 14. It should be noted that the air passage may comprise a first air passage that is defined in the front cutting head 60 and a second air passage that is defined in the rear cutting head.

Referring once again to FIG. 4, auger 70 further comprises a pair of blades 107 that extend outwardly from the exterior surface of peripheral wall 86*a* of auger shaft 86, a distance rearwardly of the front end 86*b*. Blades 107 are opposed to each other and taper from a region where they join peripheral wall 86*a* to where they terminate at a truncated tip 107*a*. Blades 107 aid in further cutting material i.e., reducing the size of cuttings entering bore 66*d* of second housing 66.

Rearwardly of blades 107, a series of angled grinding plates 108 may be provided on auger shaft 86 and rearwardly of grinding plates 108 there is a plurality of auger flights 109 that are arranged in a helix around the exterior surface of auger shaft 86. Auger flights 109 extend outwardly away from the exterior surface of auger shaft 86. Grinding plates 108 may be of the largest size towards front end 86*b* of auger shaft 86 and may get progressively smaller moving toward rear end 86*c* thereof. Auger 70 may located substantially within bore 66*d* of second housing 66 and a portion of auger shaft 86 may extend outwardly and forwardly from bore 66*d*. Blades 107 and grinding plates 108 may be located entirely within bore 66*d* of second housing 66.

In accordance with an aspect of the present invention, one or more of the grinding plates 108 may define one or more holes 108*a* therein that extend from a front surface of the flights to the rear surface thereof. As best seen in FIG. 11B, grinding plates 108 may be oriented at a variety of different angles relative to auger shaft 86. In accordance with another aspect of the invention, an inner surface may extend between the front surface and rear surface of each flight 108*a* and the inner surface may bound and define the associated hole 108*a*. Inner surface may include a plurality of jagged teeth 108*b* that extend inwardly into the hole 108*a* in the plane of the flight 108. Holes 108*a* may allow some cuttings to pass therethrough and the jagged teeth provided on the flight 108 may further cut up the material that is being fed rearwardly by the auger 70. In other words, teeth 108*b* may further reduce the size of the cuttings moving through second housing 66. Connecting plates 108*c* (FIG. 11B) may be provided to connect one grinding plate 108 to another.

With primary reference to FIGS. 1A, 1B and 10, the operation the system is now described. As shown and discussed previously with respect to FIG. 1, pilot tube 20 may be used to form pilot hole 18. This may be done in any manner known in the art. Pilot hole 18 may be formed by forcing and/or drilling with pilot tube 20 from first pit 12 to second pit 14 or in the opposite direction from second pit 14 to first pit 12. Thus, rig 28 of control assembly 16 might be used to drive pilot tube 20 from first pit 12 to second pit 14, or rig 30 may be used to drive pilot tube 20 from second pit 14 to first pit 12. As is well-known in the art, this would be done by adding pilot tube segments 20*a*, 20*b*, 20*c*, etc. in an end-to-end fashion as the pilot hole 18 becomes longer. Once pilot tube 20 has formed pilot hole 18, such that one end of pilot tube 20 is exposed at first pit 12 and the other end exposed at second pit 14, the end exposed at second pit 14 is engaged with front end 50*a* of swivel 46. The other end of the pilot tube 20 that is exposed at first pit 12 is engaged with the conduits 26 that connect to air source 22 and water supply 24. Cutting assembly 44 may be rotated about longitudinal axis "Y" in a first direction ""L" to advance the assembly 44 in the direction of arrow "C" and pilot tube 20 and auger 70 may be rotated in the opposite direction "M" (FIG. 1B and FIG. 12A) to move the cut material 114 (FIG. 12A) in a direction opposite to arrow "C". In other instances, pilot tube 20 and auger 70, may be rotated in the same direction as the rotation of cutting assembly 44 (i.e., in the direction of arrow "L" or the opposite direction to arrow "M") and thereby move the cuttings, spoil or debris 114 in a direction opposite to arrow "C" (FIG. 1). It should be noted that pilot tube 20 and auger 70 may be rotated at a same speed as cutting assembly 44 or at a different speed (higher or lower) to the speed of rotation of the cutting assembly 44.

The swivel 46 will be engaged with swivel mount 52 on cutting assembly 44. Second housing 66 of cutting assembly will also be engaged with the forwardmost casing segment 36*b* and one or more casing segments 36 may be secured to casing segment 36*b* to engage cutting assembly 44 to engine 34. Engine 34 of rig 30 may be operated to drive rotation of a drive shaft that is operatively engaged with casing segment 36*a*. Air compressor 22 is actuated in first pit 12 so that pressurized air flows through conduits 26, through the bore of pilot tube 20, through air passage 50*d* of swivel and into the air passage of cutting assembly 44. The airflow may be in the range of from about 900 cfm up to about 1600 cfm or even higher to be effective at entraining cuttings from cutting assembly 44.

It will be understood that in some instances it may be desirable to utilize water or other fluids to discharge cuttings from cutting assembly 44 through casing 36 instead of air. In this instance, water supply 24 will be actuated in first pit 12 so that pressurized water or any other suitable fluid flows through conduits 26, through the bore of pilot tube 20 and into the air passage of cutting assembly 44.

As cutting assembly 44 is rotated (in the direction of arrow "L"—FIG. 12A) about the longitudinal axis "Y" by engine 34 and is advanced forwardly in the direction of arrow "C" (FIG. 1B), roller cones 76 of front cutting head 60 cut and break up the ground "G". Cut materials are fed rearwardly by rotating roller cones 76, arms 74 and plates 78 through fluted regions 64*e* in first housing 64 to the region rearwardly of the first housing 64. At this point cutting assembly 44 is rotating about the longitudinal axis "Y" and is still advancing in the direction of arrow "C" through ground "G". Front cutting head 60 cuts a first diameter borehole through ground "G".

Air flowing through the air passage in cutting assembly 44 blows cuttings toward shaft 68 with flanges 84 and cutting teeth 84*a* thereon and towards rear cutting head 62. Roller cones 102 and cutting teeth 104 cut and grind away additional material, thereby enlarging the diameter of the borehole cut by front cutting head 60. Cuttings from rear cutting head 62 pass through the gaps between the various arms 96, 97, and 98 of rear cutting head 62 and into bore 66*d* of second housing 66. Engine also actuates auger 70 to rotate independently in either of the same direction as the rotation of the rest of cutting assembly or opposite thereto. Grinding plates 108 of auger 70 feed the cuttings rearwardly through bore 66*d* towards casing 36. Some cuttings pass through the openings 108*a* grinding plates 108 and are further reduced in size by contacting the cutting teeth 108*b* as auger 70 is rotated. Finally, through the action of the pressurized air flowing through the air passage in cutting assembly 44 and the action of auger 70, cuttings from front and rear cutting heads 60, 62 enter the bore of casing 36. Since all of the casing segments 36*b*, 36*c*, 36*d* through to the rearmost casing segment 36*a* have bores that are in fluid communication with each other, the cut material (i.e., the spoil) entrained in the pressurized air blowing out of cutting assembly 44 will feed into casing 36, and finally out of discharge port 40 on HDD rig 30.

Since the spoil flowing through second housing 66 moves directly into casing 36, there is a substantially reduced chance of frac-out when this system is used. Furthermore, since collar 99 acts as a sealing surface and effectively substantially seals the borehole 110B that is cut in the ground "G", any cuttings, air and/or fluid that might inadvertently escape from casing 36 cannot flow forwardly and thereby be accidentally forced toward the surface as the cutting assembly 44 advances in the direction of arrow "C" through ground "G". The sealing collar 99 also aids in preventing air or fluid used during the boring operation from leaking into the environment and potentially damaging and contaminating the same. The collar 99 also ensures that the air or fluid that is forced through the air passage through front and rear cutting heads 60, 62 is under sufficient pressure to force cuttings through second housing 66 and into casing 36 to move the cuttings therethrough. If air and/or fluid can bleed around collar 99, then the pressure on the cuttings will be reduced and might be insufficient to move the cuttings through the second housing 66, through the casing 36 and out of the discharge port 40 and hose 42.

A method of generally horizontally boring a borehole 110B (FIG. 12A) may comprise steps of providing a cutting assembly 44 comprising a front cutting head 60 and a rear cutting head 62; wherein rear cutting head 62 is spaced a distance rearwardly behind front cutting head 60; rotating in the direction of arrow "L" (FIG. 12A) and moving forward in the direction of arrow "C", the cutting assembly 44 and a casing 36 extending rearwardly from cutting assembly 44 to cut an underground borehole 110; and moving pressurized air in the direction of arrow "E" rearwardly through an air passage 86*d*, 86*f*, 68*d*, 68*e*, 68*f*, 64*d*, 64*h*, 64*i*, 66*d* in front cutting head 60 and rear cutting head 62, including the space between front cutting head 60 and rear cutting head 62 and subsequently into a bore defined in casing 36 to discharge cuttings created by the front and rear cutting heads 60, 62 in a direction "P" (FIG. 12B) and out of rear end 36*a*, 40, 42 (FIGS. 1A, 1B) of casing 36.

The method may further comprise a step of driving the rotation of the cutting assembly 44 and of the casing 36 in the direction of arrow "L" (FIG. 12B) with a rotational output of an engine 34 adjacent the rear end 36*a* of casing 36. The step of rotating in the direction of arrow "L" and moving forward cutting assembly 44 and casing 36 in the direction of arrow "C" comprises pushing the rear end 36*a* of the casing 36 in the direction of arrow "C".

The method further comprises a step of providing a pilot tube 20 within an underground pilot hole 18 having a pilot hole diameter that is slightly larger than a diameter of the pilot tube; wherein the borehole 110A, 110B follows the pilot hole 18 and has a first borehole diameter (cut by the front cutting head 60) and a second borehole diameter (110B that is cut by the rear cutting head 62) that is larger than the pilot hole diameter. The method further comprises a step of engaging the cutting assembly 44 and pilot tube 20 together in end-to-end relationship via a swivel 46. This engagement causes pilot tube 20 to be rotatable in the same direction as the cutting assembly or the opposite direction relative thereto or at a same speed or a different speed relative to the cutting assembly that rotates in the direction of arrow "L".

The method further comprises engaging the pilot tube 20 with a front end 68*b* of a shaft 68 of cutting assembly 44 (FIG. 1B) via swivel 46 and placing a bore of the pilot tube 20 in fluid communication with bore 86*d* of auger shaft 86 and bore 68*d* of shaft 68; and moving pressurized air from air source 22 through conduits 26, through the bore of pilot tube 20 into bore 86*d* and bore 68*d* of shaft 68.

The step of moving pressurized air through the bore 86*d* of auger shaft 86 further comprises creating backpressure in the direction of arrow "H" (FIG. 12A). The step of creating backpressure in the direction of arrow "H" comprises engaging a plate 94 defining a pattern of holes 94*a* therein at a rear end 86*c* of bore 86*d* of auger shaft 86. The step of creating backpressure further comprises engaging one of a plurality of different plates 94 at rear end 86*c* of the bore 86*d* of auger shaft 86, wherein each of the plurality of different plates, such as plate 94, defines a different pattern of holes 94*a* therein. An exemplary pattern of holes 94*a* may be seen in FIG. 8, though other patterns are possible. The plate 94 that is engaged with auger shaft 86 is selected by an operator based on a particular pattern of holes 94*a* arranged in the selected plate 94. The pattern of holes 94*a* in any particular plate 94 is selected on the basis of the terrain (i.e., type of rock, soil, ground, obstacles, etc.) through which borehole 110B is to be cut as the pattern of holes 94*a* will affect the strength of the backpressure generated within shaft 68. If a strong airflow is required to blow heavier, larger particle cuttings through the cutting assembly 44, through casing 36 and out of discharge port 42, then a first configuration or pattern of holes 94*a* in plate 94 will be selected. If a less vigorous airflow is required to blow cuttings (such as smaller, lighter particles like beach sand) through cutting assembly 44 and casing 36 and out of discharge port 42, then a plate 94 with a completely different pattern of holes 94*a* may be selected.

The method further comprises sealing the borehole 110B with a collar 99 provided rearwardly of rear cutting head 62 on cutting assembly. The method further comprises providing a rearwardly tapered second housing 66 (FIGS. 12C and 12B) rearwardly of rear cutting head 62 and attaching casing 36 to a rear end 66*e* of the tapered second housing 66; and directing cuttings from rear cutting head 62 through bore 66*d* defined by the tapered second housing 66 and into casing 36. This directing of cuttings is accomplished by additionally using an auger provided in cutting assembly 44.

The method further comprises cutting a first diameter borehole 110A with front cutting head 60 and cutting a larger second diameter borehole 110B with rear cutting head 62 and performing this cutting operation without withdrawing the cutting assembly 44 from the borehole 110A, 110B between the cutting of the first diameter borehole 110A and the cutting of the second diameter borehole 110B. In other words, the cutting of the two different diameter sections 110A, 110B of the borehole is accomplished in a single pass of cutting assembly 44.

The step of moving pressurized air through cutting assembly 44 occurs essentially without moving a liquid rearwardly through the air passage in cutting assembly 44 and into casing 36.

Furthermore, the step of rotating in the direction of arrow "L" and moving forward in the direction of arrow "C" occurs without delivering a liquid adjacent the cutting assembly 44 other than liquid occurring naturally in the ground through which cutting assembly 44 cuts borehole 110A, 110B. Additionally, wherein other than liquid occurring naturally in ground through which cutting assembly 44 cuts the borehole 110A, 110B, essentially no liquid is used to discharge from the borehole 110A, 110B cuttings created by cutting assembly 44.

Figure 13:
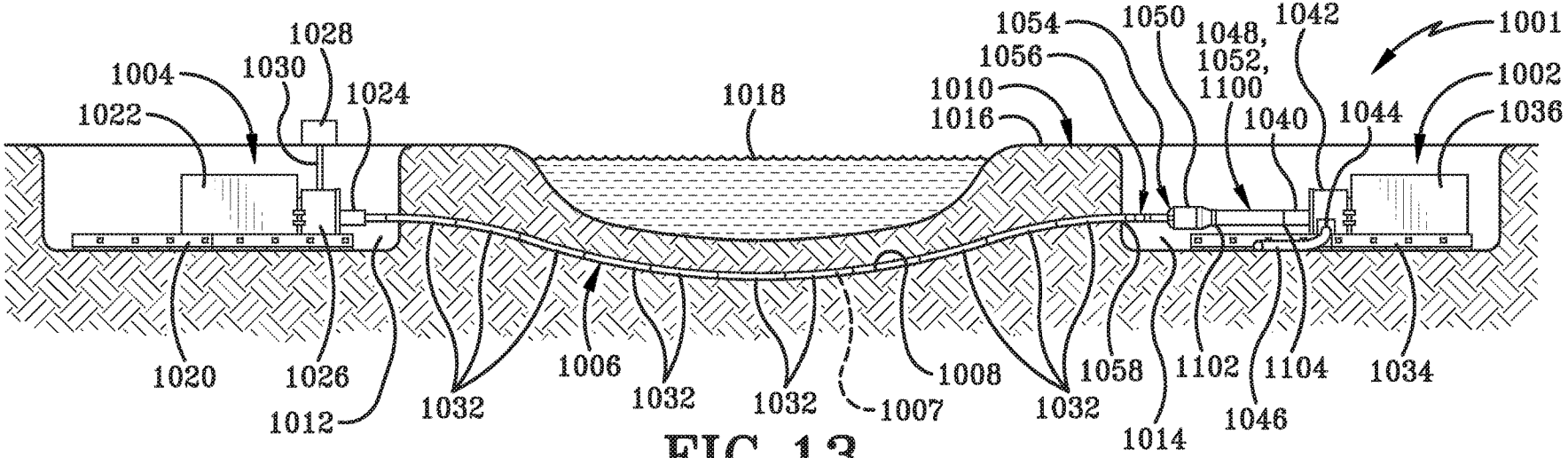
FIG. 13 (FIG. 13) is a diagrammatic side elevation view of a horizontal directional drilling system with the ground shown in section to illustrate a pilot hole formed in the ground with the pilot tube remaining within the pilot hole.

FIG. 13 shows a sample earth-boring or horizontal directional drilling (HDD) apparatus or system 1001 which may include an HDD rig 1002 and a pilot tube drive rig or pilot tube control rig 1004. Pilot tube drive rig 1004 may be configured to drive or control a pilot tube or drill string 1006 to drill or otherwise form a pilot hole 1008 in the ground or earth 1010 extending from one station or pit 1012 to another station or pit 1014 generally adjacent and below the ground surface 1016 of ground 1010 and possibly below a surface obstacle 1018 shown here in the form of a waterway such as a stream, river, pond or lake although obstacle 1018 may also represent many other types of obstacles such as roads, buildings, walls, trees and so forth such that trenchless or HDD drilling is desirable. Pilot hole 1008 (and the larger diameter borehole discussed later herein) may have a substantial length which may be, for instance, at least 50, 100, 150, 200, 250 or 300 feet or more. Thus, station 1012 and rig 1002 are distal station 1014 and rig 1004 and may be separated by such lengths or distances.

Pilot drive or control rig 1004 may include tracks 1020 which may be rigidly secured to ground 1010 at station 1012 which may be within a pit 1012. While tracks 1020 are shown as being horizontal, they may be angled relative to horizontal so that the pilot hole 1008 at its end adjacent station 1012 is at an angle to horizontal. Rig 1004 may also include an engine 1022 which is mounted on tracks 1020 and has a rotational output/pilot tube connector 1024, which may pass through an air connection swivel 1026. Engine 1022, connector 1024 and swivel 1026 are movable back and forth in a forward and rearward direction as shown at Arrow P in FIG. 19 along tracks 1020 relative to tracks 1020 and the ground. Air compressor 1028 may be positioned adjacent station 1012 with an air hose or conduit 1030 extending between and connected to air compressor 1028 and swivel 1026 such that air compressor 1028 is in fluid communication with a pilot tube air passage 1007 (FIGS. 13, 19) formed in pilot tube 1006 and extending from one end (a first or front end) of the pilot tube to the other end (a second, rear or back end) of the pilot tube, that is along the entire length of pilot tube 1006. The first or front end of pilot tube 1006 is in or adjacent pit/station 1012 and the second or back end of pilot tube 1006 is in or adjacent pit/station 1014, whereby compressor 1028 is in fluid communication with passage 1007 via the front end of pilot tube 1006. Pilot tube 1006 is made up of a plurality of pilot tube segments 1032 which are connected to one another in an end-to-end fashion and are removable from one another. For instance, each adjacent pair of segments 1032 may be joined to one another by a threaded engagement or other removable connections known in the art. Each of segments 1032 may define air passages extending from the front end to the rear end thereof such that each of the pilot tube segment passages are in fluid communication with one another to form pilot tube air passage 1007.

HDD rig 1002 may include tracks 1034 which are secured to ground 1010. While tracks 1034 are shown as being horizontal, they may be angled relative to horizontal so that the pilot hole at its end adjacent station 1014 extends at an angle to horizontal. Rig 1004 may further include an engine 1036 having a rotational output 1038 (FIG. 15) with a connector 1040 which is coupled to output 1038 for rotation therewith. Connector 1040 may also be referred to as a casing segment or rearmost casing segment 1040. Rig 1004 may further include a front discharge box 1042 with casing segment 1040 extending from within box 1042 forward and out of box 1042. Box 1042 may have an outlet or exit port 1044 and which may have connected to it a discharge hose or conduit 1046. Casing segment 1040 may be part of a casing 1048 having a larger diameter front section 1050 and a smaller diameter rear section 1052. An earth-boring cutter head 1054 may be mounted at the front of front or forward section 1050 with a swivel 1056 extending between and connected to the front of the cutter head 1054 and a rear end 1058 of pilot tube 1006. HDD rig 1002 is movable back and forth in a forward and rearward direction as shown at Arrow Q in FIG. 19 along tracks 1034, which include the back and forth movement of engine 1036, housing or box 1042, connector 1040 and hose 1046 relative to tracks 1034 and ground 1010.

Figure 14:
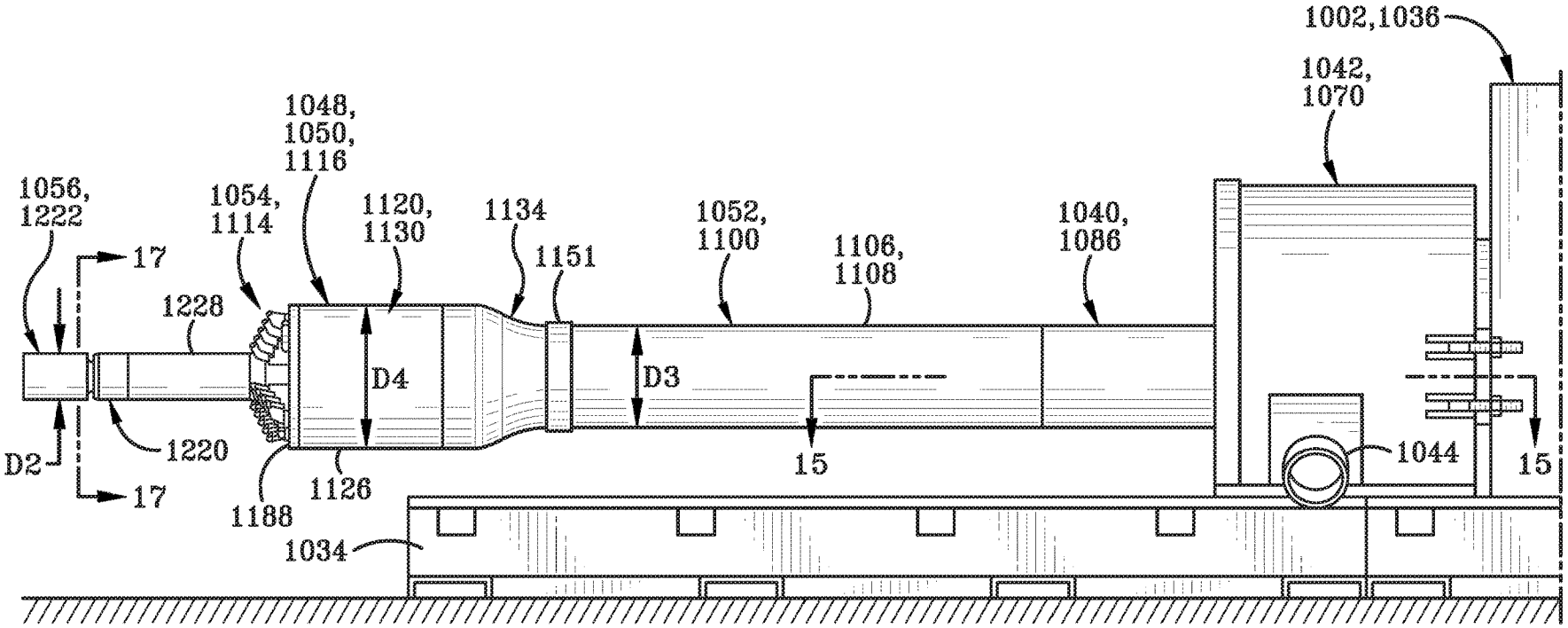
FIG. 14 (FIG. 14) is a side elevational view showing a reamer or reaming assembly extending forward from a power drive of a horizontal directional drilling rig.

Pilot tube 1006 may have an outer diameter D1 (FIG. 19) defined by its cylindrical outer perimeter or outer surface. As shown in FIG. 14, swivel 1056 may have an outer diameter D2 defined by its cylindrical outer surface or outer perimeter, rearward section 1052 of casing 1048 may have an outer diameter D3 defined by its cylindrical outer surface or outer perimeter, and section 1050 may have an outer diameter D4 defined by its cylindrical outer surface or outer perimeter. Diameter D2 may be the same as or essentially the same as diameter D1. Diameter D3 may be substantially larger than diameters D1 and D2, and diameter D4 substantially larger than diameter D3. The difference between diameters D4 and D3 is usually at least four inches and may be substantially more than that. For instance, the difference between diameters D4 and D3 may be at least 4, 5, 6, 7, 8, 9, 10, 11, 12, 18, 24, 30 or 36 inches or may fall within a range of about 4, 5, 6, 7, 8, 9, 10, 11 or 12 inches to about 8, 9, 10, 11, 12, 18, 24, 30 or 36 inches. There may be a ratio of diameter D4 to diameter D3 which is at least 1.2:1, 1.3:1, 1.4:1, 1.5:1, 1.6:1, 1.7:1, 1.8:1, 1.9:1, 2:1, 2.5:1, 3:1, 3.5:1 or 4:1, or said ratio may fall within a range of about 1.2:1, 1.3:1, 1.4:1, 1.5:1, 1.6:1, 1.7:1, 1.8:1, 1.9:1 or 2:1 to about 1.6:1, 1.7:1, 1.8:1, 1.9:1, 2:1, 2.5:1, 3:1, 3.5:1 or 4:1.

Figure 15:
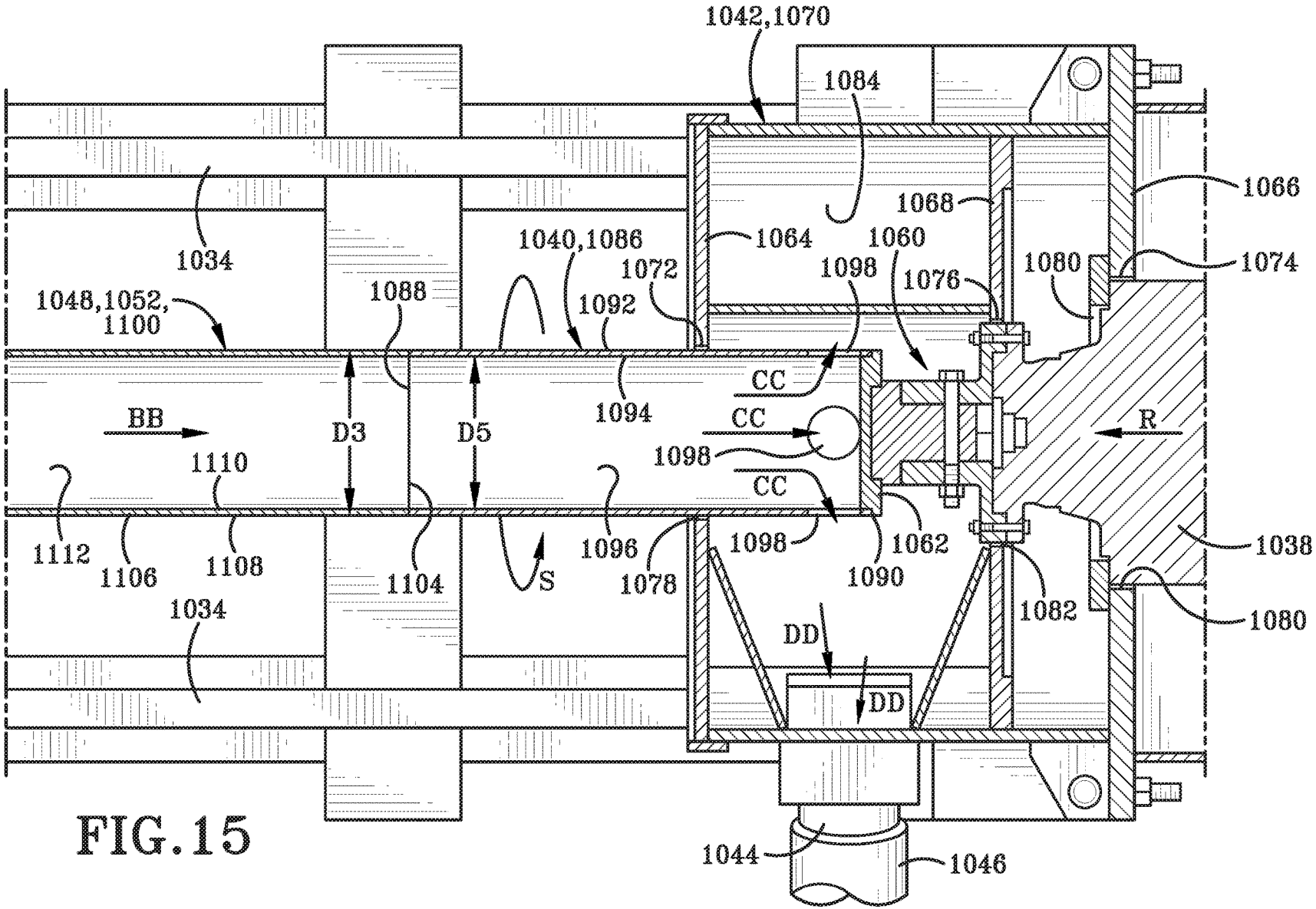
FIG. 15 (FIG. 15) is a sectional view taken on line 15-15 of FIG. 14 showing in part the inside of the rear end of the smaller diameter casing and the interior chamber of the front box of the power drive.

With primary reference to FIG. 15, a coupler 1060 may extend between and be secured to the front of rotational output or drive shaft 1038 and a rear end of casing segment 1040. Coupler 1060 thus secures the rear end of segment 1040 to the front of output 1038 in order to translate rotational movement of output 1038 to casing segment 1040 and all of the casing 1048 and cutter head 1054 and one portion of swivel 1056. Coupler 1060 may include or be secured to an end cap, pushing plate or pushing cap 1062 which contacts the rear end of casing segment 1040 and covers the air passage defined by segment 1040 which extends from its front end to its rear end. Coupler 1060 thus translates the forward movement of output 1038 (Arrow R) to casing segment 1040 and the entire casing 1048, cutter head 1054, swivel 1056 and pilot tube 1006 when connected to the front of swivel 1056. This forward movement of the rotational output 1038 and coupler 1060 and so forth would occur during the forward movement of rig 1002 along tracks 1034. Coupler 1060 may have any suitable configuration and may include various fasteners such as bolts as shown in FIG. 15. Drive shaft 1036, coupler 1060, cap 1062, connector 1040 and casing 1048 may serve as a drive train extending between engine 1036 and cutter head 1054 for pushing and driving rotation of cutter head 1054.

Box 1042 may include an annular front wall 1064, an annular back wall 1066 and an annular intermediate wall 1068 which is rearward of front wall 1064 and forward of back wall 1066. Box 1042 may further include a cylindrical sidewall 1070 such that each of walls 1064, 1066 and 1068 are secured to sidewall 1070 and extend radially inwardly therefrom to respective inner perimeters 1072, 1074 and 1076 which respectively define openings or holes 1078, 1080 and 1082 each of which extends from the front to the back of the given wall 1064, 1066 and 1068. Hole 1078 has an inner diameter defined by inner perimeter 1072 which is slightly larger than outer diameter D3. Thus, the outer diameter or surface of casing segment 1040 is closely adjacent inner perimeter 1072 inasmuch as segment 1040 extends through hole 1078 with a portion of segment 1040 extending forward of front wall 1064 and a portion of segment 1040 extending within an interior chamber 1084 of box 1002 defined within walls 1064, 1068 and 1070. An annular seal may be positioned adjacent inner perimeter 1072 to form a seal between front wall 1064 and the outer surface of casing segment 1040. Drive shaft or output 1038 extends through hole 1080 while output 1038 and/or coupler 1060 may extend through hole 1082. An annular seal may be positioned adjacent inner perimeter 1074 to provide a seal between wall 1066 and shaft 1038. Likewise, an annular seal may be provided along inner perimeter 1076 to provide a seal between wall 1068 and shaft 1038 and/or coupler 1060. Port 1044 is in fluid communication with interior chamber 1084, as is the passage defined by hose 1046 which is connected at one end thereof to port 1044 and extends outwardly therefrom to a discharge end.

With continued reference to FIG. 15, casing segment 1040 includes a cylindrical sidewall 1086 having a front end 1088, a back end 1090 and cylindrical outer and inner surfaces 1092 and 1094 extending from front end 1088 to back end 1090. Outer surface 1092 may define an outer diameter which is the same as outer diameter D3 of the rear section 1052. Inner surface 1094 may define an inner diameter D5 which may serve as the inner diameter of rear section 1052 from the front to the rear end thereof. Inner surface 1094 defines a cuttings passage 1096 (which may also be referred to as an interior chamber or an interior bore) which extends from front end 1088 to adjacent back end 1090. Passage 1096 may be referred to as a connector cuttings passage or rearmost casing segment cuttings passage. Cap 1062 covers or closes the back end of passage 1096. A plurality of exit holes or openings 1098 may be formed in sidewall 1086 adjacent rear end 1090 extending from inner surface 1094 to outer surface 1092. Openings 1098 are in fluid communication with passage 1096 and interior chamber 1084, outlet 1044 and the passage defined by hose 1046.

Figure 19:
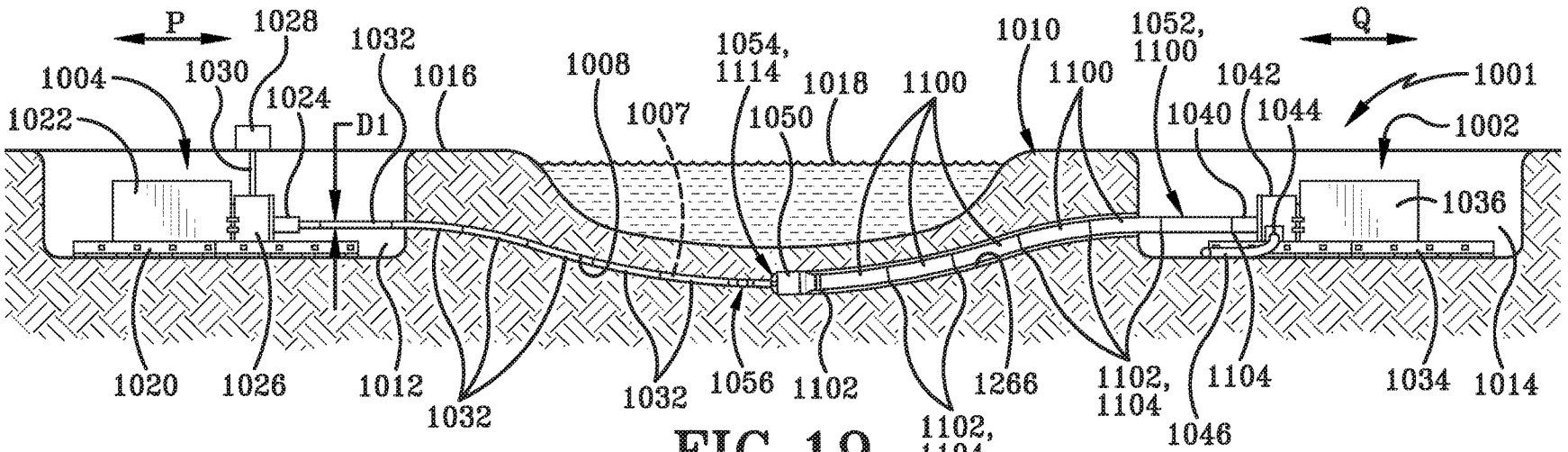
FIG. 19 (FIG. 19) is an operational view similar to FIG. 13 showing the reamer assembly having cut an enlarged borehole which is larger than and follows the path of the pilot hole.

With continued reference to FIG. 15 and additional reference to FIGS. 13 and 19, casing section 1052 may include a plurality of smaller diameter casing segments 1100 which may be secured in an end-to-end fashion such that the casing section 1052 extends between and is secured to the larger diameter section 1050 and rearmost segment 1040, or to coupler 1060 inasmuch as segment 1040 may be deemed to be part of the narrower diameter section. Each segment 1100 has a front end 1102 and a back end 1104 such that the back ends 1104 are secured to respective front ends 1102 of other segments 1100 and the back end 1104 of the rear segment 1100 secured to front end 1088 of casing segment 1040. Each segment 1100 may have a cylindrical sidewall 1106 which defines front and back ends 1102 and 1104 and which includes cylindrical outer and inner surfaces 1108 and 1110. Outer surface 1108 of each segment 1100 has an outer diameter D3. Inner surface 1110 defines a casing segment cuttings passage 1112 extending from front end 1102 to back end 1104 and having an inner diameter D5. The various cuttings passages 1112 of segments 1100 are in fluid communication with one another and with passage 1096 of segment 1040, as well as openings 1098, interior chamber 1084, outlet 1044 and the hose 1046 passage. During different stages of the underground boring process, different numbers of casing segments 1100 may be used and secured to one another. Initially, only one or two segments 1100 may form part of casing 1048, whereas later in the process, casing 1048 may include at least 5, 10, 15, 20, 25, 30, 35, 40, 45 or 50 or more segments 1100.

Figure 16:
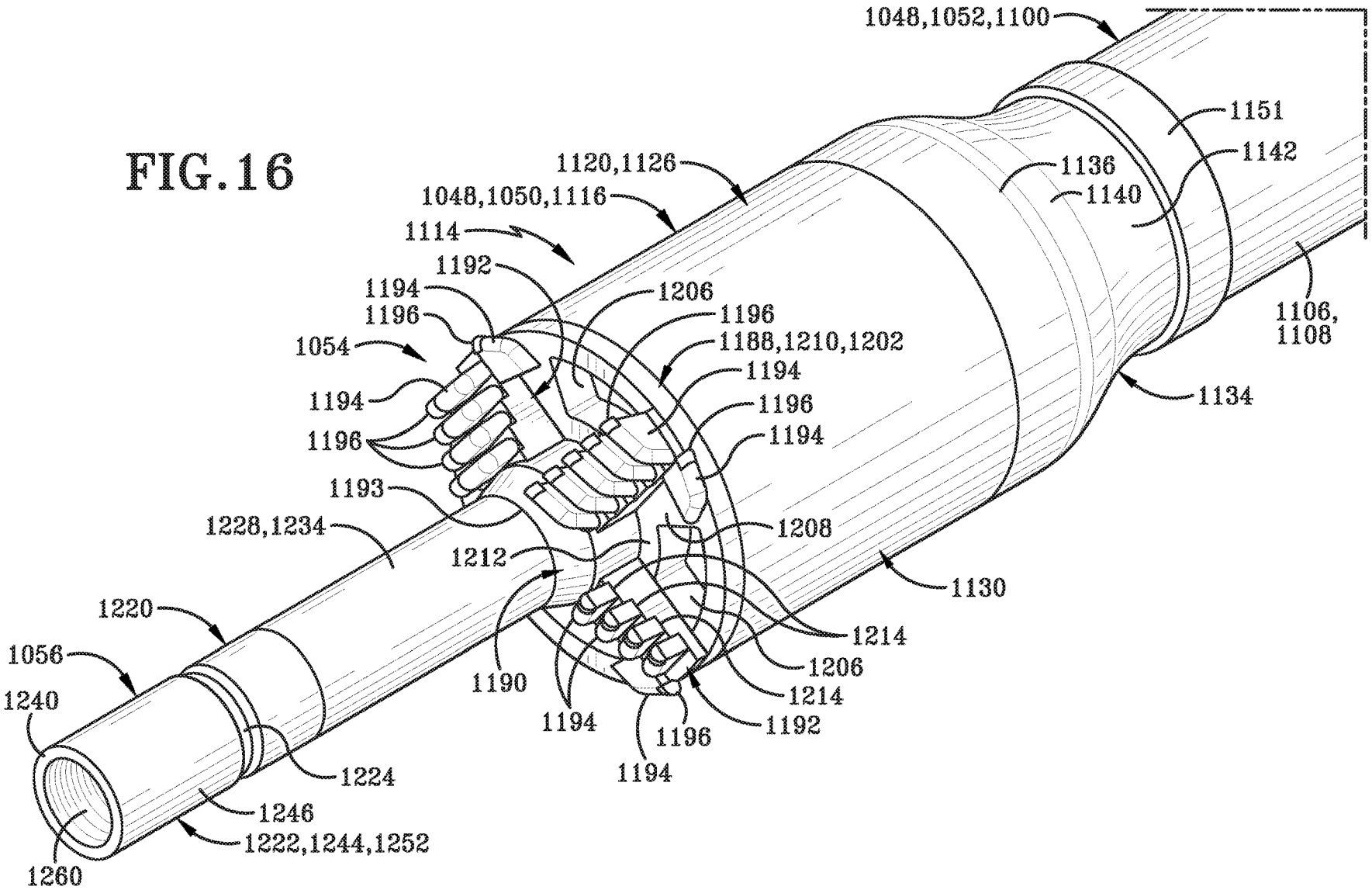
FIG. 16 (FIG. 16) is an enlarged perspective view of the cutting head region.
Figure 17:
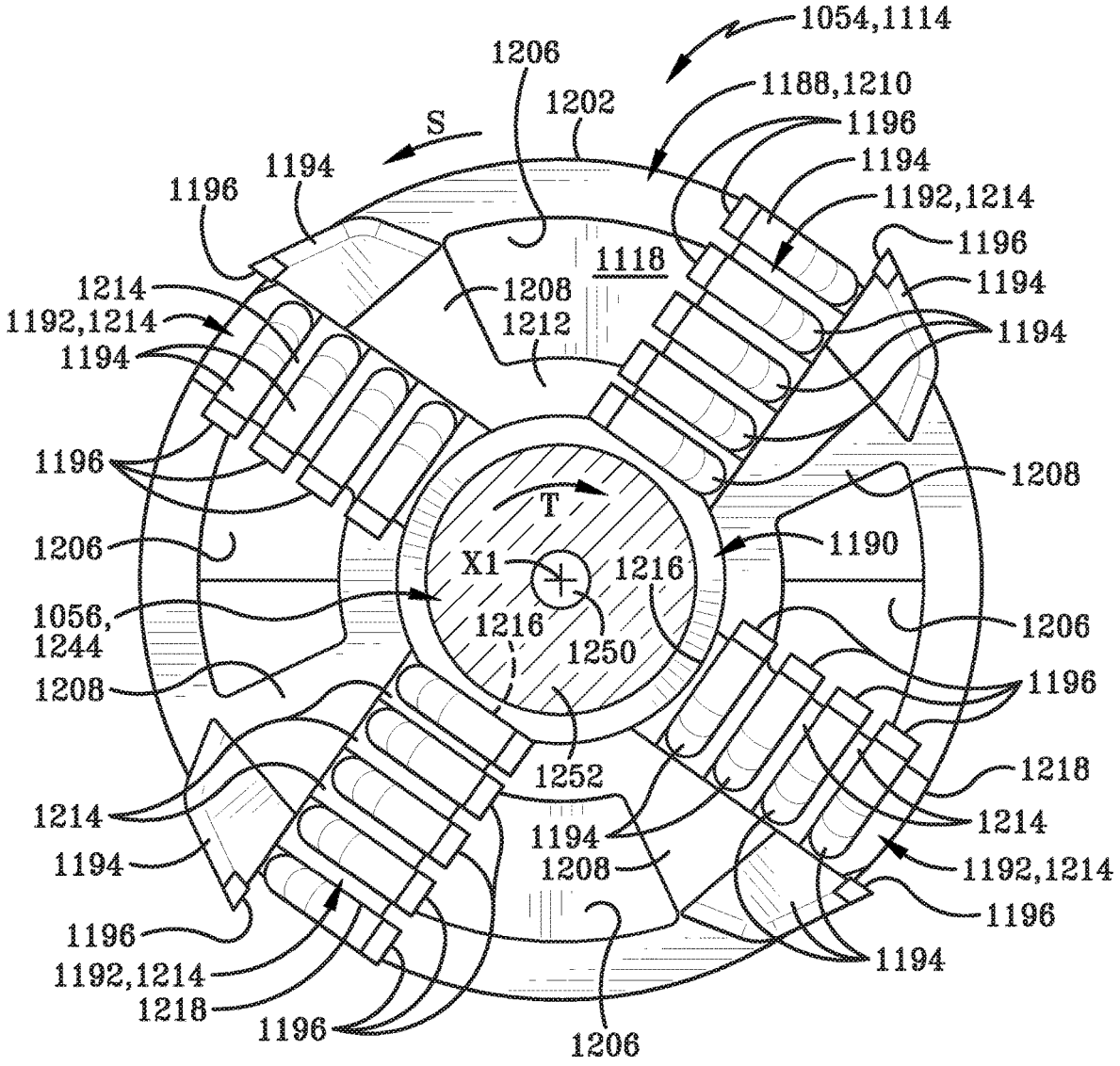
FIG. 17 (FIG. 17) is an enlarged sectional view taken on line 17-17 of FIG. 14 showing a cross-sectional view of a portion of the swivel and a front end elevation view of the cutter head.
Figure 18:
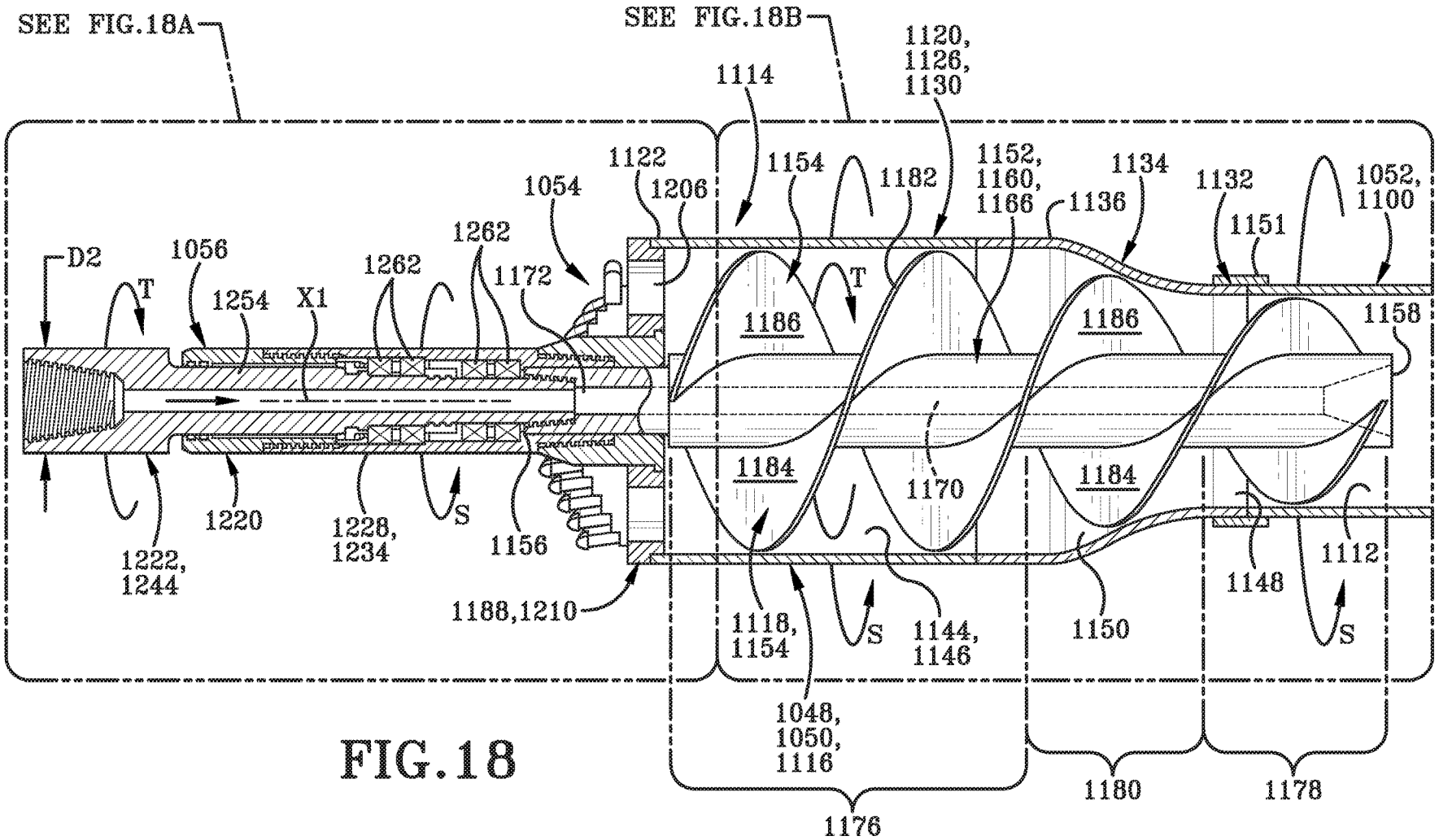
FIG. 18 (FIG. 18) is a longitudinal sectional view showing the swivel, cutter head and portions of the casing in section with the auger shown in a side elevation view.

With primary reference to FIGS. 16-18B, system 1001 may include a reamer or reamer assembly 1114 which may include cutter head 1054 and a front casing segment 1116 which defines or includes larger diameter front section 1150. An auger 1118 (FIG. 18) may extend within section 1050 and a front portion of section 1052. Reamer 1114 is rotatable about a central longitudinal axis X1 (FIG. 18). More particularly, front casing segment 1116 is rotatable about axis X1 together with cutter head 1054, an outer portion of swivel 1056 and the front segment 1100 of section 1052. Auger 1118 is likewise rotatable about axis X1 together with an inner portion of swivel 1056 independently of the rotation of segment 1116, cutter head 1054, the outer portion of swivel 1056 and the front segment 1100. Sidewall 1106 including outer and inner surfaces 1108 and 1110 may be concentric about axis X1. Casing segment 1116, auger 1118, swivel 1056, cutter head 1054, wider section 1050 are or may be distal the rear end of casing 1048, casing segment/connector 1040 and rig 1002 including box 1042, cap 1062, coupler 1060, drive shaft 1038, engine 1036 and tracks 1034.

Front casing segment 1116 may include an annular sidewall 1120 generally having a circular cross section, a front end 1122 and a back end 1124. Sidewall 1120, which may be formed of one or more annular pieces or segments, may further include annular outer and inner surfaces 1126 and 1128 which extend from front end 1122 to back end 1124. Sidewall 1120 may include a front larger diameter cylindrical portion 1130, a back or rear smaller diameter cylindrical portion 1132 and a tapered portion 1134 which extends rearwardly from a back end 1136 of portion 1130 to a front end 1138 of portion 1132. Outer surface 1126 faces generally radially outwardly away from axis X1, while inner surface 1128 faces radially inwardly toward axis X1. Outer and inner surfaces 1126 and 1128 along the length of front section 1130 and along the length of section 1132 may be essentially parallel to axis X1 and to one another. Sidewall 1120 in section 1130, sidewall in section 1132, outer and inner surfaces 1126 and 1128 of section 1130, and outer and inner surfaces 1126 and 1128 of section 1132 may be concentric about axis X1.

Outer surface 1126 along tapered portion 1134 faces radially outwardly and rearwardly. Inner surface 1128 along tapered portion 1134 faces radially inwardly and forward. Tapered section 1134 may include a front curved segment 1140 (FIG. 18B) extending rearwardly from back end 1136 of portion 1130 and a rear curved segment 1142 extending forward from the front end 1138 of back portion 1132. As shown in FIG. 18, outer surface 1126 along front curved segment 1140 may be convexly curved as viewed from the side of the reamer, whereas outer surface 1126 along rear curved segment 1142 may be concavely curved as viewed from the side. Inner surface 1128 along front segment 1140 may be concavely curved as viewed from the side in a longitudinal section (such as shown in FIG. 18), whereas inner surface 1128 of rear segment 1142 may be convexly curved as viewed from the side as seen in a longitudinal section such as FIG. 18. Inner surface 1128 defines a casing segment cuttings passage 1144 which may also be referred to as an auger receiving passage and which extends from front end 1122 to back end 1124. Passage 1144 may include a wider or larger diameter portion 1146 extending from the front end 1122 to the back end 1136 of front portion 1130, a narrower or smaller diameter portion 1148 extending from the front end 1130 of back portion 1132 to back end 1124, and a tapered portion 1150 extending from back end 1136 to front end 1138. An annular collar 1151 may encircle or surround a rear portion of back portion 1132/segment 1116 adjacent back end 1124 and a front portion of frontmost casing 1100 adjacent front end 1102 to help rigidly secure frontmost casing segment 1100/narrower section 1052 to segment 1116/wider section 1050. A plurality of fasteners (not shown) such as bolts or screws may extend through collar 1151 and sidewalls 1120 and 1106 to secure collar 1151, frontmost casing segment 1000 and casing segment 1116 to one another. Similar collars and fasteners may be used between adjacent pairs of casing segments 1000 to secure a given front end 1102 of one segment 1100 to a given back end 1104 of another segment 1100, whereby such collars may be used to secure segments 1100 in the end-to-end fashion shown in FIG. 19.

Inner surface 1128 along front portion 1130 defines an inner diameter D6 (FIG. 18B) of wider portion 1146. Inner surface 1128 along back portion 1132 defines an inner diameter which may be the same as or essentially the same as diameter D5. The difference between diameters D6 and D5 may be the same as or fall in the same range as discussed with respect to the difference between diameters D4 and D3. Likewise, there may be a ratio of diameter D6 to diameter D5 which is the same as or within the same range as discussed with respect to the ratio of diameter D4 to diameter D3. Inner surface 1128 along tapered portion 1134 defines an inner diameter which is less than inner diameter D6 and greater than inner diameter D5.

Figure 18A:
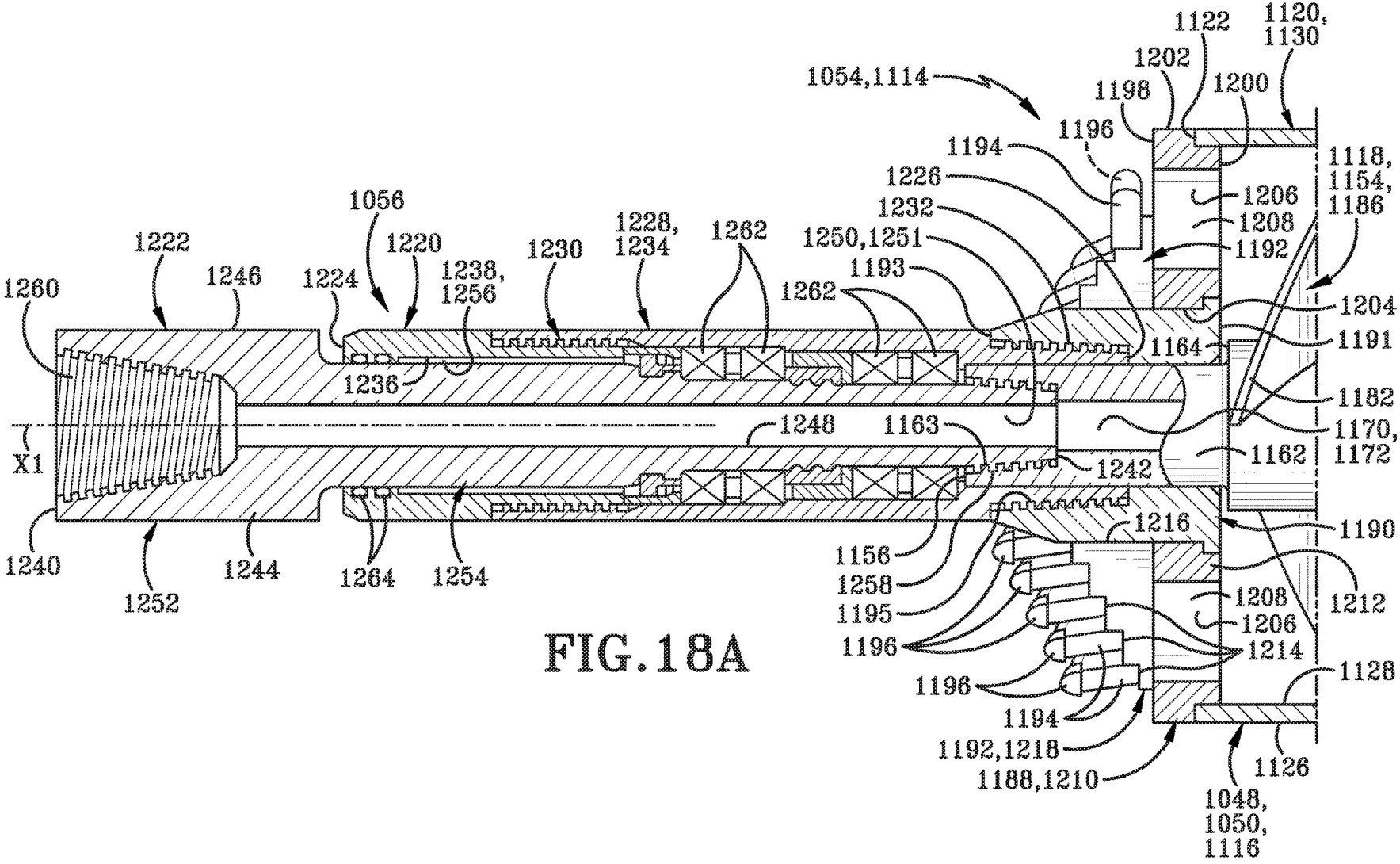
FIG. 18A (FIG. 18A) is an enlarged sectional view of the encircled portion of FIG. 18 with reference line "FIG. 18A".
Figure 18B:
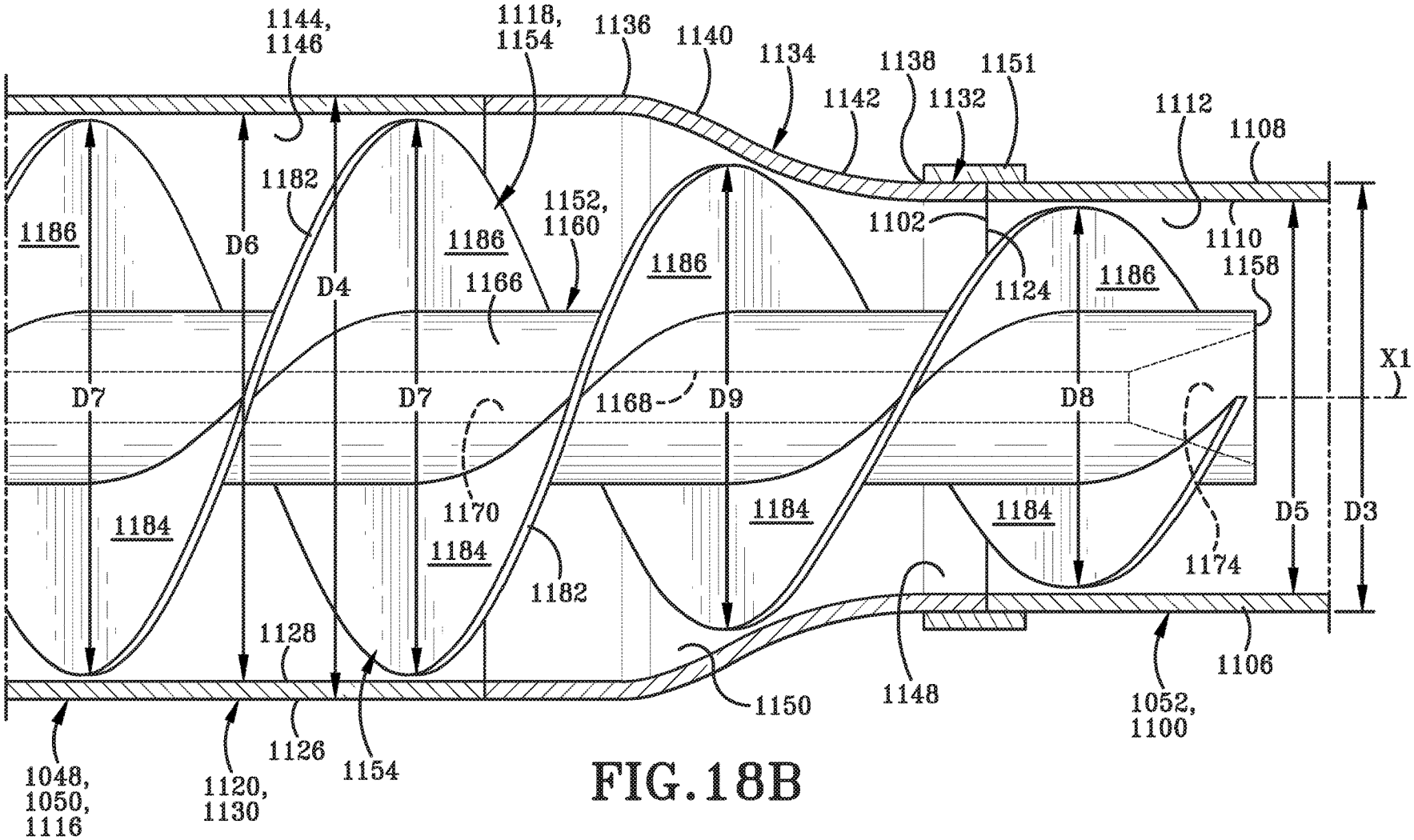
FIG. 18B (FIG. 18B) is an enlarged sectional view of the encircled portion of FIG. 18 with reference line "FIG. 18B".

With primary reference to FIGS. 18 and 18B, auger 1118 may include a rigid auger shaft 1152 and one or more helical auger flights 1154 secured to shaft 1152 and extending radially outwardly therefrom. Auger 1118 has a front end 1156 and a terminal rear or back end 1158 such that shaft 1152 extends from front end 1156 to back end 1158. Shaft 1152 may include a wider or larger diameter segment 1160 and a narrower or smaller diameter segment 1162 (FIG. 18A) adjacent front end 1156. Shaft 1152 may include a shoulder or step 1164 (FIG. 18A) which steps inwardly from wider segment 1160 to narrower segment 1162. Step 1164 may serve as a front end of wider segment 1160 and a back end of narrower segment 1162 so that segment 1160 extends from back end 1158 to front end 1164 and narrower segment 1162 extends from back end 1164 to front end 1156. Narrower segment 1162 may include an externally threaded section 1163 adjacent the back end of segment 1162. Shaft 1152 has an outer surface 1166 which is typically cylindrical and a typically cylindrical inner surface 1168 (FIG. 18B) which defines an auger air passage 1170 extending from front end 1156 to back end 1158 of shaft 1152. Air passage 1170 has a front entrance opening 1172 adjacent front end 156 and a rear entrance opening 1174 (FIG. 18B) at or adjacent rear end 1158. Passage 1170 is in fluid communication with cuttings passage 1112 of the front segment 1100 and the cuttings passage of smaller diameter rear section 1052 of the casing, whereby passage 1170 is likewise in fluid communication with openings 1098, chamber 1084, outlet 1044 and hose 1046 (FIG. 15). Each helical flight 1154 is secured to and extends radially outwardly from outer surface 1166 of wider segment 1160 and may extend from adjacent front end 1164 to adjacent back end 1158. Flights 1154 may generally follow the contour of inner surface 1128 of casing segment 1116 and thus have a wider or larger diameter front section 1176, a narrower rear section 1178 and a tapered or intermediate section 1180 which extends from the back of front section 1176 to the front of rear section 1178. More particularly, each helical flight 1154 extends radially outwardly from outer surface 1166 of segment 1160 to an outer terminal helical edge 1182 which may extend continuously from the front of the flight to the back of the flight. Each flight 1154 may have a forward facing front face 1184 which extends from outer surface 1166 and the inner edge of a given flight to the helical edge 1182 of the given flight. Likewise, each flight 1154 may have a rearwardly facing rear face 1186 which extends outwardly from outer surface 1166 and the inner edge of the given flight to the outer helical edge 1182 of the given flight. Each of faces 1184 and 1186 may have a helical configuration.

Helical edge 1182 along wider front section 1176 and along narrow back portion 1132 may be concentric about axis X1. Helical edge 1182 along wider front section 1176 may define an outer diameter D7 (FIG. 18B) which is slightly less than inner diameter D6 such that this portion of outer helical edge 1176 is closely adjacent or in contact with inner surface 1128 of front portion 1130. Helical edge 1182 along narrow back portion 1132 and the front region of the frontmost casing segment 1100 may define an outer diameter D8 (FIG. 18B) which is slightly less than diameter D5 such that helical edge 1182 of rear section 1178 is closely adjacent or in contact with inner surface 1128 of back portion 1132 and/or inner surface 1110 of the foremost casing segment 1100. Helical edge 1182 tapers inwardly and rearwardly within tapered section 1180 from the rear of wider section 1176 to the front of narrower section 1178 so that this portion of helical edge 1182 defines an outer diameter D9 (FIG. 18B) which may vary and which is slightly less than the inner diameter defined by inner surface 1128 of tapered portion 1134, whereby helical edge 1182 within tapered section 1180 is closely adjacent or in contact with inner surface 1128 of tapered segment 134. Diameters D8 and D9 are thus less than diameter D7, and diameter D8 is less than diameter D9. The difference between diameters D7 and D8 may be the same as or fall in the same range as discussed with respect to the difference between diameters D4 and D3. Likewise, there may be a ratio of diameter D7 to diameter D8 which is the same as or within the same range as discussed with respect to the ratio of diameter D4 to diameter D3.

With primary reference to FIGS. 16, 17 and 18A, cutter head 1054 may include a base plate 1188, a swivel mount 1190, a plurality of cutter tooth mount blocks 1192, a plurality of cutter teeth 1194 wherein each tooth 1194 includes a cutting tip or face 1196. Base plate 1188 may have front and back surfaces 1198 and 1200 which may be parallel to one another and perpendicular to axis X1. Plate 1188 has a circular or cylindrical outer surface or perimeter 1202 which extends between surfaces 1198 and 1200 and may be concentric about axis X1. Casing segment 1116 may be rigidly secured to plate 1188 and extends rearwardly therefrom to rigidly secure segment 1116/casing 1048 to plate 1188/cutter head 1054. Wider portion 1130 adjacent front end 1122 may be secured to plate 1188 along or adjacent outer perimeter 1202. Outer surface 1202 may define an outer diameter which may be the same as or similar to outer diameter D4 of wider front section 1050. Thus, the differences between the outer diameter of plate 1188 and diameter D3 of narrower back section 1052 may be the same as or fall in the same range as discussed with respect to the difference between diameters D4 and D3. Likewise, the ratio of the outer diameter of plate 1188 to diameter D3 may be the same as or within the same range as discussed with respect to the ratio of diameter D4 to diameter D3. Cutter head 1054 may have an outer diameter similar to that of perimeter 1202 (may be the same or slightly larger) such that the outer diameter of cutter head 1054 and diameter D3 of narrower back section 1052 may be the same as or fall in the same range as discussed with respect to the difference between diameters D4 and D3. The outer diameter of cutter head 1054 is thus of course substantially greater than that of pilot tube outer diameter D1.

Plate 1188 may define a central hole 1204 extending from front surface 1198 to back surface 1200 and in which is received swivel mount 1190. More particularly, swivel mount 1190 is rigidly secured to plate 1188 within hole 1190 and extends forward outwardly from front surface 1198. Swivel mount 1190 may have a back end 1191 which is adjacent or substantially flush with back surface 1200 of plate 1188. Mount 1190 may have a front end 1193 which is spaced forward of front surface 1198 of plate 1188. Mount 1190 may have an internally threaded portion 1195 extending rearwardly from front end 1193. Plate 1188 may define a plurality of cuttings passages or openings 1206 extending from front surface 1198 to back surface 1200. Openings 1206 may serve as front cuttings entrance openings of casing air passage or cuttings passage 1144 adjacent the front end of casing 1048 and communicate with cutter teeth 1194 to allow cuttings from teeth 1194/faces 1196 to enter passage 1144 through openings 1206. Openings 1206 may be circumferentially spaced from one another whereby plate 1188 includes a plurality of radial arms 1208 which are also circumferentially spaced from one another such that each arm 1208 extends between an adjacent pair of openings 1206 and each opening 1206 extends between an adjacent pair of arms 1208. Thus, openings 1206 and arms 1208 may circumferentially alternate. Plate 1188 may further include an outer ring 1210 which includes outer surface 1202 and an inner ring 1212 which defines hole 1204. Each arm 1208 is rigidly secured to and extends outwardly from inner ring 1212 to a rigid connection with outer ring 1210. Each opening 1206 extends from an outer diameter or surface of inner ring 1212 to an inner diameter or surface of outer ring 1210 and from a radially extending surface of one arm 1208 to a radially extending surface of the adjacent arm 1208. In the sample embodiment, there are four openings 1206 and four arms 1208 although these numbers may vary. Entrance openings for the same purpose as openings 1206 may be formed in sidewall 1120 adjacent cutter head 1054 and front end 1122 of casing 1048.

Mount blocks 1192 may be rigidly secured to and extend forward from front surface 1198 of respective arms 1208. Each mount block 1192 has a plurality of forward facing steps 1214 and each mount block has a radial inner end 1216 and a radial outer end 1218 wherein inner end 1216 may be adjacent or in contact with the outer perimeter of swivel mount 1190. Steps 1214 are positioned such that the closer the given step is to the inner end 1216, the further forward that step is. Thus, the step which is closest to outer end 1218 is the most rearward, with the next step 1214 being further forward, the next or middle step being further forward and so forth such that the step closest to end 1216 is furthest forward of the various steps.

While most of the cutter teeth 1194 in the sample embodiment are shown secured to and extending forward from the forward facing steps 1214, some of the cutter teeth may be secured adjacent one of the radially extending surfaces of a given mount block 1192. These latter teeth 1194 may be secured to a trailing radial surface of a given block 1192 and may be spaced forward of and adjacent front surface 1198 of outer ring 1210. Most of the teeth 1194 shown are also positioned radially inward of outer perimeter 1202 although some of teeth 1194 and cutting faces 1196 extend radially outward beyond outer surface 1202 and outer surface 1126 of wider section 1050, for example those teeth 1194 which are secured to the trailing edge of each of blocks 1192. Each of the cutting faces 1196 shown faces in the direction of rotation of the cutter head 1054, discharge casing 1048 and outer portion of swivel 1056 which occurs during the cutting operation and which is shown by Arrows S FIGS. 15, 17, 18 and 20.

Referring now to FIG. 18A, swivel 1056 includes a first or outer portion 1220 and a second or inner portion 1222 which are rotatable relative to one another about axis X1. Outer portion 1220 has a front end 1224 and a back end 1226 which may serve as the back end of swivel 1056. Outer portion 1220 includes a generally cylindrical sidewall 1228 which defines front and back ends 1224 and 1226. Sidewall 1228 may for example include two segments which are threadedly secured to one another at a threaded connection 1230. Outer portion 1220 may include an externally threaded portion 1232 which threadedly engages internally threaded portion 1195 of swivel mount 190 to form a threaded connection therebetween to mount outer portion 1220 rigidly on swivel mount 1190. Outer portion 1220 extends forward from front end 1193 of swivel mount 1190. Outer portion 1220 may have a cylindrical outer surface 1234 which defines an outer diameter which may be the same as or substantially the same as diameter D2. Outer surface 1234 may be concentric about axis X1. Outer portion 1220 further includes an inner surface 1236 extending from front end 1224 to back end 1226 to define a passage 1238 likewise extending from front end 1224 to back end 1226. Passage 1238 receives therein a portion of narrower segment 1162 of shaft 1152 such that the front end 1156 of shaft 162 is forward of the rear end 1226 of outer portion 1220. Outer portion 1220, cutter head 1054, casing 1048, segment/connector 1040, cap 1062, coupler 1060, drive shaft 1038 may be rotatable together as a unit.

Inner portion 1222 has a front end 1240 and a back end 1242. Front end 1240 may serve as the front end of swivel 1056. Inner portion 1222 includes a sidewall 1244 which generally has a circular cross section, an outer surface 1246 (which may be concentric about axis X1) and an inner surface 1248 defining a swivel air passage 1250 extending from front end 1240 to back end 1242. A rear portion of swivel air passage 1250 and a front portion of auger air passage 1170 may together serve as or represent a cutter head air passage 1251 which extends rearward through cutter head 1054. Passage 1251 may extend from front end 1193 of swivel mount 1190 and cutter head 1054 to back end or surface of plate 1188 and cutter head 1054. Passages 1251, 1250 and 1170 are spaced from and separate from cuttings entrance openings or passages 1206, which may be spaced radially outward of passages 1251, 1250 and 1170. Axis X1 may pass through passages 1007, 1112, 1144, 1170, 1250 and 1251 while not passing through entrance openings 1206. Having described the various passages thus far, it is noted that compressor 1028, conduit 1030, swivel 1026, passage 1007, passage 1251, passage 1250, passage 1170, passage 1112, passage 1096, openings 1098, chamber 1084, outlet 1044 and hose 1046 are all in fluid communication with one another. Compressor 1028 is in fluid communication with these various passages via the respective front ends thereof so as to move pressurized air rearward through the given air passage from the front end thereof to the back end thereof.

Sidewall 1244 may include a wider front section 1252 and a narrower rear section 1254 which may be also termed an insert portion inasmuch as it is inserted or received within passage 1238 of outer portion 1220. Outer surface 1246 of narrower section 1254 and inner surface 1236 of outer portion 1224 defined therebetween an annulus 1256 which is part of passage 1238. Insert portion 1254 may include an externally threaded portion 1258 which extends forward from rear end 1242 and which threadedly engages threaded section 1163 of narrower segment 1162 to form a threaded connection which rigidly secures inner portion 1222 of swivel 1056 to segment 1162 of shaft 1152 such that inner portion 1222 extends forward from the front end of shaft 1152. Wider section 1252 of sidewall 1244 may have an internally threaded portion 1260 adjacent and extending rearwardly from front end 1240 which is configured to threadedly engage a rear end or trailing end of pilot tube 1006 to secure pilot tube 1006 to portion 1222 of swivel 1056. One end, or a first or front end, of the pilot tube 1006 may be at station 1012/in pit 1012 connected to output/connector 1024, while the other end, or a second or rear end, of pilot tube 1006 may be at station 1014/in pit 1014 connected to inner portion 1222 of swivel 1056 whereby pilot tube 1006 is operatively connected or rotationally coupled to auger 1118. Pilot tube 1006, portion 1222 of swivel 1056 and auger 1118 are rotatable together as a unit about axis X1 independently of or relative to and in opposite direction (Arrows T in FIGS. 17, 18 and 20) to outer portion 1220, cutter head 1054 and casing 1048. The relative rotation may be facilitated by bearings 1262 which are received within passage 1238 and annulus 1256 and extend from inner surface 1236 to outer surface 1246 of narrower section 1254. Rotational output/connector 1024, pilot tube 1006 and inner portion 1222 of swivel 1056 may serve as a drive train extending between engine 1022 and auger 1118 for driving rotation of auger 1118. Annular seals 1264 may be provided between the inner and outer portions 1220 and 1222, such as shown in FIG. 18A between outer surface 1246 of narrower section 1254 and inner surface 1236 of outer portion 1220. The seals or O-rings 1264 are shown adjacent front end 1224 of outer section 1220 and thus may form a seal between inner and outer portion 1220 and 1222 to minimize or prevent the entry of liquid or particles into passage 1238 and annulus 1256 which might cause damage to bearings 1262 and other components of the swivel.

Referring again primarily to FIG. 18, auger 1118 and its location are discussed in greater detail. Front end 1164 of wider segment and the front end of the one or more flights 1154 may be adjacent back end/surface of cutter head 1054/plate 1188. Auger 1118 or a similar auger may extend only over a relatively short distance compared to the entire length of casing 1048, which of course increases as the reaming process progresses. In order to minimize the substantial weight that would otherwise be provided by an auger extending the full length of casing 1048, auger 1118 may be essentially entirely within the front region of casing 1048 and more particularly, wider segment 1160 of shaft 1152 and the one or more flights 1154 may be entirely within the front region of casing 1048. For example, segment 1160 and the one or more flights 1154 may be entirely within larger diameter section 1050/portion 1130, tapered portion 1134 and the front region or portion of narrower section 1052/frontmost segment 1100/portion 1132. Said another way, segment 1160 and the one or more flights 1154 may be entirely within wider portion 1146, tapered portion 1150, and the front region or portion of the narrower portion of cuttings passage 1144 which may include narrower portion 1148 and/or the front region or portion of passage 1112 of foremost casing segment 1100. Auger 1118 may be shortened such that segment 1160 and the one or more flights 1154 may be entirely within larger diameter section 1050/portion 1130 and tapered portion 1134 or entirely within larger diameter section 1050/portion 1130. Said another way, segment 1160 and the one or more flights 1154 may be entirely within wider portion 1146 and tapered portion 1150 or be entirely within wider portion 1146. Rear end 1158 and rear entrance opening 1174 of passage 1170 may, for example, be adjacent (and rearward or forward of): tapered portion 1134 including front and back ends thereof; narrower portion 1132 including front and back ends thereof; the back end 1136 of larger section 1050/portion 1130; the front end 1102 or 1138 of narrower section 1052/frontmost segment 1100; the back end 1124 of casing segment 1116/portion 1132; narrow portion 1148 and front and back ends thereof; tapered portion 1150 and front and back ends thereof; the back end of wider portion 1146; and the front end of the narrower cuttings passage of section 1052 made up of passages 1112. Back end 1158 may be forward of the back end 1104 (FIG. 7) of the frontmost casing segment 1100, and may be distal said back end 1104. It may be, for instance, that auger 1118 extends rearwardly from front end 1122 of casing 1048/section 1050/segment 1116 no more than 5, 10, 15, 20, 25 or 30 feet. Similarly, auger 1118 may, for instance, extend rearwardly from back surface or end 1200 of cutter head 1054/plate 1188 no more than 5, 10, 15, 20, 25 or 30 feet. Back end 1158 may be within a front region of casing 1048 so that there is no auger within the casing rearward of the back end 1158.

System 1000 may be free of an auger or there may be no auger (which may include one or more helical auger flights and may include a shaft from which the one or more flights extend radially outwardly) which is within or extends through the passages 1112 of casing segments 1100 other than the frontmost segment 1100, or in the case where auger 1118 does not extend rearwardly into passage 1112 of foremost casing 1100 and/or narrower portion 1148 of passage 1144, system 1000 may be free of or not include such an auger which is within or extends through any of the passages 1112 of casing segments 1100 or the narrower passage of section 1052 made up of said passages 1112. System 1000 may be free of or not include such an auger which is within or extends through casing 1048/section 1052 adjacent the rear end of casing 1048/section 1052 or adjacent casing segment/connector 1040 and rig 1002 including drive shaft 1036, coupler 1060, end/pushing cap 1062, openings 1098, discharge box 1042 and tracks 1034.

Figure 20:
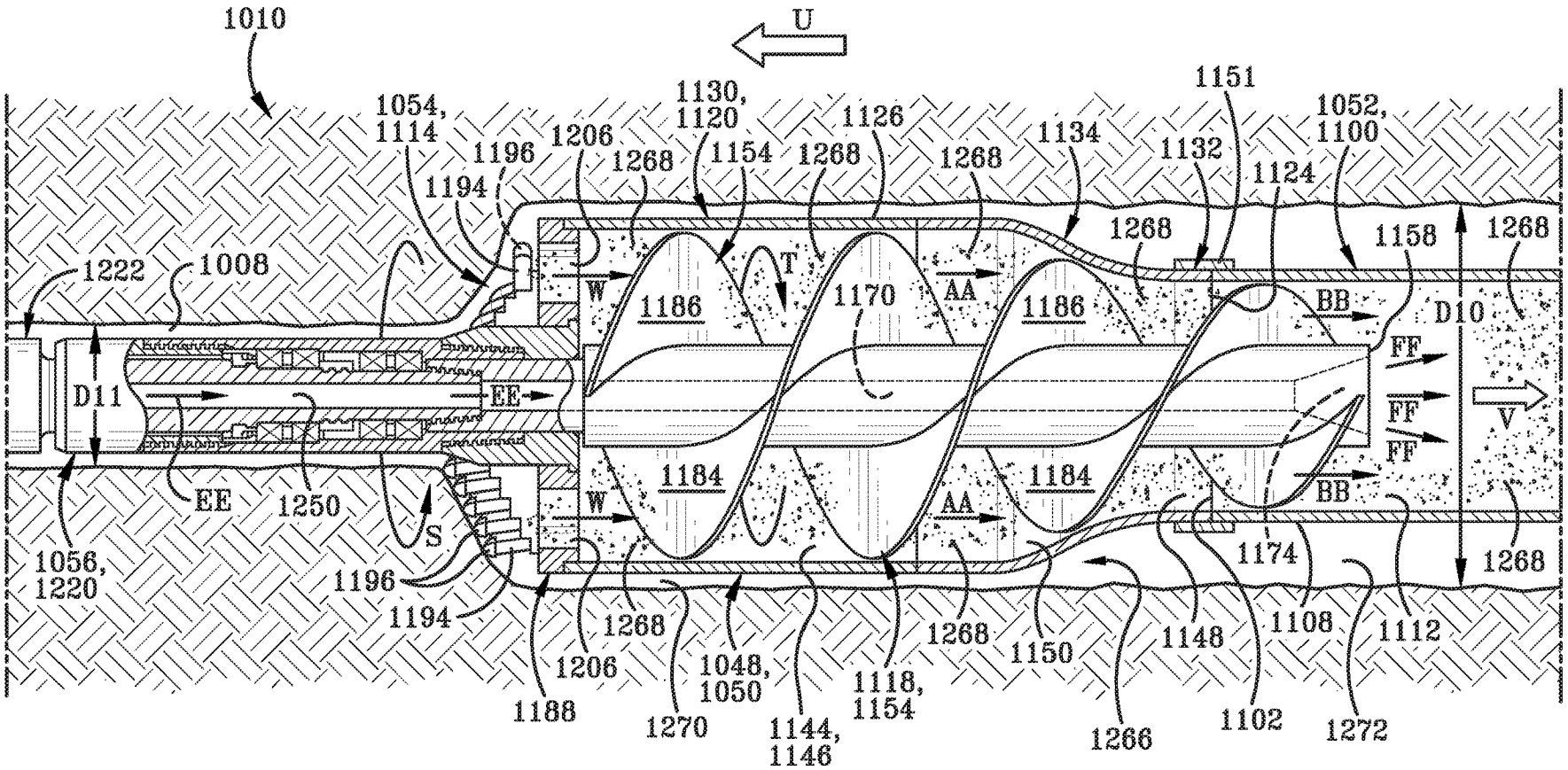
FIG. 20 (FIG. 20) is an enlarged operational view showing the operation of the reamer assembly in the cutting head region.

With primary reference to FIGS. 13, 19, and 20, the operation of system 1000 is now described. As shown and discussed previously with respect to FIG. 13, pilot tube or drill string 1006 may be used to form pilot hole 1008. This may be done in any manner known in the art. Pilot hole 1008 may be formed by forcing and/or drilling with pilot tube 1006 from station 1012 to station 1014 or in the opposite direction from station 1014 to station 1012. Thus, rig 1004 might be used to drive pilot tube 1006 from station 1012 to station 1014, or rig 1002 may be used to drive pilot tube 1006 from station 1014 to station 1012. As is well-known, this would be done by adding pilot tube segments 1032 in an end-to-end fashion as the pilot hole 1008 became longer. Once pilot tube 1006 has formed pilot hole 1008 such that one end of pilot tube 1006 is exposed at station 1012 and the other end exposed at station 1014, the end exposed at station 1012 may be connected to the rotational output or connector 1024 of rig 1004, and the other end of pilot tube 1006 at station 1014 may be connected to the front end 1240 of swivel 1056 such as by a threaded engagement with threaded portion 1260 of the swivel.

With the reamer 1114 connected to the back end of the swivel 1056 and with one or more casing segments 1100 secured to the back of reamer assembly 1114 and to the front of connector 1040, engine 1036 of rig 1002 may be operated to drive rotation of drive shaft 1036, coupler 1060 and cap 1062 (FIG. 15) as well as the rotation of connector 1040, casing 1048, cutter head 1054 and outer portion 1220 of swivel 1056 in the cutting direction illustrated by Arrow S in FIG. 20. This rotation may be relative to auger 1118, inner portion 1222 of swivel 56 and pilot tube 1006, which may be rotated in the opposite direction (Arrow T) at the same time by rotation of output/connector 1024 when driven by engine 1022 of rig 1004. All of this rotational movement may occur during forward movement (Arrow U in FIG. 20) toward station 1012. More particularly, this forward movement includes a forward movement of engine 1036, box 1042, connector 1040, casing 1048, reamer 1114 including cutter head 1054 and auger 1118, swivel 1056, pilot tube 1006, engine 1022, swivel 1026 and connector 1024. As this forward movement continues such that cutter head lengthens borehole 1266, casing segments 1100 are added to the back of section 1052 to lengthen section 1052 and casing 1048. The rotation of cutter head 1054 and forward movement thereof results in cutter head 1054 cutting an enlarged borehole 1266 (FIGS. 19, 20) which is larger than and follows pilot hole 1008 and extends from station 1014 to station 1012 when completed. Like pilot hole 1008, borehole 1266 may be arcuate or curved such that holes 1008 and 1266 may have a shallow U-shaped configuration such that they angle downwardly from one or both ends so as to pass under obstacle 18 whereby one or both ends of holes 1008 and 1266 may be higher than the portion which passes beneath obstacle 1018.

Borehole 1266 has a diameter D10 which is larger than a diameter D11 of pilot hole 1008, as shown in FIG. 20. The above noted rotation and forward movement may be achieved or effected by rig 1002 rotating and pushing (or applying a forward force to) the rear end of casing 1048 (such as with drive shaft 1038, coupler 1060, pushing cap 1062 and/or segment 1040) and may be aided by rig 1004 pulling pilot tube 1006 to in turn pull swivel 1056, reamer 1114 including cutter head 1054 and segment 1116, casing 1048, etc. Usually, all or most of this forward movement is effected or driven by rig 1002 via said pushing or application of forward force, and all of this rotation is effected or driven by rig 1002 via rotation of drive shaft 1038, coupler 1060, pushing cap 1062 and/or segment 1040. The difference between diameters D10 and D3 of narrower section 1050/segments 1100 may be the same as or fall in the same range as discussed with respect to the difference between diameters D4 and D3. Likewise, there may be a ratio of diameter D10 to diameter D3 which is the same as or within the same range as discussed with respect to the ratio of diameter D4 to diameter D3.

During the cutting process and as shown in FIG. 20, cuttings 1268 produced by the cutting engagement of cutter head 1054 with ground 1010 in forming borehole 1266 may be moved rearwardly (Arrow V in FIG. 20) through discharge casing 1048 and as shown by various arrows in FIG. 15, through passage 1096 of casing segment 1040 and out of passage 1096 through openings 1098 into interior chamber 1084 and out of chamber 1084 through outlet 1044 and hose 1046. The rearward or discharging movement generally indicated by Arrow V in FIG. 20 may include more specifically rearward movement of cuttings 1268 from adjacent cutting teeth 1194 through openings 1206 in base plate 1188 (Arrows W in FIG. 20), through the portions 1146, 1148 and 1150 of cuttings passage 1144 (Arrows AA in FIG. 20), through the narrower casing cuttings passage of narrower section 1052 made up of the various casing segment passages 1112 (Arrows BB in FIGS. 20 and 15), through and out of passage 1096 via openings 1098 (Arrows CC in FIG. 15) into chamber 1084, and out of chamber 1084 via outlet 1044 into hose 1046 or the like as shown at Arrows DD in FIG. 15. This rearward or discharge movement of cuttings 1268 may be facilitated or effected by rotation of auger 1118 (Arrow T in FIG. 20) and rearward movement of pressurized air from air compressor 1028 (FIG. 19) through conduit 1030, swivel 1026, connector 1024, pilot tube 1006, swivel 1056, auger 1118 and the cuttings discharge passage of casing 1048, such as the narrower cuttings passage of section 1052 formed of passages 1112 and downstream or rearward thereof through passage 1096, openings 1098, chamber 1084, outlet 1044 and hose 1046 as shown in FIG. 15. The rearward flow of compressed air is thus also represented in FIG. 15 at Arrows BB, CC, and DD. In addition, FIG. 20 illustrates air flow at Arrows EE and Arrows FF, wherein Arrows EE illustrate the rearward flow of compressed air through air passage 1250 of swivel 1056 and air passage 1170 of auger 1118, and Arrows FF illustrate the rearward flow of compressed air out of the exit opening 1174 of passage 1170 adjacent rear end 1158 of auger 1118 and into the cuttings passage of casing 1048, which may in particular be the narrower cuttings passage defined by segment passages 1112. Cuttings 1268 may slide along the tapered inner surface 1128 of tapered portion 1134 to facilitate rearward movement into narrower portion 1132/section 1052. Rotation of casing 1048 may include rotation of the rear end of the casing within interior chamber 1084 of a box 1042 while cuttings 1268 are discharged out of the rear end of the casing via openings 1098 into chamber 1084.

Where auger 1118 is used, the rotation of auger 1118 may facilitate the rearward movement of cuttings 1268 through portions 1146, 1148, and 1150 of passage 1144 and the front portion of the passage defined by narrower section 1052, which may be the front portion of passage 1112 of the foremost casing 1100. In the sample embodiment, a forward or front portion of cuttings 1268 may be disposed within portions 1146, 1148, and 1150 as well as the front section of passage 1112 of the frontmost casing 1100 forward of the back end 1158 of auger 1112 and the exit opening of passage 1170 such that compressed air enters the cuttings passage defined by casing 1048 rearward of this forward or front portion of the cuttings 1268. Rotation of auger 1118 may push, force or deliver cuttings 1268 rearwardly to the region adjacent back end 1158 so that the pressurized air exiting rear entrance opening 1174 into the cuttings passage of casing 1048 and shown at Arrows FF in FIG. 20 forces cuttings 1268 rearward of back end 1158 rearwardly through the cuttings passage for discharge out of the rear end of casing 1048 and from system 1000, such as through passages 1112 and 1096, openings 1098, chamber 1084, outlet 1044 and hose 1046. In the sample embodiment, compressed air performs the vast majority of movement of cuttings 1268 rearwardly to discharge them.

Compressor 1028 may compress air to produce the above noted pressurized air at a pressure which may vary according to the requirements. By way of example, this pressure may be at least 200, 250, 300 or 350 pounds per square inch (psi) and may be more. Compressor or air pump 1028 may also deliver or cause the pressurized air to flow rearwardly through pilot tube 1008, swivel 1056, auger 1118, casing 1048 and beyond at a rate which may be at least 700, 750, 800, 850, 900, 950, 1000, 1050 or 1100 cubic feet per minute (cfm) or more if needed or suitable.

Although system 1000 may pump drilling fluid through the various air and cuttings passages instead of air (whereby these passages may be fluid or liquid passages), the use of air avoids problems such as those discussed in the Background section herein. Thus, system may be configured to eliminate or essentially eliminate the use of drilling fluid for use with cutter head 1054 and/or for use in discharging cuttings 1268. Thus, for instance, moving the pressurized air rearwardly through pilot tube air passage 1007, swivel air passage 1250, auger air passage 1170, casing air passage/cuttings passage 1112, air passage/cuttings passage 1096, discharge openings 1098, interior chamber 1084, outlet 1044 and so forth may be achieved without (or essentially without) moving drilling fluid or discharge fluid rearwardly through the same, wherein such drilling fluid or discharge fluid may be in the form of liquid water (i.e. water in its liquid state), a bentonite slurry (which normally would include liquid water), liquid polymers, or any other liquid, aside from any liquid which may form within these various passages etc. by condensation (e.g., gaseous water from air in the passages condensing to form liquid water) or incidental leakage which might occur at joints or connections between pilot tube segments 1032 or other components such that water/other liquid outside the pilot tube or other components might enter the passages etc.

While water or other liquid occurring naturally in ground through which the cutter head cuts the borehole may inherently be adjacent or in contact with the cutter head and facilitate the reaming or cutting process, the reaming process may occur without delivering such a drilling fluid or discharge fluid adjacent or into contact with the cutter head, such as may occur in many processes to facilitate cutting and/or entraining cuttings therein for discharge out of the borehole along a path inside a casing or outside of a casing, such as in an annulus around the casing. Thus, the rotation and forward movement of the cutter head and casing to cut the borehole may occur without delivering a liquid adjacent or into contact with the cutter head other than liquid occurring naturally in ground through which the cutter head cuts the borehole. It may be that such drilling fluid or discharge fluid is not delivered through a conduit to adjacent the cutter head, such as a passage formed in the pilot tube, a passage within the casing, a conduit outside the casing, or through an annulus within the borehole around the casing defined between the outer surface of the casing and the inner surface defining the borehole. System 1000 may thus be configured so that none or essentially none of the cuttings created by the cutter head are discharged from the casing or borehole using a liquid or fluid (such as those noted above), or said in another way, so that no liquid or fluid, or essentially no liquid or fluid, is used to entrain and/or force, discharge or remove such cuttings from the casing or borehole, other than the above-noted liquid occurring naturally in the ground (which might enter the cuttings passage via entrance openings 1206), condensation or inadvertent leakage at joints between components.

The ability to avoid the use of drilling fluid as discussed above eliminates the frac-out problems noted in the Background section herein. In addition, the elimination of frac-out problems allows for the ability to drill shorter boreholes because the borehole can be cut closer to a given obstacle 1018. That is, the borehole need not extend as far down or deep into the earth, thereby substantially decreasing the required borehole length at substantial cost savings. The ability to drill shallower boreholes also often avoids or minimizes the necessity of drilling through rock.

The use of casing 1048 during rotation thereof may also vastly reduce the friction between the outer surface of the casing and the inner surface defining borehole 1266 which would occur with a casing of having a diameter of larger casing section 1050 because a large portion of outer surface 1108 of narrower section 1052 does not engage the inner surface defining borehole 1266, even when the borehole is curved. Once borehole 1266 is completed to extend from station 1012 to station 1014, final product pipe or casing may be installed in borehole 1266 in any manner known in the art. Such pipe may, for instance, have an outer diameter D4 or a diameter greater than diameter D3 and less than diameter D4. In addition, in some situations, casing segments 1100 may also serve as the final product installed within borehole 1266.

Figure 21:
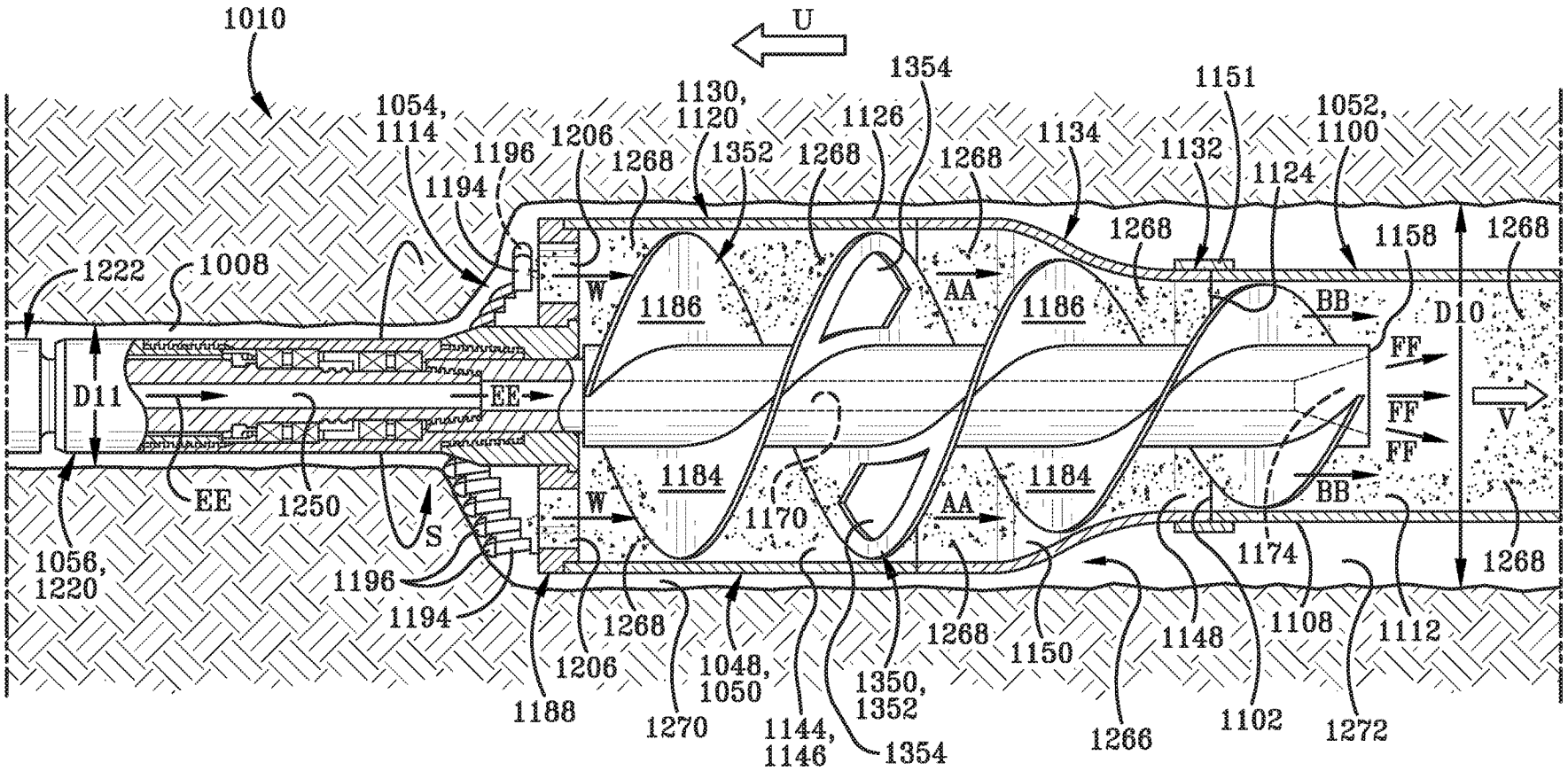
FIG. 21 (FIG. 21) is an enlarged operational view showing the operation of the reamer assembly in the cutting head region having a stationary auger.

FIG. 21 depicts an exemplary operation of an alternative embodiment of the reamer assembly 1114 which may include cutter head 1054 and a front casing segment 1116 which defines or includes larger diameter front section 1150. An auger 1350 having a helical flight 1352 may be disposed within the front casing segment. The earth-boring cutter head 1054 and the casing 1116 is secured to the cutter head 1054 and extends rearwardly therefrom so that the casing and cutter head are rotatable together as a unit. The casing cuttings passage extends from adjacent the casing front end to adjacent the casing back end. The entrance opening of the casing cuttings passage which is adjacent the cutter head and adapted to allow cuttings to move through the entrance opening into the casing cuttings passage. The auger 1350 positioned within the casing cuttings passage rearwardly from the entrance opening. The auger 1350 may be stationary relative to the longitudinal axis of the reamer assembly 1114. In some implementations, the stationary auger 1350 does not rotate when the casing and cutter head are rotated together as a unit.

With continued reference to FIG. 21, the method for drilling through earthen material may provide the steps of directing a gas through a pilot tube disposed below ground (as indicated by arrows EE). Further, directing the gas near a portion of a drilling or cutter head 1054 disposed below ground in operative communication with the pilot tube. Further, directing the gas through an interior bore defined by a first casing segment 1116, wherein the gas moving through the chamber carries spoils cut by the cutting head rearwardly through a second casing segment connected to the first casing segment 1116. FIG. 21 further provides for directing the gas around the auger 1350 located within the first casing segment. Then, directing the gas through the interior bore of the first casing segment 1116 while the first casing segment is rotating about a longitudinal axis. In FIG. 21, the auger 1350 is stationary and does not rotate about the longitudinal axis. Then, the method may provide for directing the gas around a first section of a stationary flute 1352 of the auger having a first diameter, and thereafter directing the gas around a second section of the stationary flute having a second diameter less than the first diameter, wherein the first section is associated with a forward end of the auger such that the auger is rearwardly tapered. The method may further include directing the gas through an aperture 1354 defined in the stationary flute 1352 of the auger 1350. Additionally, the method identified in FIG. 21 may provide directing the gas through the interior bore of the first casing segment while the first casing segment is rotating about a longitudinal axis; and directing the gas to flow through a tapered portion of the first casing segment. This allows increasing a velocity of the flowing gas carrying the spoils downstream from the tapered portion of the first casing segment. Additionally there is an increased pressure in the gas inside the first casing segment, which then generates a pocket of gas retained behind spoils that increases in pressure until the pocket of gas behind the spoils overcomes forces retaining the spoils inside the first casing segment. Thereafter, the pocket of gas is released, in one or more burps, in response to the pocket of gas overcoming the forces that retain the spoils in the first casing segment.

FIG. 21 further depicts the operation of the reamer assembly by rotating the first casing segment 1116 about the longitudinal axis disposed below ground. Additionally, receiving spoils composed of cut aggregate material carried by a gas in the first casing segment, as indicated by arrows AA. Then, advancing the first casing segment forwardly (as indicated by arrow U) simultaneous to rotation of the first casing segment (as indicated by Arrow S) to cut earthen material into aggregate material. This method effects rearward displacement of the cut aggregate material carried by the gas through the first casing segment, as indicated by arrows BB. The auger 1350 is maintained stationary relative to the first casing segment so that the auger does not rotate about the longitudinal axis. Further, the longitudinally aligned aperture 1354 formed in the flight 1352 of the auger 1350 is maintained in a fixed orientation relative to the longitudinal axis. Alternatively, the auger may be rotated as indicated by auger 1118 in FIG. 20. For example, rotating the auger about the longitudinal axis relative to the first casing segment or rotating a longitudinally aligned aperture formed in a flight of the auger about the longitudinal axis. Additionally, the auger may be rotated in a rotational direction opposite that of the casing segment.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented with software, the software code can be executed on any suitable processor or collection of processors, whether provided in a single computer or distributed among multiple computers operatively connected with or carried by the drilling rig or drilling apparatus. Collectively, this may refer to drilling rig control logic, that when executed by processors, effects the drilling rig or apparatus to create the bore beneath the earthen surface.

Further, it should be appreciated that a computer may be embodied in any of a number of forms, such as a rack-mounted computer, a smartphone, a desktop computer, a laptop computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, the computer used to control the drilling rig may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers used to control the drilling rig may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

The terms "program" or "software" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

That which is claimed:

1. A method for drilling through earthen material comprising:

directing a compressed gas through a pilot tube disposed below ground;

directing the compressed gas near a portion of a cutting head disposed below ground in operative communication with the pilot tube;

directing the compressed gas through an interior bore defined by a first casing segment;

wherein the compressed gas moving through the interior bore carries spoils cut by the cutting head rearwardly through a second casing segment connected to the first casing segment.

2. The method for drilling through earthen material of claim 1, further comprising:

directing the compressed gas around an auger located within the first casing segment.

3. The method for drilling through earthen material of claim 2, further comprising:

directing the compressed gas through the interior bore of the first casing segment while the first casing segment is rotating about a longitudinal axis.

4. The method for drilling through earthen material of claim 3, wherein the auger is stationary and does not rotate about the longitudinal axis.

5. The method for drilling through earthen material of claim 4, further comprising:

directing the compressed gas around a first section of a stationary flute of the auger having a first diameter, and thereafter directing the compressed gas around a second section of the stationary flute having a second diameter less than the first diameter, wherein the first section is associated with a forward end of the auger such that the auger is rearwardly tapered.

6. The method for drilling through earthen material of claim 5, further comprising:

directing the compressed gas through an aperture defined in the stationary flute of the auger.

7. The method for drilling through earthen material of claim 6, comprising:

directing the compressed gas around a forward facing surface on the stationary flute of the auger.

8. The method for drilling through earthen material of claim 1, further comprising:

directing the compressed gas through the interior bore of the first casing segment while the first casing segment is rotating about a longitudinal axis;

directing the compressed gas to flow through a tapered portion of the first casing segment.

9. The method for drilling through earthen material of claim 8, further comprising:

increasing a velocity of the flowing compressed gas carrying the spoils downstream from the tapered portion of the first casing segment.

10. The method for drilling through earthen material of claim 1, further comprising:

increasing pressure in the compressed gas inside the first casing segment;

generating a pocket of compressed gas retained behind spoils that increases in pressure until the pocket of compressed gas behind the spoils overcomes forces retaining the spoils inside the first casing segment;

releasing the pocket of compressed gas, in one or more burps, in response to the pocket of compressed gas overcoming the forces that retain the spoils in the first casing segment.

11. A method for drilling through earthen material comprising:

rotating a first casing segment about a longitudinal axis disposed below ground;

receiving spoils composed of cut aggregate material carried by a compressed gas in the first casing segment;

advancing the first casing segment forwardly simultaneous to rotation of the first casing segment to cut earthen material into aggregate material; and effecting rearwardly displacement of the cut aggregate material carried by the compressed gas through the first casing segment.

12. The method for drilling through earthen material of claim 11, further comprising:

effecting aggregate material to pass along a portion of an auger at least partially disposed within the first casing segment.

13. The method for drilling through earthen material of claim 12, further comprising:

maintaining the auger stationary relative to the first casing segment so that the auger does not rotate about the longitudinal axis.

14. The method for drilling through earthen material of claim 13, further comprising:

maintaining a longitudinally aligned aperture formed in a flight of the auger in a fixed orientation relative to the longitudinal axis.

15. The method for drilling through earthen material of claim 12, further comprising:

rotating the auger about the longitudinal axis relative to the first casing segment.

16. The method for drilling through earthen material of claim 15, further comprising:

rotating a longitudinally aligned aperture formed in a flight of the auger about the longitudinal axis.

17. The method for drilling through earthen material of claim 15, further comprising:

rotating the auger opposite a rotational direction of the first casing segment.

18. The method for drilling through earthen material of claim 11, further comprising:

channeling the compressed gas near a portion of a cutting head connected to the first casing segment such that the cutting head rotates in unison with the first casing segment;

precluding the compressed gas from flowing exterior the first casing segment; and effecting cut aggregate material to be mixed with the compressed gas inside the first casing segment between an inner surface of the first casing segment and an outer surface of a stationary auger disposed within the first casing segment.

19. An earth boring apparatus comprising:

an earth-boring cutter head;

a casing secured to the cutter head and extending rearwardly therefrom so that the casing and cutter head are rotatable together as a unit, the casing having a casing front end and a casing back end;

a casing cuttings passage which extends from adjacent the casing front end to adjacent the casing back end;

an entrance opening of the casing cuttings passage which is adjacent the cutter head and adapted to allow cuttings to move through the entrance opening into the casing cuttings passage; and a stationary auger positioned within the casing cuttings passage rearwardly from the entrance opening, wherein the stationary auger does not rotate when the casing and cutter head are rotated together as a unit.

20. A method for drilling through earthen material comprising:

directing a gas through a pilot tube disposed below ground;

directing the gas near a portion of a drilling head disposed below ground in operative communication with the pilot tube;

directing the gas through an interior bore defined by a first casing segment;

wherein the gas moving through the interior bore carries spoils cut by the cutting head rearwardly through a second casing segment connected to the first casing segment;

directing the gas around an auger located within the first casing segment;

directing the gas through the interior bore of the first casing segment while the first casing segment is rotating about a longitudinal axis;

wherein the auger is stationary and does not rotate about the longitudinal axis;

directing the gas around a first section of a stationary flute of the auger having a first diameter, and thereafter directing the gas around a second section of the stationary flute having a second diameter less than the first diameter, wherein the first section is associated with a forward end of the auger such that the auger is rearwardly tapered.

21. A method for drilling through earthen material comprising:

rotating a first casing segment about a longitudinal axis disposed below ground;

receiving spoils composed of cut aggregate material carried by a gas in the first casing segment;

advancing the first casing segment forwardly simultaneous to rotation of the first casing segment to cut earthen material into aggregate material; and effecting rearwardly displacement of the cut aggregate material carried by the gas through the first casing segment;

effecting aggregate material to pass along a portion of an auger at least partially disposed within the first casing segment;

rotating the auger about the longitudinal axis relative to the first casing segment; and rotating a longitudinally aligned aperture formed in a flight of the auger about the longitudinal axis.

* * * * *